US010416581B2

(12) United States Patent
Ito et al.

(10) Patent No.: US 10,416,581 B2
(45) Date of Patent: Sep. 17, 2019

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Yota Ito, Mishima (JP); Tsutomu Nishida, Mishima (JP); Shoma Hinata, Mishima (JP); Tatsuya Yamaai, Yokohama (JP); Akira Sakakibara, Susono (JP); Daisuke Miura, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 181 days.

(21) Appl. No.: 15/667,715

(22) Filed: Aug. 3, 2017

(65) Prior Publication Data

US 2018/0059558 A1 Mar. 1, 2018

(30) Foreign Application Priority Data

Aug. 26, 2016 (JP) ..... 2016-165851

(51) Int. Cl.
*G03G 5/147* (2006.01)
*G03G 5/05* (2006.01)
(Continued)

(52) U.S. Cl.
CPC ..... *G03G 5/14773* (2013.01); *G03G 5/0539* (2013.01); *G03G 5/0564* (2013.01); *G03G 5/0578* (2013.01); *G03G 5/0603* (2013.01); *G03G 5/0612* (2013.01); *G03G 5/0614* (2013.01); *G03G 5/0668* (2013.01); *G03G 5/078* (2013.01); *G03G 5/14756* (2013.01); *G03G 15/75* (2013.01); *G03G 21/1814* (2013.01)

(58) Field of Classification Search
CPC ..... G03G 5/14773; G03G 5/14756
See application file for complete search history.

(56) References Cited

U.S. PATENT DOCUMENTS 7,704,657 B2 4/2010 Uesugi et al.
8,632,935 B2 1/2014 Sugiyama et al.
(Continued)

FOREIGN PATENT DOCUMENTS

JP H06-011877 1/1994
JP 2011-107363 6/2011

*Primary Examiner* — Erika J Villaluna
(74) *Attorney, Agent, or Firm* — Venable LLP

(57) ABSTRACT

An electrophotographic photosensitive member with suppressed potential variation even in the case that a protective layer including a cured material of a composition having a polymerizable functional group is used is provided. An electrophotographic photosensitive member including a support, a charge generation layer, a charge transport layer containing a charge transporting material, and a protective layer, in the order presented, wherein the charge transport layer contains a polycarbonate resin having a structure selected from a group A and a structure selected from a group B, and the protective layer includes a cured material of a composition containing a compound having at least a functional group selected from chain-polymerizable functional groups and sequential polymerizable functional groups.

14 Claims, 1 Drawing Sheet

(51) Int. Cl.

| | |
|---|---|
| ***G03G 5/06*** | (2006.01) |
| ***G03G 5/07*** | (2006.01) |
| ***G03G 15/00*** | (2006.01) |
| ***G03G 21/18*** | (2006.01) |

(56) References Cited

U.S. PATENT DOCUMENTS

| | | | |
|---|---|---|---|
| 8,765,335 | B2 | 7/2014 | Tanaka et al. |
| 8,846,281 | B2 | 9/2014 | Okuda et al. |
| 9,029,054 | B2 | 5/2015 | Okuda et al. |
| 9,063,505 | B2 | 6/2015 | Sekiya et al. |
| 9,069,267 | B2 | 6/2015 | Kaku et al. |
| 9,114,565 | B2 | 8/2015 | Kawai et al. |
| 9,170,506 | B2 | 10/2015 | Tanaka et al. |
| 9,170,507 | B2 | 10/2015 | Sugiyama et al. |
| 9,274,442 | B2 | 3/2016 | Sato et al. |
| 9,304,414 | B2 | 4/2016 | Miura et al. |
| 9,436,106 | B2 | 9/2016 | Kuno et al. |
| 9,459,545 | B2 | 10/2016 | Tanaka et al. |
| 9,523,929 | B2 | 12/2016 | Nakamura et al. |
| 9,535,346 | B2 | 1/2017 | Sekiya et al. |
| 9,541,850 | B2 | 1/2017 | Nishida et al. |
| 9,563,139 | B2 | 2/2017 | Kawahara et al. |
| 9,645,515 | B2 | 5/2017 | Kuno et al. |
| 9,645,516 | B2 | 5/2017 | Kawahara et al. |
| 9,772,569 | B2 | 9/2017 | Tanaka et al. |
| 9,772,596 | B2 | 9/2017 | Mitsui et al. |
| 9,864,284 | B2 * | 1/2018 | Kawahara ..... G03G 5/047 |
| 2014/0093281 | A1 | 4/2014 | Takahashi et al. |
| 2014/0212800 | A1 | 7/2014 | Miura et al. |
| 2015/0185630 | A1 | 7/2015 | Ito et al. |
| 2015/0185634 | A1 | 7/2015 | Sekiya et al. |
| 2015/0316863 | A1 | 11/2015 | Tanaka et al. |
| 2015/0346616 | A1 | 12/2015 | Kawahara et al. |
| 2015/0346617 | A1 | 12/2015 | Kawahara et al. |
| 2015/0362847 | A1 | 12/2015 | Tanaka et al. |
| 2016/0091807 | A1 | 3/2016 | Tanaka et al. |
| 2016/0131985 | A1 | 5/2016 | Tanaka et al. |
| 2016/0154326 | A1 | 6/2016 | Kumoi et al. |
| 2016/0154328 | A1 | 6/2016 | Kumoi et al. |
| 2017/0227858 | A1 | 8/2017 | Tomono et al. |

* cited by examiner

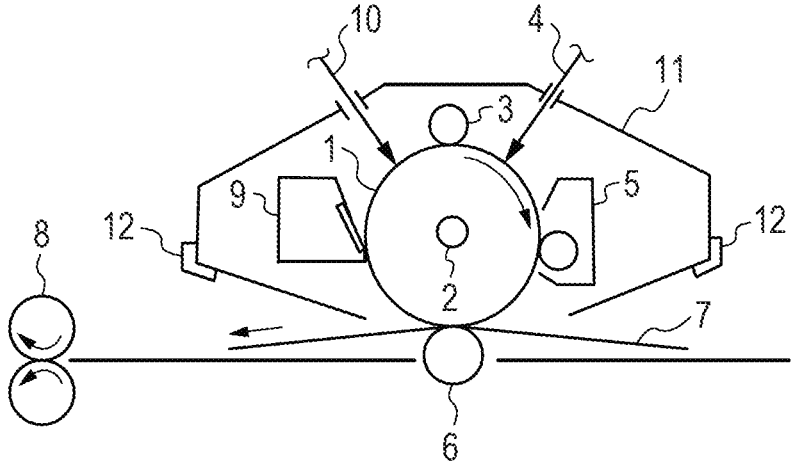
10
4
11
3
1
9
5
12
12
8
2
7
6

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member and a method for producing the same, and a process cartridge and electrophotographic apparatus each using the electrophotographic photosensitive member.

Description of the Related Art

For electrophotographic photosensitive members to be installed in a process cartridge or electrophotographic apparatus, electrophotographic photosensitive members containing an organic photoconductive material (charge generating material) are used. An electrophotographic photosensitive member generally includes a support and a photosensitive layer formed on the support.

For a photosensitive layer, a laminated photosensitive layer in which a charge transport layer containing a charge transporting material is laminated on a charge generation layer containing a charge generating material is suitably used.

An electrophotographic apparatus with a longer product life has been demanded in recent years, and hence it is desired to provide an electrophotographic photosensitive member having enhanced abrasion resistance to mechanical force and potential variation-suppressing effect to electric force in combination. To enhance the abrasion resistance, a protective layer is occasionally provided on a charge transport layer. For a protective layer, a cured material of a composition having a polymerizable functional group which is polymerized through external energy such as heat, light (e.g., ultraviolet rays) and radiation (e.g., electron beams) is suitably used.

However, adverse effects due to the presence of a protective layer are problematic, and to solve the problem various examinations have been made on polycarbonate resins to be used for a charge transport layer. Japanese Patent Application Laid-Open No. H06-011877 discloses a technique in which a particular polycarbonate resin is used as a countermeasure to cracks to be generated between a protective layer and a photosensitive layer in formation of the protective layer. Japanese Patent Application Laid-Open No. 2011-107363 discloses a technique in which a particular polycarbonate resin is used for reduction of image unevenness.

The present inventors conducted examination, and the results revealed that the polycarbonate resins described in Japanese Patent Application Laid-Open No. H06-011877 and Japanese Patent Application Laid-Open No. 2011-107363 may have insufficient potential variation-suppressing effect, and leave room for further improvement.

SUMMARY OF THE INVENTION

The present invention is directed to providing an electrophotographic photosensitive member with suppressed potential variation even in the case that a protective layer including a cured material of a composition having a polymerizable functional group is used, and a method for producing the electrophotographic photosensitive member. Further, the present invention is directed to providing a process cartridge and electrophotographic apparatus each including the electrophotographic photosensitive member.

The above objects are achieved by the present invention. Specifically, according to one aspect of the present invention, there is provided an electrophotographic photosensitive member comprising a support, a charge generation layer, a charge transport layer containing a charge transporting material, and a protective layer, in the order presented, wherein the charge transport layer contains a polycarbonate resin having a structure selected from a group A below and a structure selected from a group B below, and the protective layer includes a cured material of a composition containing a compound having at least a functional group selected from chain-polymerizable functional groups and sequential polymerizable functional groups.

Examples of the structure selected from a group A include structures represented by the following formulas (101) and (102).

Formula (101)

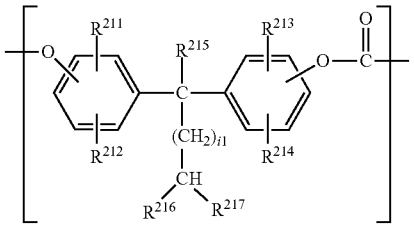

In the formula (101), $R^{211}$ to $R^{214}$ each independently represent a hydrogen atom, an alkyl group, an aryl group, or an alkoxy group; $R^{215}$ represents an alkyl group, an aryl group, or an alkoxy group; $R^{216}$ and $R^{217}$ each independently represent an alkyl group having one to nine carbon atoms; and i1 represents an integer of 0 to 3, provided that $R^{215}$ and $(CH_2)_{i1}CHR^{216}R^{217}$ are not the same.

Formula (102)

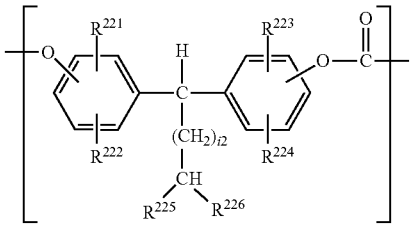

In the formula (102), $R^{221}$ to $R^{224}$ each independently represent a hydrogen atom, an alkyl group, an aryl group, or an alkoxy group; $R^{225}$ and $R^{226}$ each independently represent an alkyl group having one to nine carbon atoms, provided that $R^{225}$ and $R^{226}$ are not the same; and i2 represents an integer of 0 to 3.

Examples of the structure selected from a group B include structures represented by the following formula (104), formula (105) and formula (106).

Formula (104)

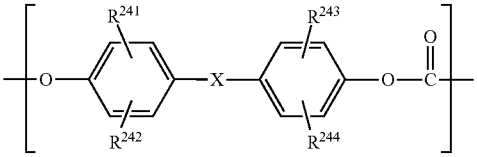

In the formula (104), $R^{241}$ to $R^{244}$ each independently represent a hydrogen atom, an alkyl group, an aryl group, or an alkoxy group; and X represents a single bond, an oxygen atom, a sulfur atom, or a sulfonyl group.

Formula (105)

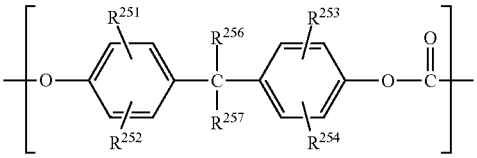

In the formula (105), $R^{251}$ to $R^{254}$ each independently represent a hydrogen atom, an alkyl group, an aryl group, or an alkoxy group; and $R^{256}$ and $R^{257}$ each independently represent a hydrogen atom, an alkyl group, an aryl group, or a halogenated alkyl group.

Formula (106)

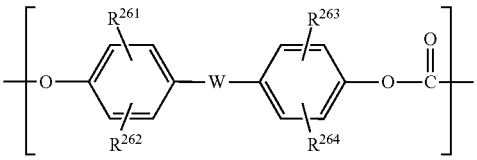

In the formula (106), $R^{261}$ to $R^{264}$ each independently represent a hydrogen atom, an alkyl group, an aryl group, or an alkoxy group; and W represents a cycloalkylidene group having 5 to 12 carbon atoms.

Alternatively, the above objects are achieved by the present invention in the following. Specifically, according to another aspect of the present invention, there is provided an electrophotographic photosensitive member comprising a support, a charge generation layer, a charge transport layer containing a charge transporting material, and a protective layer, in the order presented, wherein the charge transport layer contains a polycarbonate resin having a structure represented by a formula (121) below and a structure represented by the formula (104), and the protective layer includes a cured material of a composition containing a compound having at least a functional group selected from chain-polymerizable functional groups and sequential polymerizable functional groups.

Formula (121)

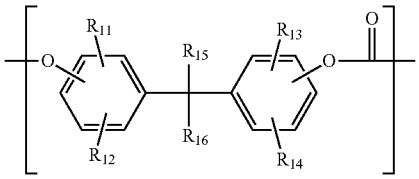

In the formula (121), $R^{11}$ to $R^{15}$ each independently represent a hydrogen atom, a methyl group, an ethyl group, or a phenyl group; and $R^{16}$ represents a linear alkyl group having 6 to 15 carbon atoms.

According to the present invention, an electrophotographic photosensitive member with suppressed potential variation even in the case that a protective layer including a cured material of a composition having a polymerizable functional group is used can be provided through use of a particular polycarbonate resin for a charge transport layer.

Further features of the present invention will become apparent from the following description of exemplary embodiments with reference to the attached drawing.

BRIEF DESCRIPTION OF THE DRAWING

FIGURE is a diagram illustrating one example of the schematic configuration of an electrophotographic apparatus including a process cartridge including an electrophotographic photosensitive member according to the present invention.

DESCRIPTION OF THE EMBODIMENTS

Preferred embodiments of the present invention will now be described in detail in accordance with the accompanying drawing.

Hereinafter, the present invention will be described in detail with reference to exemplary embodiments. The present inventors conducted examination, and found that use of an electrophotographic photosensitive member including a charge transport layer containing a particular polycarbonate resin enables achievement of enhancement of the abrasion resistance and potential variation-suppressing effect in combination, even in the case that a protective layer including a cured material of a composition having a polymerizable functional group is used. Specifically, the electrophotographic photosensitive member according to the present invention is an electrophotographic photosensitive member including a support, a charge generation layer, a charge transport layer containing a charge transporting material, and a protective layer, in the order presented, wherein the charge transport layer contains a polycarbonate resin having a structure selected from a group A below and a structure selected from a group B below, and the protective layer includes a cured material of a composition containing a compound having at least a functional group selected from chain-polymerizable functional groups and sequential polymerizable functional groups.

Examples of the structure selected from a group A include structures represented by the following formulas (101) and (102).

Formula (101)

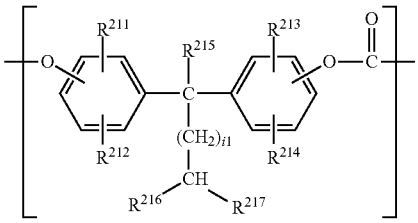

In the formula (101), $R^{211}$ to $R^{214}$ each independently represent a hydrogen atom, an alkyl group, an aryl group, or an alkoxy group; $R^{215}$ represents an alkyl group, an aryl group, or an alkoxy group; $R^{216}$ and $R^{217}$ each independently represent a substituted or unsubstituted alkyl group having one to nine carbon atoms; and i1 represents an integer of 0 to 3, provided that $R^{215}$ and $(CH_2)_{i1}CHR^{216}R^{217}$ are not the same.

Formula (102)

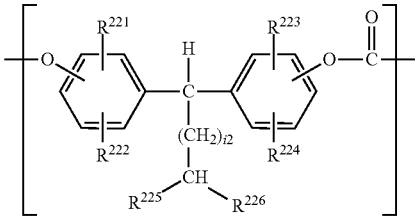

In the formula (102), $R^{221}$ to $R^{224}$ each independently represent a hydrogen atom, an alkyl group, an aryl group, or an alkoxy group; $R^{225}$ and $R^{226}$ each independently represent a substituted or unsubstituted alkyl group having one to nine carbon atoms, provided that $R^{225}$ and $R^{226}$ are not the same; and i2 represents an integer of 0 to 3.

Examples of the structure selected from a group B include structures represented by the following formula (104), formula (105) and formula (106).

Formula (104)

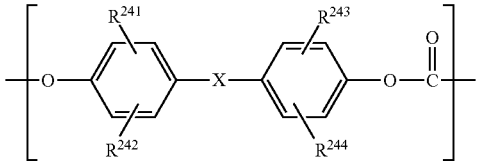

In the formula (104), $R^{241}$ to $R^{244}$ each independently represent a hydrogen atom, an alkyl group, an aryl group, or an alkoxy group; and X represents a single bond, an oxygen atom, a sulfur atom, or a sulfonyl group.

Formula (105)

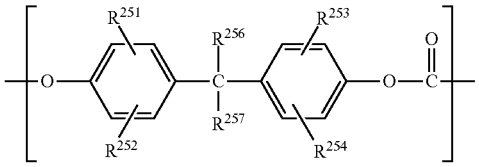

In the formula (105), $R^{251}$ to $R^{254}$ each independently represent a hydrogen atom, an alkyl group, an aryl group, or an alkoxy group; $R^{256}$ and $R^{257}$ each independently represent a hydrogen atom, an alkyl group, an aryl group, or a halogenated alkyl group; and the aryl group may be substituted with an alkyl group, an alkoxy group, or a halogen atom.

Formula (106)

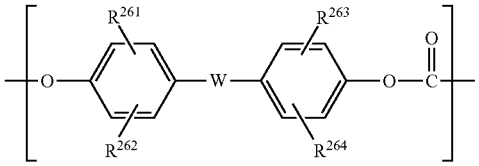

In the formula (106), $R^{261}$ to $R^{264}$ each independently represent a hydrogen atom, an alkyl group, an aryl group, or an alkoxy group; W represents a cycloalkylidene group having 5 to 12 carbon atoms; and the cycloalkylidene group may be substituted with an alkyl group.

Specifically, the electrophotographic photosensitive member according to the present invention is an electrophotographic photosensitive member including a support, a charge generation layer, a charge transport layer containing a charge transporting material, and a protective layer, in the order presented, wherein the charge transport layer contains a polycarbonate resin having a structure represented by a formula (121) below and a structure represented by the formula (104), and the protective layer includes a cured material of a composition containing a compound having at least a functional group selected from chain-polymerizable functional groups and sequential polymerizable functional groups.

Formula (121)

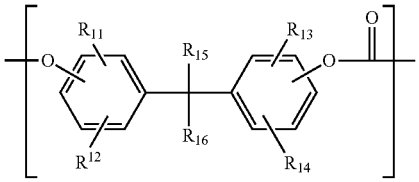

In the formula (121), $R^{11}$ to $R^{15}$ each independently represent a hydrogen atom, a methyl group, an ethyl group, or a phenyl group; and $R^{16}$ represents a linear alkyl group having 6 to 15 carbon atoms.

Examples of methods for synthesizing a polycarbonate resin having a structure selected from the group A and a structure selected from the group B include the following two methods. The first method is a method in which at least one bisphenol compound selected from formulas (107) and (108) below and at least one bisphenol compound selected from formulas (110) to (112) below are directly reacted with phosgene (phosgene method). The second method is a method in which the at least two bisphenol compounds mentioned above are subjected to transesterification reaction with a bisaryl carbonate such as diphenyl carbonate, di-p-tolyl carbonate, phenyl-p-tolyl carbonate, di-p-chlorophenyl carbonate, and dinaphthyl carbonate (transesterification method).

The same is applied to the method for synthesizing a polycarbonate resin having the structure represented by the formula (121) and the structure represented by the formula (104).

In the phosgene method, the above-mentioned at least two bisphenol compounds and phosgene are reacted typically in the presence of an acid-binding agent and a solvent. Examples of the acid-binding agent therefor include pyridine and hydroxides of alkali metal such as potassium hydroxide and sodium hydroxide. Examples of the solvent include methylene chloride and chloroform. Further, a catalyst or a molecular weight modifier may be appropriately added to promote condensation polymerization reaction. Examples of the catalyst include tertiary amines such as triethylamine and quaternary ammonium salts. Examples of the molecular weight modifier include monofunctional compounds such as phenol, p-cumylphenol, t-butylphenol, and long-chain alkyl-substituted phenols.

In synthesizing a polycarbonate resin, an antioxidant such as sodium sulfite and hydrosulfite; or a branching agent such as phloroglucin and isatinbisphenol may be used. The reaction temperature in synthesizing a polycarbonate resin is preferably 0 to 150° C., and more preferably 5 to 40° C. The reaction time depends on the reaction temperature. However the reaction time is preferably 0.5 minutes to 10 hours, and more preferably 1 minute to 2 hours in typical cases. The pH of the reaction system can be set to 10 or higher during reaction.

Specific examples of bisphenol compounds to be used for the synthesis are as follows.

(1) At least one bisphenol compound selected from formulas (107) and (108)

Formula (107)

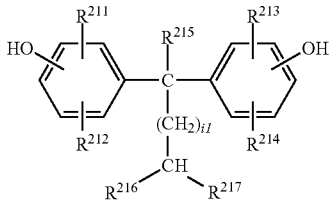

In the formula (107), $R^{211}$ to $R^{214}$ each independently represent a hydrogen atom, an alkyl group, an aryl group, or an alkoxy group; $R^{215}$ represents an alkyl group, an aryl group, or an alkoxy group; $R^{216}$ and $R^{217}$ each independently represent a substituted or unsubstituted alkyl group having one to nine carbon atoms; and i1 represents an integer of 0 to 3, provided that $R^{215}$ and $(CH_2)_{i1}CHR^{216}R^{217}$ are not the same.

Formula (108)

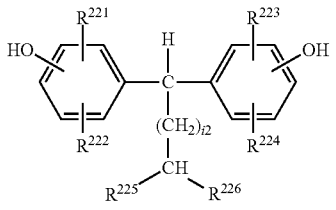

In the formula (108), $R^{221}$ to $R^{224}$ each independently represent a hydrogen atom, an alkyl group, an aryl group, or an alkoxy group; $R^{225}$ and $R^{226}$ each independently represent a substituted or unsubstituted alkyl group having one to nine carbon atoms, provided that $R^{225}$ and $R^{226}$ are not the same; and i2 represents an integer of 0 to 3.

Specific examples of bisphenol compounds represented by the formulas (107) and (108) include 2,2-bis(4-hydroxyphenyl)-4-methylpentane, 2,2-bis(4-hydroxyphenyl)-5-methylhexane, 3,3-bis(4-hydroxyphenyl)-5-methylheptane, 2,2-bis(4-hydroxyphenyl)-3-methylbutane, 1,1-bis(4-hydroxyphenyl)-1-phenyl-2-methylpropane, 1,1-bis(4-hydroxyphenyl)-1-phenyl-3-methylbutane, 2,2-bis(4-hydroxyphenyl)-6-methylheptane, 1,1-bis(4-hydroxyphenyl)-2-ethylhexane, and 1,1-bis(4-hydroxyphenyl)-1-phenyl-2-methylpentane. Two or more of these bisphenol compounds can be used in combination.

(2) At least one bisphenol compound selected from formulas (110) to (112)

Formula (110)

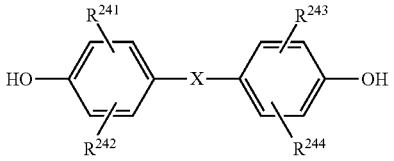

In the formula (110), $R^{241}$ to $R^{244}$ each independently represent a hydrogen atom, an alkyl group, an aryl group, or an alkoxy group; and X represents a single bond, an oxygen atom, a sulfur atom, or a sulfonyl group.

Formula (111)

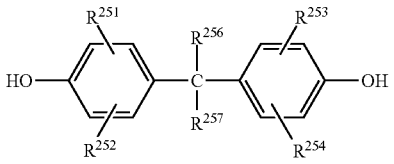

In the formula (111), $R^{251}$ to $R^{254}$ each independently represent a hydrogen atom, an alkyl group, an aryl group, or an alkoxy group; $R^{256}$ and $R^{257}$ each independently represent a hydrogen atom, an alkyl group, an aryl group, or a halogenated alkyl group; and the aryl group may be substituted with an alkyl group, an alkoxy group, or a halogen atom.

Formula (112)

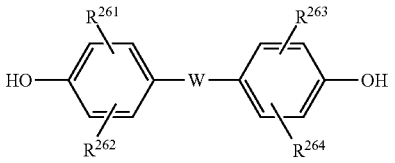

In the formula (112), $R^{261}$ to $R^{264}$ each independently represent a hydrogen atom, an alkyl group, an aryl group, or an alkoxy group; W represents a cycloalkylidene group having 5 to 12 carbon atoms; and the cycloalkylidene group may be substituted with an alkyl group.

Specific examples of bisphenol compounds represented by the formulas (110) to (112) include 4,4'-dihydroxybiphenyl, 4,4'-dihydroxy-3,3'-dimethylbiphenyl, 4,4'-dihydroxy-2,2'-dimethylbiphenyl, 4,4'-dihydroxy-3,3',5-trimethylbiphenyl, 4,4'-dihydroxy-3,3',5,5'-tetramethylbiphenyl, 4,4'-dihydroxy-3,3'-dibutylbiphenyl, 4,4'-dihydroxy-3,3'-dicyclohexylbiphenyl, 3,3'-difluoro-4,4'-dihydroxybiphenyl, 4,4'-dihydroxy-3,3'-diphenylbiphenyl, 1,1-bis(4-hydroxyphenyl)ethane, 1,1-bis(3-methyl-4-hydroxyphenyl)ethane, 1,1-bis(3-fluoro-4-hydroxyphenyl)ethane, 1,1-bis(2-tert-butyl-4-hydroxy-3-methylphenyl)ethane, 1,2-bis(4-hydroxyphenyl)ethane, 1,2-bis(3-methyl-4-hydroxyphenyl)ethane, 2,2-bis(4-hydroxyphenyl)propane, 2,2-bis(3-methyl-4-hydroxyphenyl)propane, 2,2-bis(3-cyclohexyl-4-hydroxyphenyl)propane, 2,2-bis(3-phenyl-4-hydroxyphenyl)propane, 2,2-bis(3,5-dimethyl-4-hydroxyphenyl)propane, 2,2-bis(3-fluoro-4-hydroxyphenyl)propane, 2,2-bis(3-chloro-4-hydroxyphenyl)propane, 2,2-bis(3-bromo-4-hydroxyphenyl)propane, 2,2-bis(3,5-difluoro-4-hydroxyphenyl)propane, 2,2-bis(3,5-dichloro-4-hydroxyphenyl)propane, 2,2-bis(3,5-dibromo-4-hydroxyphenyl)propane, 2,2-bis(2-tert-butyl-4-hydroxy-3-methylphenyl)propane, 2,2-bis(4-hydroxyphenyl) hexafluoropropane, 2,2-bis(3-methyl-4-hydroxyphenyl)hexafluoropropane, 2,2-bis(3,5-dimethyl-4-hydroxyphenyl) hexafluoropropane, 2,2-bis(3-phenyl-4-hydroxyphenyl)hexafluoropropane, 2,2-bis(3-fluoro-4-hydroxyphenyl) hexafluoropropane, 2,2-bis(3-chloro-4-hydroxyphenyl)hexafluoropropane, 1,1-bis(4-hydroxyphenyl)cyclohexane, 1,1-bis(3-methyl-4-hydroxyphenyl)cyclohexane, 1,1-bis(3-cyclo-4-hydroxyphenyl)cyclohexane, 1,1-bis(3-phenyl-4-hydroxyphenyl)cyclohexane, 1,1-bis(3,5-dimethyl-4-hydroxyphenyl)cyclohexane, 1,1-bis(3-fluoro-4-hydroxyphenyl)cyclohexane, 1,1-bis(3-chloro-4-hydroxyphenyl)cyclohexane, 1,1-bis(3-bromo-4-hydroxyphenyl)cyclohexane, 1,1-bis(3,5-difluoro-4-hydroxyphenyl)cyclohexane, 1,1-bis(3,5-dichloro-4-hydroxyphenyl)cyclohexane, 1,1-bis(3,5-dibromo-4-hydroxyphenyl)cyclohexane, 1,1-bis(2-tert-butyl-4-hydroxy-3-methylphenyl)cyclohexane, bis(4-hydroxyphenyl)sulfone, 1,1-bis(4-hydroxyphenyl)-3,3,5-trimethylcyclohexane, 1,1-bis(4-hydroxyphenyl) cyclopentane, 1,1-bis(4-hydroxyphenyl)-1-phenylethane, bis(4-hydroxyphenyl)diphenylmethane, 9,9-bis(4-hydroxyphenyl)-fluorene, and 2,2-bis(4-hydroxyphenyl)butane. Two or more of these bisphenol compounds can be used in combination.

The present inventors infer that the reason why the potential variation is suppressed through use of an electrophotographic photosensitive member in which the charge transport layer contains a polycarbonate resin having a structure selected from the group A and a structure selected from the group B and the protective layer includes a cured material of a composition containing a compound having at least a functional group selected from chain-polymerizable functional groups and sequential polymerizable functional groups is as follows.

A coating solution for a protective layer is applied onto a charge transport layer provided above a support and a charge generation layer, and a protective layer is then formed through external energy such as heat, light (e.g., ultraviolet rays) and radiation (e.g., electron beams). The protective layer is converted to a cured material through bonding between polymerizable functional groups, where the film density increases, and thereby a stress is presumably left in the layer. The residual stress acts on the interface between the charge transport layer and the protective layer. Mechanical and electric force continuously applied to the electrophotographic photosensitive member by electrophotographic process including a charging unit, a developing unit, a transferring unit, and a cleaning unit through long-term, repeated use may generate a minute detached portion in the interface between the charge transport layer and the protective layer to cause an image defect such as a spot on an image. Therefore, the charge transport layer can have a high ability to relax stress. The structure of the polycarbonate resin contained in the charge transport layer significantly contributes to relaxation of stress, and it is expected that the volume of a space pushed away in the charge transport layer increases by virtue of the presence of a structure of polycarbonate as a bisphenol structure having a branched chain in the center of the structure (a structure selected from the group A) and a structure different therefrom (a structure selected from the group B), and as a result overlapping of the structures of polycarbonate is prevented between the molecules of the polycarbonate resin in the polycarbonate resin.

On the other hand, the presence of a structure of polycarbonate as a bisphenol structure having a branched chain in the center of the structure (a structure selected from the group A) has been proved to impart a high charge transporting ability to the polycarbonate resin. The present inventors infer that this is because the volume of a space pushed away in the charge transport layer increases to further homogenize the distances between the polycarbonate resins and between the polycarbonate resin and the charge transporting material, and the charge transporting ability becomes higher; and expect that the charge transporting material is homogeneously present in the charge transport layer, and thus homogeneously present also in the interface between the protective layer and the charge transport layer, which allows quick transfer and acceptance of charge in the interface, and thus the accumulation of charge is prevented and eventually potential variation is suppressed. By virtue of suppressed potential variation, the stability of image density is kept high even after long-term, repeated use of the electrophotographic photosensitive member.

Now, the structure selected from the group A will be described in detail.

Among structures selected from the group A, a polycarbonate resin having a structure represented by any of formulas (A-101) to (A-105), (A-201) to (A-205) and (A-401) to (A-405) below can be used from the viewpoint of potential variation-suppressing effect. Especially, the formulas (A-101) to (A-105) and (A-201) to (A-205) below are preferred, in each of which one of the moieties bonding to a carbon element at the center of a bisphenol structure is not a hydrogen element. The present inventors infer that this is because the volume of a space pushed away in the charge transport layer is higher than that in the case of the structure in which one of the moieties bonding to a carbon element at the center of a bisphenol structure is a hydrogen element. Moreover, the formulas (A-101), (A-102), (A-104), (A-105), (A-201) and (A-203) below are preferred, in which one of the moieties bonding to a carbon element at the center of a bisphenol structure is a methyl group ($R^{215}$ in the above formula (101) is $CH_3$), and the formulas (A-101), (A-102), (A-104) and (A-105) below are more preferred, in which the branched chains in the center of a bisphenol structure are the same ($R^{216}$ and $R^{217}$ in $(CH_2)_{i1}CHR^{216}R^{217}$ in the formula (101) are the same). The present inventors infer that this is because the volume of a space pushed away in the charge transport layer is in the most preferable range for the advantageous effects of the present invention by virtue of the structure in which one of the moieties bonding to a carbon element at the center of a bisphenol structure is a methyl group and the branched chains in the center of a bisphenol structure are the same.

(A-101)

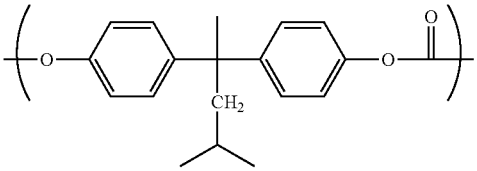

(A-102)

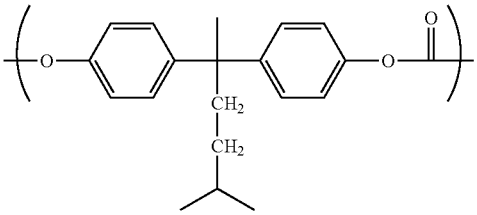

(A-103)

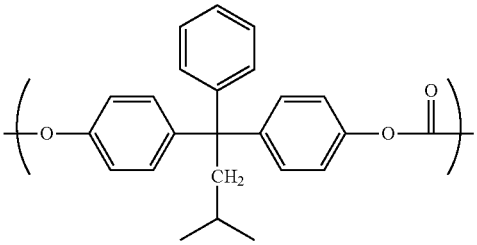

(A-104)

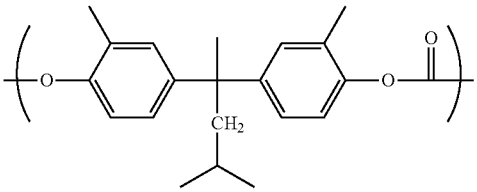

(A-105)

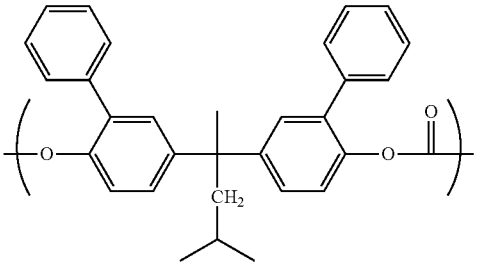

-continued (A-201)

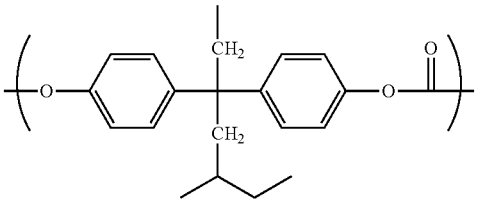

(A-202)

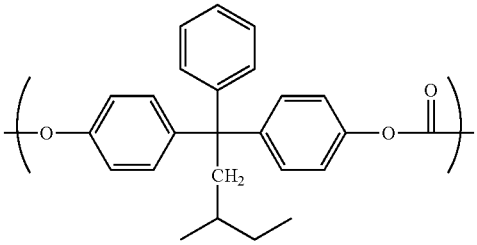

(A-203)

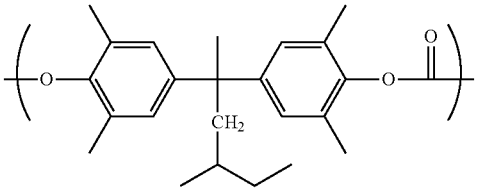

(A-204)

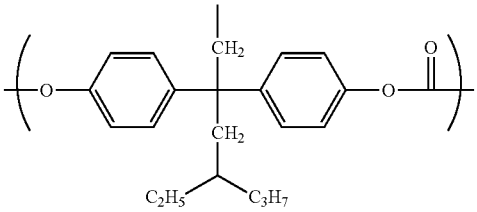

(A-205)

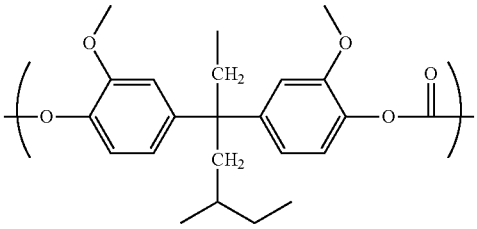

(A-401)

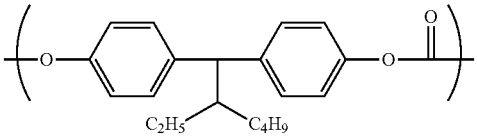

(A-402)

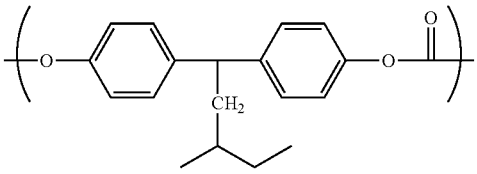

-continued (A-403)

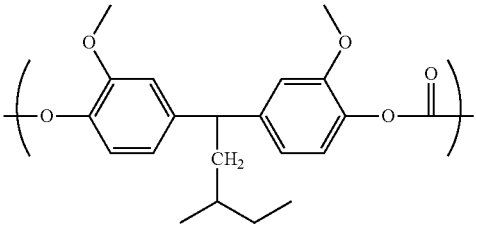

(A-404)

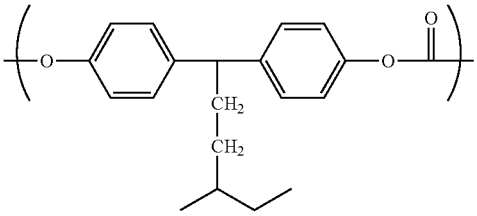

(A-405)

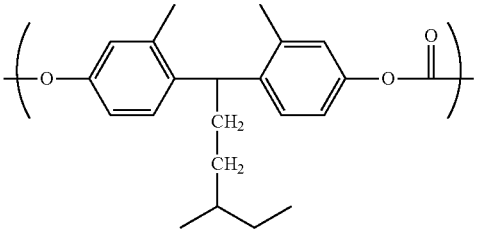

Now, the structure selected from the group B will be described in detail.

Among structures selected from the group B, a polycarbonate resin having a structure represented by any of formulas (B-101) to (B-105), (B-201) to (B-205), (B-301) to (B-308) and (B-401) to (B-405) below can be used from the viewpoint of potential variation-suppressing effect. Especially, the formulas (B-101) to (B-105) below are more preferred from the view point of potential variation-suppressing effect. The present inventors infer that this is because the volume of a space pushed away in the charge transport layer increases to further homogenize the distances between the polycarbonate resins and between the polycarbonate resin and the charge transporting material, and the charge transporting ability becomes higher. Moreover, the formulas (B-201) to (B-205) below are preferred from the viewpoint of further preventing generation of an image defect such as a spot on an image. The present inventors infer that denser packing of the polycarbonate resin lowers the film density and increases the contact area between the resin site of the charge transport layer and the protective layer in the interface to increase the adhesive force, and as a result generation of an image defect can be further prevented. Furthermore, the formulas (B-301) to (B-308) and (B-401) to (B-405) below are preferred from the viewpoint of the solubility of a copolymerized polycarbonate resin. High affinity to the structure selected from the group A presumably contributes to enhancement of the solubility of the resin in a solvent in a coating solution for a charge transport layer.

(B-101)

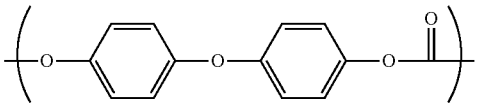

-continued (B-102)

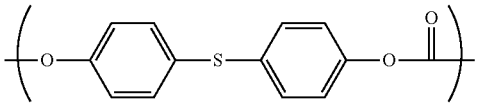

(B-103)

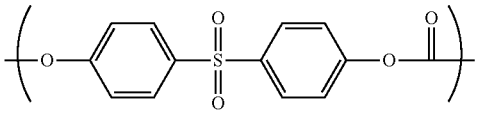

(B-104)

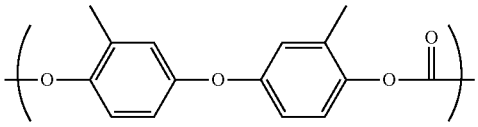

(B-105)

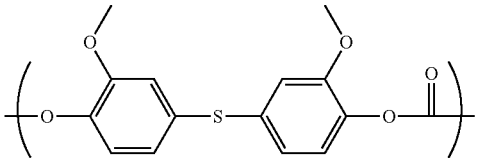

(B-201)

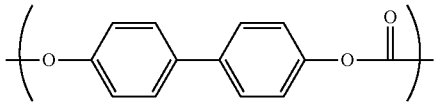

(B-202)

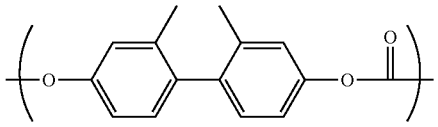

(B-203)

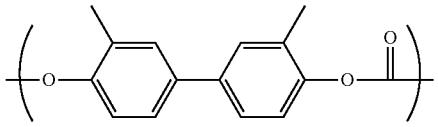

(B-204)

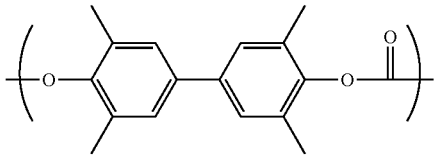

(B-205)

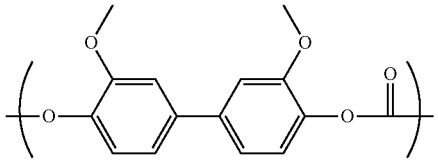

(B-301)

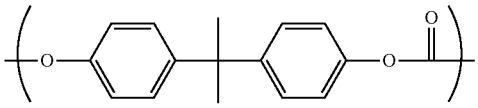

(B-302)

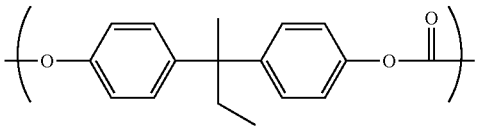

-continued (B-303)

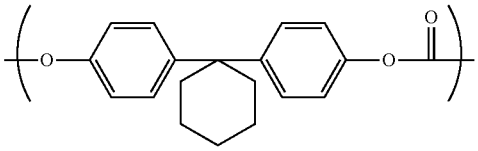

(B-304)

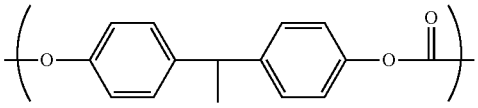

(B-305)

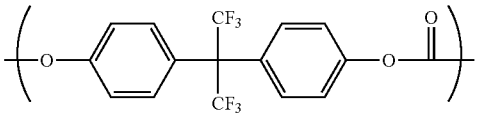

(B-306)

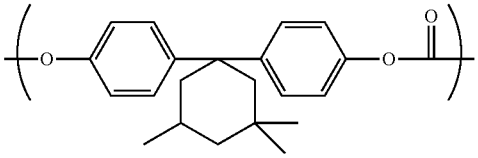

(B-307)

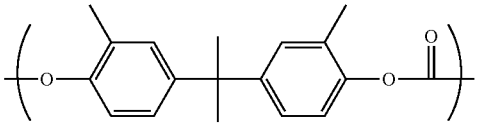

(B-308)

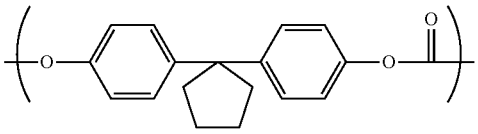

(B-401)

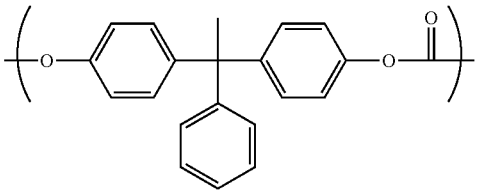

(B-402)

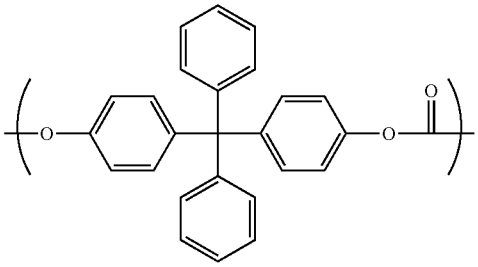

(B-403)

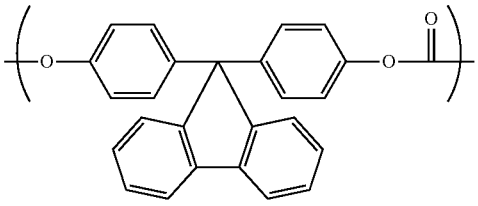

-continued (B-404)

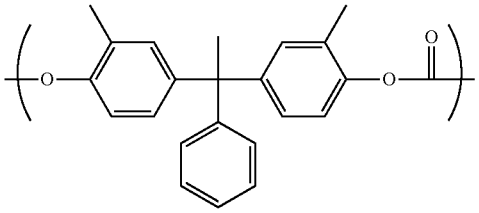

(B-405)

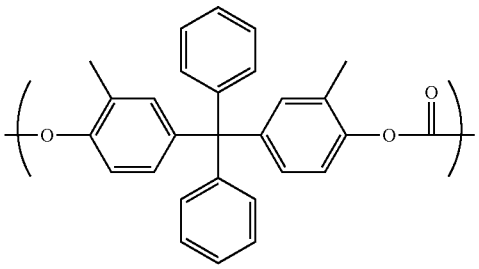

The present inventors infer that the reason why potential variation is suppressed when an electrophotographic photosensitive member in which the charge transport layer contains a polycarbonate resin having the structure represented by the formula (121) and the structure represented by the formula (104) and the protective layer includes a cured material of a composition containing a compound having at least a functional group selected from chain-polymerizable functional groups and sequential polymerizable functional groups is used is as follows.

A coating solution for a protective layer is applied onto a charge transport layer provided above a support and a charge generation layer, and a protective layer is then formed through external energy such as heat, light (e.g., ultraviolet rays) and radiation (e.g., electron beams). The protective layer is converted to a cured material through bonding between polymerizable functional groups, where the film density increases, and thereby a stress is presumably left in the layer. The residual stress acts on the interface between the charge transport layer and the protective layer. Mechanical and electric force continuously applied to the electrophotographic photosensitive member by electrophotographic process including a charging unit, a developing unit, a transferring unit, and a cleaning unit through long-term, repeated use may generate a minute detached portion in the interface between the charge transport layer and the protective layer to cause an image defect such as a spot on an image. Therefore, the charge transport layer can have a high ability to relax stress. The structure of the polycarbonate resin contained in the charge transport layer significantly contributes to relaxation of stress, and it is expected that, by virtue of the presence of the structure represented by the formula (121), in which the center of the structure is folded and thus the structure is bulky, and the structure represented by the formula (104), in which the center of the structure is small, overlapping of the structures of polycarbonate is prevented between the molecules of the polycarbonate resin in the polycarbonate resin.

Further, the present inventors infer that the distances between the polycarbonate resins and between the polycarbonate resin and the charge transporting material becomes more homogenous through the prevention of overlapping, and the charge transporting material is homogeneously present to fill the space, and the charge transporting ability becomes higher; and expect that the charge transporting material is homogeneously present similarly in the interface between the protective layer and the charge transport layer, which allows quick transfer and acceptance of charge in the interface, and the accumulation of charge is prevented and eventually potential variation is suppressed. By virtue of suppressed potential variation, the stability of image density is kept high even after long-term, repeated use of the electrophotographic photosensitive member.

Now, the structure represented by the formula (121) will be described in detail.

Among the structures represented by the formula (121), a polycarbonate resin having a structure represented by any of formulas (C-101) to (C-105) below can be used from the viewpoint of potential variation-suppressing effect. Especially, the formulas (C-101) to (C-103) below are preferred, in each of which one of the moieties bonding to a carbon element at the center of a bisphenol structure is a hydrogen element. The present inventors infer that this is because a long linear alkyl group is folded by virtue of the structure in which one of the moieties bonding to a carbon element at the center of a bisphenol structure is a hydrogen element, and as a result the volume of a space pushed away in the charge transport layer is in the most preferable range for the advantageous effects of the present invention.

(C-101)

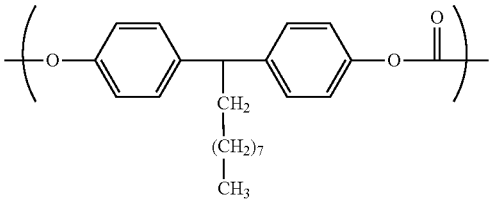

(C-102)

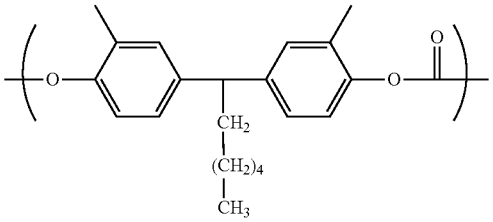

(C-103)

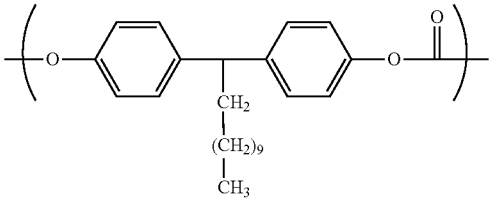

-continued (C-104)

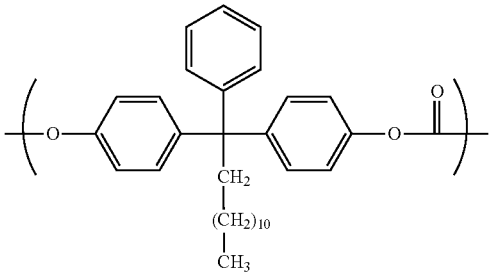

(C-105)

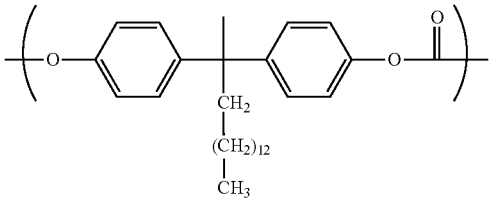

In the present invention, the content ratio of the structure selected from the group A to the polycarbonate resin is preferably 20 mol % or higher and 80 mol % or lower, and more preferably 25 mol % or higher and 49 mol % or lower.

In the present invention, the content ratio of the structure represented by the formula (121) to the polycarbonate resin is preferably 20 mol % or higher and 80 mol % or lower, and more preferably 25 mol % or higher and 49 mol % or lower.

In the present invention, the viscosity-average molecular weight (Mw) of the polycarbonate resin is preferably 20,000 or higher and 70,000 or lower, and more preferably 25,000 or higher and 60,000 or lower. If the viscosity-average molecular weight of the polycarbonate resin is lower than 20,000, the viscosity of the coating solution for a charge transport layer is low, and a charge transport layer having a desired film thickness may not be obtained. If the viscosity-average molecular weight of the polycarbonate resin is higher than 70,000, on the other hand, the coating solution for a charge transport layer may have insufficient storage stability. The weight-average molecular weight (Mw) of the polycarbonate resin is preferably 25,000 or higher and 100,000 or lower, and more preferably 30,000 or higher and 80,000 or lower.

For measurement of the viscosity-average molecular weight of a polycarbonate resin in Examples described later, the intrinsic viscosity [q] was measured by using a Ubbelohde viscometer for a 0.5 w/v % dichloromethane solution of polycarbonate at 20° C. with a Huggins constant of 0.45, and the viscosity-average molecular weight was determined by using the following equation.

$$[\eta]=1.23\times10-4\times(Mv)0.83$$

The weight-average molecular weight of a polycarbonate resin was measured for a sample of a 0.25 w/v % chloroform solution through gel permeation chromatography (GPC) [measurement apparatus: Alliance HPLC system (manufactured by Waters Corporation)] with two Shodex KF-805L columns (manufactured by Showa Denko K.K.) and an eluent of chloroform at 1 mL/min under UV detection at 254 nm, and calculated as a value in terms of polystyrene.

The intrinsic viscosity of the polycarbonate resin can be 0.3 dL/g to 2.0 dL/g.

Now, specific examples of the polycarbonate resin will be described in detail.

Specific examples of the polycarbonate resin having a structure selected from the group A and a structure selected from the group B are listed in Tables 1 to 12.

TABLE 1

Specific examples of polycarbonate resin

| | Group A | | Group B | |
|---|---|---|---|---|
| Exemplary compound No. | Structure | Content ratio (mol %) | Structure | Content ratio (mol %) |
| Exemplary compound 1001 | A-101 | 49 | B-101 | 51 |
| Exemplary compound 1002 | A-101 | 80 | B-101 | 20 |
| Exemplary compound 1003 | A-101 | 35 | B-101 | 65 |
| Exemplary compound 1004 | A-101 | 20 | B-101 | 80 |
| Exemplary compound 1005 | A-101 | 49 | B-102 | 51 |
| Exemplary compound 1006 | A-101 | 80 | B-102 | 20 |
| Exemplary compound 1007 | A-101 | 35 | B-102 | 65 |
| Exemplary compound 1008 | A-101 | 20 | B-102 | 80 |
| Exemplary compound 1009 | A-101 | 49 | B-103 | 51 |
| Exemplary compound 1010 | A-101 | 80 | B-103 | 20 |
| Exemplary compound 1011 | A-101 | 35 | B-103 | 65 |
| Exemplary compound 1012 | A-101 | 20 | B-103 | 80 |
| Exemplary compound 1013 | A-101 | 49 | B-104 | 51 |
| Exemplary compound 1014 | A-101 | 80 | B-104 | 20 |
| Exemplary compound 1015 | A-101 | 35 | B-104 | 65 |
| Exemplary compound 1016 | A-101 | 20 | B-104 | 80 |
| Exemplary compound 1017 | A-101 | 49 | B-105 | 51 |
| Exemplary compound 1018 | A-101 | 80 | B-105 | 20 |
| Exemplary compound 1019 | A-101 | 35 | B-105 | 65 |
| Exemplary compound 1020 | A-101 | 20 | B-105 | 80 |
| Exemplary compound 1021 | A-101 | 49 | B-201 | 51 |
| Exemplary compound 1022 | A-101 | 80 | B-201 | 20 |
| Exemplary compound 1023 | A-101 | 35 | B-201 | 65 |
| Exemplary compound 1024 | A-101 | 20 | B-201 | 80 |
| Exemplary compound 1025 | A-101 | 49 | B-202 | 51 |
| Exemplary compound 1026 | A-101 | 80 | B-202 | 20 |
| Exemplary compound 1027 | A-101 | 35 | B-202 | 65 |
| Exemplary compound 1028 | A-101 | 20 | B-202 | 80 |
| Exemplary compound 1029 | A-101 | 49 | B-203 | 51 |
| Exemplary compound 1030 | A-101 | 80 | B-203 | 20 |
| Exemplary compound 1031 | A-101 | 35 | B-203 | 65 |
| Exemplary compound 1032 | A-101 | 20 | B-203 | 80 |
| Exemplary compound 1033 | A-101 | 49 | B-204 | 51 |
| Exemplary compound 1034 | A-101 | 80 | B-204 | 20 |
| Exemplary compound 1035 | A-101 | 35 | B-204 | 65 |
| Exemplary compound 1036 | A-101 | 20 | B-204 | 80 |
| Exemplary compound 1037 | A-101 | 49 | B-205 | 51 |
| Exemplary compound 1038 | A-101 | 80 | B-205 | 20 |
| Exemplary compound 1039 | A-101 | 35 | B-205 | 65 |
| Exemplary compound 1040 | A-101 | 20 | B-205 | 80 |
| Exemplary compound 1041 | A-101 | 49 | B-301 | 51 |
| Exemplary compound 1042 | A-101 | 80 | B-301 | 20 |
| Exemplary compound 1043 | A-101 | 35 | B-301 | 65 |
| Exemplary compound 1044 | A-101 | 20 | B-301 | 80 |
| Exemplary compound 1045 | A-101 | 49 | B-302 | 51 |
| Exemplary compound 1046 | A-101 | 80 | B-302 | 20 |
| Exemplary compound 1047 | A-101 | 35 | B-302 | 65 |
| Exemplary compound 1048 | A-101 | 20 | B-302 | 80 |
| Exemplary compound 1049 | A-101 | 49 | B-303 | 51 |
| Exemplary compound 1050 | A-101 | 80 | B-303 | 20 |
| Exemplary compound 1051 | A-101 | 35 | B-303 | 65 |
| Exemplary compound 1052 | A-101 | 20 | B-303 | 80 |
| Exemplary compound 1053 | A-101 | 49 | B-304 | 51 |
| Exemplary compound 1054 | A-101 | 80 | B-304 | 20 |
| Exemplary compound 1055 | A-101 | 35 | B-304 | 65 |
| Exemplary compound 1056 | A-101 | 20 | B-304 | 80 |
| Exemplary compound 1057 | A-101 | 49 | B-305 | 51 |
| Exemplary compound 1058 | A-101 | 80 | B-305 | 20 |
| Exemplary compound 1059 | A-101 | 35 | B-305 | 65 |
| Exemplary compound 1060 | A-101 | 20 | B-305 | 80 |
| Exemplary compound 1061 | A-101 | 49 | B-306 | 51 |
| Exemplary compound 1062 | A-101 | 80 | B-306 | 20 |
| Exemplary compound 1063 | A-101 | 35 | B-306 | 65 |
| Exemplary compound 1064 | A-101 | 20 | B-306 | 80 |
| Exemplary compound 1065 | A-101 | 49 | B-307 | 51 |

TABLE 1-continued

Specific examples of polycarbonate resin

| | Group A | | Group B | |
|---|---|---|---|---|
| Exemplary compound No. | Structure | Content ratio (mol %) | Structure | Content ratio (mol %) |
| Exemplary compound 1066 | A-101 | 80 | B-307 | 20 |
| Exemplary compound 1067 | A-101 | 35 | B-307 | 65 |
| Exemplary compound 1068 | A-101 | 20 | B-307 | 80 |
| Exemplary compound 1069 | A-101 | 49 | B-308 | 51 |
| Exemplary compound 1070 | A-101 | 80 | B-308 | 20 |
| Exemplary compound 1071 | A-101 | 35 | B-308 | 65 |
| Exemplary compound 1072 | A-101 | 20 | B-308 | 80 |
| Exemplary compound 1073 | A-101 | 49 | B-401 | 51 |
| Exemplary compound 1074 | A-101 | 80 | B-401 | 20 |
| Exemplary compound 1075 | A-101 | 35 | B-401 | 65 |
| Exemplary compound 1076 | A-101 | 20 | B-401 | 80 |
| Exemplary compound 1077 | A-101 | 49 | B-402 | 51 |
| Exemplary compound 1078 | A-101 | 80 | B-402 | 20 |
| Exemplary compound 1079 | A-101 | 35 | B-402 | 65 |
| Exemplary compound 1080 | A-101 | 20 | B-402 | 80 |
| Exemplary compound 1081 | A-101 | 49 | B-403 | 51 |
| Exemplary compound 1082 | A-101 | 80 | B-403 | 20 |
| Exemplary compound 1083 | A-101 | 35 | B-403 | 65 |
| Exemplary compound 1084 | A-101 | 20 | B-403 | 80 |
| Exemplary compound 1085 | A-101 | 49 | B-404 | 51 |
| Exemplary compound 1086 | A-101 | 80 | B-404 | 20 |
| Exemplary compound 1087 | A-101 | 35 | B-404 | 65 |
| Exemplary compound 1088 | A-101 | 20 | B-404 | 80 |
| Exemplary compound 1089 | A-101 | 49 | B-405 | 51 |
| Exemplary compound 1090 | A-101 | 80 | B-405 | 20 |
| Exemplary compound 1091 | A-101 | 35 | B-405 | 65 |
| Exemplary compound 1092 | A-101 | 20 | B-405 | 80 |
| Exemplary compound 1093 | A-102 | 49 | B-101 | 51 |
| Exemplary compound 1094 | A-102 | 80 | B-101 | 20 |
| Exemplary compound 1095 | A-102 | 35 | B-101 | 65 |
| Exemplary compound 1096 | A-102 | 20 | B-101 | 80 |
| Exemplary compound 1097 | A-102 | 49 | B-102 | 51 |
| Exemplary compound 1098 | A-102 | 80 | B-102 | 20 |
| Exemplary compound 1099 | A-102 | 35 | B-102 | 65 |
| Exemplary compound 1100 | A-102 | 20 | B-102 | 80 |
| Exemplary compound 1101 | A-102 | 49 | B-103 | 51 |
| Exemplary compound 1102 | A-102 | 80 | B-103 | 20 |
| Exemplary compound 1103 | A-102 | 35 | B-103 | 65 |
| Exemplary compound 1104 | A-102 | 20 | B-103 | 80 |
| Exemplary compound 1105 | A-102 | 49 | B-104 | 51 |
| Exemplary compound 1106 | A-102 | 80 | B-104 | 20 |
| Exemplary compound 1107 | A-102 | 35 | B-104 | 65 |
| Exemplary compound 1108 | A-102 | 20 | B-104 | 80 |
| Exemplary compound 1109 | A-102 | 49 | B-105 | 51 |
| Exemplary compound 1110 | A-102 | 80 | B-105 | 20 |
| Exemplary compound 1111 | A-102 | 35 | B-105 | 65 |
| Exemplary compound 1112 | A-102 | 20 | B-105 | 80 |
| Exemplary compound 1113 | A-102 | 49 | B-201 | 51 |
| Exemplary compound 1114 | A-102 | 80 | B-201 | 20 |
| Exemplary compound 1115 | A-102 | 35 | B-201 | 65 |
| Exemplary compound 1116 | A-102 | 20 | B-201 | 80 |
| Exemplary compound 1117 | A-102 | 49 | B-202 | 51 |
| Exemplary compound 1118 | A-102 | 80 | B-202 | 20 |
| Exemplary compound 1119 | A-102 | 35 | B-202 | 65 |
| Exemplary compound 1120 | A-102 | 20 | B-202 | 80 |

TABLE 2

Specific examples of polycarbonate resin

| | Group A | | Group B | |
|---|---|---|---|---|
| Exemplary compound No. | Structure | Content ratio (mol %) | Structure | Content ratio (mol %) |
| Exemplary compound 1121 | A-102 | 49 | B-203 | 51 |
| Exemplary compound 1122 | A-102 | 80 | B-203 | 20 |
| Exemplary compound 1123 | A-102 | 35 | B-203 | 65 |

TABLE 2-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1124 | A-102 | 20 | B-203 | 80 |
| Exemplary compound 1125 | A-102 | 49 | B-204 | 51 |
| Exemplary compound 1126 | A-102 | 80 | B-204 | 20 |
| Exemplary compound 1127 | A-102 | 35 | B-204 | 65 |
| Exemplary compound 1128 | A-102 | 20 | B-204 | 80 |
| Exemplary compound 1129 | A-102 | 49 | B-205 | 51 |
| Exemplary compound 1130 | A-102 | 80 | B-205 | 20 |
| Exemplary compound 1131 | A-102 | 35 | B-205 | 65 |
| Exemplary compound 1132 | A-102 | 20 | B-205 | 80 |
| Exemplary compound 1133 | A-102 | 49 | B-301 | 51 |
| Exemplary compound 1134 | A-102 | 80 | B-301 | 20 |
| Exemplary compound 1135 | A-102 | 35 | B-301 | 65 |
| Exemplary compound 1136 | A-102 | 20 | B-301 | 80 |
| Exemplary compound 1137 | A-102 | 49 | B-302 | 51 |
| Exemplary compound 1138 | A-102 | 80 | B-302 | 20 |
| Exemplary compound 1139 | A-102 | 35 | B-302 | 65 |
| Exemplary compound 1140 | A-102 | 20 | B-302 | 80 |
| Exemplary compound 1141 | A-102 | 49 | B-303 | 51 |
| Exemplary compound 1142 | A-102 | 80 | B-303 | 20 |
| Exemplary compound 1143 | A-102 | 35 | B-303 | 65 |
| Exemplary compound 1144 | A-102 | 20 | B-303 | 80 |
| Exemplary compound 1145 | A-102 | 49 | B-304 | 51 |
| Exemplary compound 1146 | A-102 | 80 | B-304 | 20 |
| Exemplary compound 1147 | A-102 | 35 | B-304 | 65 |
| Exemplary compound 1148 | A-102 | 20 | B-304 | 80 |
| Exemplary compound 1149 | A-102 | 49 | B-305 | 51 |
| Exemplary compound 1150 | A-102 | 80 | B-305 | 20 |
| Exemplary compound 1151 | A-102 | 35 | B-305 | 65 |
| Exemplary compound 1152 | A-102 | 20 | B-305 | 80 |
| Exemplary compound 1153 | A-102 | 49 | B-306 | 51 |
| Exemplary compound 1154 | A-102 | 80 | B-306 | 20 |
| Exemplary compound 1155 | A-102 | 35 | B-306 | 65 |
| Exemplary compound 1156 | A-102 | 20 | B-306 | 80 |
| Exemplary compound 1157 | A-102 | 49 | B-307 | 51 |
| Exemplary compound 1158 | A-102 | 80 | B-307 | 20 |
| Exemplary compound 1159 | A-102 | 35 | B-307 | 65 |
| Exemplary compound 1160 | A-102 | 20 | B-307 | 80 |
| Exemplary compound 1161 | A-102 | 49 | B-308 | 51 |
| Exemplary compound 1162 | A-102 | 80 | B-308 | 20 |
| Exemplary compound 1163 | A-102 | 35 | B-308 | 65 |
| Exemplary compound 1164 | A-102 | 20 | B-308 | 80 |
| Exemplary compound 1165 | A-102 | 49 | B-401 | 51 |
| Exemplary compound 1166 | A-102 | 80 | B-401 | 20 |
| Exemplary compound 1167 | A-102 | 35 | B-401 | 65 |
| Exemplary compound 1168 | A-102 | 20 | B-401 | 80 |
| Exemplary compound 1169 | A-102 | 49 | B-402 | 51 |
| Exemplary compound 1170 | A-102 | 80 | B-402 | 20 |
| Exemplary compound 1171 | A-102 | 35 | B-402 | 65 |
| Exemplary compound 1172 | A-102 | 20 | B-402 | 80 |
| Exemplary compound 1173 | A-102 | 49 | B-403 | 51 |
| Exemplary compound 1174 | A-102 | 80 | B-403 | 20 |
| Exemplary compound 1175 | A-102 | 35 | B-403 | 65 |
| Exemplary compound 1176 | A-102 | 20 | B-403 | 80 |
| Exemplary compound 1177 | A-102 | 49 | B-404 | 51 |
| Exemplary compound 1178 | A-102 | 80 | B-404 | 20 |
| Exemplary compound 1179 | A-102 | 35 | B-404 | 65 |
| Exemplary compound 1180 | A-102 | 20 | B-404 | 80 |
| Exemplary compound 1181 | A-102 | 49 | B-405 | 51 |
| Exemplary compound 1182 | A-102 | 80 | B-405 | 20 |
| Exemplary compound 1183 | A-102 | 35 | B-405 | 65 |
| Exemplary compound 1184 | A-102 | 20 | B-405 | 80 |
| Exemplary compound 1185 | A-103 | 49 | B-101 | 51 |
| Exemplary compound 1186 | A-103 | 80 | B-101 | 20 |
| Exemplary compound 1187 | A-103 | 35 | B-101 | 65 |
| Exemplary compound 1188 | A-103 | 20 | B-101 | 80 |
| Exemplary compound 1189 | A-103 | 49 | B-102 | 51 |
| Exemplary compound 1190 | A-103 | 80 | B-102 | 20 |
| Exemplary compound 1191 | A-103 | 35 | B-102 | 65 |
| Exemplary compound 1192 | A-103 | 20 | B-102 | 80 |
| Exemplary compound 1193 | A-103 | 49 | B-103 | 51 |
| Exemplary compound 1194 | A-103 | 80 | B-103 | 20 |
| Exemplary compound 1195 | A-103 | 35 | B-103 | 65 |

TABLE 2-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1196 | A-103 | 20 | B-103 | 80 |
| Exemplary compound 1197 | A-103 | 49 | B-104 | 51 |
| Exemplary compound 1198 | A-103 | 80 | B-104 | 20 |
| Exemplary compound 1199 | A-103 | 35 | B-104 | 65 |
| Exemplary compound 1200 | A-103 | 20 | B-104 | 80 |
| Exemplary compound 1201 | A-103 | 49 | B-105 | 51 |
| Exemplary compound 1202 | A-103 | 80 | B-105 | 20 |
| Exemplary compound 1203 | A-103 | 35 | B-105 | 65 |
| Exemplary compound 1204 | A-103 | 20 | B-105 | 80 |
| Exemplary compound 1205 | A-103 | 49 | B-201 | 51 |
| Exemplary compound 1206 | A-103 | 80 | B-201 | 20 |
| Exemplary compound 1207 | A-103 | 35 | B-201 | 65 |
| Exemplary compound 1208 | A-103 | 20 | B-201 | 80 |
| Exemplary compound 1209 | A-103 | 49 | B-202 | 51 |
| Exemplary compound 1210 | A-103 | 80 | B-202 | 20 |
| Exemplary compound 1211 | A-103 | 35 | B-202 | 65 |
| Exemplary compound 1212 | A-103 | 20 | B-202 | 80 |
| Exemplary compound 1213 | A-103 | 49 | B-203 | 51 |
| Exemplary compound 1214 | A-103 | 80 | B-203 | 20 |
| Exemplary compound 1215 | A-103 | 35 | B-203 | 65 |
| Exemplary compound 1216 | A-103 | 20 | B-203 | 80 |
| Exemplary compound 1217 | A-103 | 49 | B-204 | 51 |
| Exemplary compound 1218 | A-103 | 80 | B-204 | 20 |
| Exemplary compound 1219 | A-103 | 35 | B-204 | 65 |
| Exemplary compound 1220 | A-103 | 20 | B-204 | 80 |
| Exemplary compound 1221 | A-103 | 49 | B-205 | 51 |
| Exemplary compound 1222 | A-103 | 80 | B-205 | 20 |
| Exemplary compound 1223 | A-103 | 35 | B-205 | 65 |
| Exemplary compound 1224 | A-103 | 20 | B-205 | 80 |
| Exemplary compound 1225 | A-103 | 49 | B-301 | 51 |
| Exemplary compound 1226 | A-103 | 80 | B-301 | 20 |
| Exemplary compound 1227 | A-103 | 35 | B-301 | 65 |
| Exemplary compound 1228 | A-103 | 20 | B-301 | 80 |
| Exemplary compound 1229 | A-103 | 49 | B-302 | 51 |
| Exemplary compound 1230 | A-103 | 80 | B-302 | 20 |
| Exemplary compound 1231 | A-103 | 35 | B-302 | 65 |
| Exemplary compound 1232 | A-103 | 20 | B-302 | 80 |
| Exemplary compound 1233 | A-103 | 49 | B-303 | 51 |
| Exemplary compound 1234 | A-103 | 80 | B-303 | 20 |
| Exemplary compound 1235 | A-103 | 35 | B-303 | 65 |
| Exemplary compound 1236 | A-103 | 20 | B-303 | 80 |
| Exemplary compound 1237 | A-103 | 49 | B-304 | 51 |
| Exemplary compound 1238 | A-103 | 80 | B-304 | 20 |
| Exemplary compound 1239 | A-103 | 35 | B-304 | 65 |
| Exemplary compound 1240 | A-103 | 20 | B-304 | 80 |

TABLE 3

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1241 | A-103 | 49 | B-305 | 51 |
| Exemplary compound 1242 | A-103 | 80 | B-305 | 20 |
| Exemplary compound 1243 | A-103 | 35 | B-305 | 65 |
| Exemplary compound 1244 | A-103 | 20 | B-305 | 80 |
| Exemplary compound 1245 | A-103 | 49 | B-306 | 51 |
| Exemplary compound 1246 | A-103 | 80 | B-306 | 20 |
| Exemplary compound 1247 | A-103 | 35 | B-306 | 65 |
| Exemplary compound 1248 | A-103 | 20 | B-306 | 80 |
| Exemplary compound 1249 | A-103 | 49 | B-307 | 51 |
| Exemplary compound 1250 | A-103 | 80 | B-307 | 20 |
| Exemplary compound 1251 | A-103 | 35 | B-307 | 65 |
| Exemplary compound 1252 | A-103 | 20 | B-307 | 80 |
| Exemplary compound 1253 | A-103 | 49 | B-308 | 51 |

TABLE 3-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1254 | A-103 | 80 | B-308 | 20 |
| Exemplary compound 1255 | A-103 | 35 | B-308 | 65 |
| Exemplary compound 1256 | A-103 | 20 | B-308 | 80 |
| Exemplary compound 1257 | A-103 | 49 | B-401 | 51 |
| Exemplary compound 1258 | A-103 | 80 | B-401 | 20 |
| Exemplary compound 1259 | A-103 | 35 | B-401 | 65 |
| Exemplary compound 1260 | A-103 | 20 | B-401 | 80 |
| Exemplary compound 1261 | A-103 | 49 | B-402 | 51 |
| Exemplary compound 1262 | A-103 | 80 | B-402 | 20 |
| Exemplary compound 1263 | A-103 | 35 | B-402 | 65 |
| Exemplary compound 1264 | A-103 | 20 | B-402 | 80 |
| Exemplary compound 1265 | A-103 | 49 | B-403 | 51 |
| Exemplary compound 1266 | A-103 | 80 | B-403 | 20 |
| Exemplary compound 1267 | A-103 | 35 | B-403 | 65 |
| Exemplary compound 1268 | A-103 | 20 | B-403 | 80 |
| Exemplary compound 1269 | A-103 | 49 | B-404 | 51 |
| Exemplary compound 1270 | A-103 | 80 | B-404 | 20 |
| Exemplary compound 1271 | A-103 | 35 | B-404 | 65 |
| Exemplary compound 1272 | A-103 | 20 | B-404 | 80 |
| Exemplary compound 1273 | A-103 | 49 | B-405 | 51 |
| Exemplary compound 1274 | A-103 | 80 | B-405 | 20 |
| Exemplary compound 1275 | A-103 | 35 | B-405 | 65 |
| Exemplary compound 1276 | A-103 | 20 | B-405 | 80 |
| Exemplary compound 1277 | A-104 | 49 | B-101 | 51 |
| Exemplary compound 1278 | A-104 | 80 | B-101 | 20 |
| Exemplary compound 1279 | A-104 | 35 | B-101 | 65 |
| Exemplary compound 1280 | A-104 | 20 | B-101 | 80 |
| Exemplary compound 1281 | A-104 | 49 | B-102 | 51 |
| Exemplary compound 1282 | A-104 | 80 | B-102 | 20 |
| Exemplary compound 1283 | A-104 | 35 | B-102 | 65 |
| Exemplary compound 1284 | A-104 | 20 | B-102 | 80 |
| Exemplary compound 1285 | A-104 | 49 | B-103 | 51 |
| Exemplary compound 1286 | A-104 | 80 | B-103 | 20 |
| Exemplary compound 1287 | A-104 | 35 | B-103 | 65 |
| Exemplary compound 1288 | A-104 | 20 | B-103 | 80 |
| Exemplary compound 1289 | A-104 | 49 | B-104 | 51 |
| Exemplary compound 1290 | A-104 | 80 | B-104 | 20 |
| Exemplary compound 1291 | A-104 | 35 | B-104 | 65 |
| Exemplary compound 1292 | A-104 | 20 | B-104 | 80 |
| Exemplary compound 1293 | A-104 | 49 | B-105 | 51 |
| Exemplary compound 1294 | A-104 | 80 | B-105 | 20 |
| Exemplary compound 1295 | A-104 | 35 | B-105 | 65 |
| Exemplary compound 1296 | A-104 | 20 | B-105 | 80 |
| Exemplary compound 1297 | A-104 | 49 | B-201 | 51 |
| Exemplary compound 1298 | A-104 | 80 | B-201 | 20 |
| Exemplary compound 1299 | A-104 | 35 | B-201 | 65 |
| Exemplary compound 1300 | A-104 | 20 | B-201 | 80 |
| Exemplary compound 1301 | A-104 | 49 | B-202 | 51 |
| Exemplary compound 1302 | A-104 | 80 | B-202 | 20 |
| Exemplary compound 1303 | A-104 | 35 | B-202 | 65 |
| Exemplary compound 1304 | A-104 | 20 | B-202 | 80 |
| Exemplary compound 1305 | A-104 | 49 | B-203 | 51 |
| Exemplary compound 1306 | A-104 | 80 | B-203 | 20 |
| Exemplary compound 1307 | A-104 | 35 | B-203 | 65 |
| Exemplary compound 1308 | A-104 | 20 | B-203 | 80 |
| Exemplary compound 1309 | A-104 | 49 | B-204 | 51 |
| Exemplary compound 1310 | A-104 | 80 | B-204 | 20 |
| Exemplary compound 1311 | A-104 | 35 | B-204 | 65 |
| Exemplary compound 1312 | A-104 | 20 | B-204 | 80 |
| Exemplary compound 1313 | A-104 | 49 | B-205 | 51 |
| Exemplary compound 1314 | A-104 | 80 | B-205 | 20 |
| Exemplary compound 1315 | A-104 | 35 | B-205 | 65 |
| Exemplary compound 1316 | A-104 | 20 | B-205 | 80 |
| Exemplary compound 1317 | A-104 | 49 | B-301 | 51 |
| Exemplary compound 1318 | A-104 | 80 | B-301 | 20 |
| Exemplary compound 1319 | A-104 | 35 | B-301 | 65 |
| Exemplary compound 1320 | A-104 | 20 | B-301 | 80 |
| Exemplary compound 1321 | A-104 | 49 | B-302 | 51 |
| Exemplary compound 1322 | A-104 | 80 | B-302 | 20 |
| Exemplary compound 1323 | A-104 | 35 | B-302 | 65 |
| Exemplary compound 1324 | A-104 | 20 | B-302 | 80 |
| Exemplary compound 1325 | A-104 | 49 | B-303 | 51 |

TABLE 3-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1326 | A-104 | 80 | B-303 | 20 |
| Exemplary compound 1327 | A-104 | 35 | B-303 | 65 |
| Exemplary compound 1328 | A-104 | 20 | B-303 | 80 |
| Exemplary compound 1329 | A-104 | 49 | B-304 | 51 |
| Exemplary compound 1330 | A-104 | 80 | B-304 | 20 |
| Exemplary compound 1331 | A-104 | 35 | B-304 | 65 |
| Exemplary compound 1332 | A-104 | 20 | B-304 | 80 |
| Exemplary compound 1333 | A-104 | 49 | B-305 | 51 |
| Exemplary compound 1334 | A-104 | 80 | B-305 | 20 |
| Exemplary compound 1335 | A-104 | 35 | B-305 | 65 |
| Exemplary compound 1336 | A-104 | 20 | B-305 | 80 |
| Exemplary compound 1337 | A-104 | 49 | B-306 | 51 |
| Exemplary compound 1338 | A-104 | 80 | B-306 | 20 |
| Exemplary compound 1339 | A-104 | 35 | B-306 | 65 |
| Exemplary compound 1340 | A-104 | 20 | B-306 | 80 |
| Exemplary compound 1341 | A-104 | 49 | B-307 | 51 |
| Exemplary compound 1342 | A-104 | 80 | B-307 | 20 |
| Exemplary compound 1343 | A-104 | 35 | B-307 | 65 |
| Exemplary compound 1344 | A-104 | 20 | B-307 | 80 |
| Exemplary compound 1345 | A-104 | 49 | B-308 | 51 |
| Exemplary compound 1346 | A-104 | 80 | B-308 | 20 |
| Exemplary compound 1347 | A-104 | 35 | B-308 | 65 |
| Exemplary compound 1348 | A-104 | 20 | B-308 | 80 |
| Exemplary compound 1349 | A-104 | 49 | B-401 | 51 |
| Exemplary compound 1350 | A-104 | 80 | B-401 | 20 |
| Exemplary compound 1351 | A-104 | 35 | B-401 | 65 |
| Exemplary compound 1352 | A-104 | 20 | B-401 | 80 |
| Exemplary compound 1353 | A-104 | 49 | B-402 | 51 |
| Exemplary compound 1354 | A-104 | 80 | B-402 | 20 |
| Exemplary compound 1355 | A-104 | 35 | B-402 | 65 |
| Exemplary compound 1356 | A-104 | 20 | B-402 | 80 |
| Exemplary compound 1357 | A-104 | 49 | B-403 | 51 |
| Exemplary compound 1358 | A-104 | 80 | B-403 | 20 |
| Exemplary compound 1359 | A-104 | 35 | B-403 | 65 |
| Exemplary compound 1360 | A-104 | 20 | B-403 | 80 |

TABLE 4

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1361 | A-104 | 49 | B-404 | 51 |
| Exemplary compound 1362 | A-104 | 80 | B-404 | 20 |
| Exemplary compound 1363 | A-104 | 35 | B-404 | 65 |
| Exemplary compound 1364 | A-104 | 20 | B-404 | 80 |
| Exemplary compound 1365 | A-104 | 49 | B-405 | 51 |
| Exemplary compound 1366 | A-104 | 80 | B-405 | 20 |
| Exemplary compound 1367 | A-104 | 35 | B-405 | 65 |
| Exemplary compound 1368 | A-104 | 20 | B-405 | 80 |
| Exemplary compound 1369 | A-105 | 49 | B-101 | 51 |
| Exemplary compound 1370 | A-105 | 80 | B-101 | 20 |
| Exemplary compound 1371 | A-105 | 35 | B-101 | 65 |
| Exemplary compound 1372 | A-105 | 20 | B-101 | 80 |
| Exemplary compound 1373 | A-105 | 49 | B-102 | 51 |
| Exemplary compound 1374 | A-105 | 80 | B-102 | 20 |
| Exemplary compound 1375 | A-105 | 35 | B-102 | 65 |
| Exemplary compound 1376 | A-105 | 20 | B-102 | 80 |
| Exemplary compound 1377 | A-105 | 49 | B-103 | 51 |
| Exemplary compound 1378 | A-105 | 80 | B-103 | 20 |
| Exemplary compound 1379 | A-105 | 35 | B-103 | 65 |
| Exemplary compound 1380 | A-105 | 20 | B-103 | 80 |
| Exemplary compound 1381 | A-105 | 49 | B-104 | 51 |
| Exemplary compound 1382 | A-105 | 80 | B-104 | 20 |
| Exemplary compound 1383 | A-105 | 35 | B-104 | 65 |

TABLE 4-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1384 | A-105 | 20 | B-104 | 80 |
| Exemplary compound 1385 | A-105 | 49 | B-105 | 51 |
| Exemplary compound 1386 | A-105 | 80 | B-105 | 20 |
| Exemplary compound 1387 | A-105 | 35 | B-105 | 65 |
| Exemplary compound 1388 | A-105 | 20 | B-105 | 80 |
| Exemplary compound 1389 | A-105 | 49 | B-201 | 51 |
| Exemplary compound 1390 | A-105 | 80 | B-201 | 20 |
| Exemplary compound 1391 | A-105 | 35 | B-201 | 65 |
| Exemplary compound 1392 | A-105 | 20 | B-201 | 80 |
| Exemplary compound 1393 | A-105 | 49 | B-202 | 51 |
| Exemplary compound 1394 | A-105 | 80 | B-202 | 20 |
| Exemplary compound 1395 | A-105 | 35 | B-202 | 65 |
| Exemplary compound 1396 | A-105 | 20 | B-202 | 80 |
| Exemplary compound 1397 | A-105 | 49 | B-203 | 51 |
| Exemplary compound 1398 | A-105 | 80 | B-203 | 20 |
| Exemplary compound 1399 | A-105 | 35 | B-203 | 65 |
| Exemplary compound 1400 | A-105 | 20 | B-203 | 80 |
| Exemplary compound 1401 | A-105 | 49 | B-204 | 51 |
| Exemplary compound 1402 | A-105 | 80 | B-204 | 20 |
| Exemplary compound 1403 | A-105 | 35 | B-204 | 65 |
| Exemplary compound 1404 | A-105 | 20 | B-204 | 80 |
| Exemplary compound 1405 | A-105 | 49 | B-205 | 51 |
| Exemplary compound 1406 | A-105 | 80 | B-205 | 20 |
| Exemplary compound 1407 | A-105 | 35 | B-205 | 65 |
| Exemplary compound 1408 | A-105 | 20 | B-205 | 80 |
| Exemplary compound 1409 | A-105 | 49 | B-301 | 51 |
| Exemplary compound 1410 | A-105 | 80 | B-301 | 20 |
| Exemplary compound 1411 | A-105 | 35 | B-301 | 65 |
| Exemplary compound 1412 | A-105 | 20 | B-301 | 80 |
| Exemplary compound 1413 | A-105 | 49 | B-302 | 51 |
| Exemplary compound 1414 | A-105 | 80 | B-302 | 20 |
| Exemplary compound 1415 | A-105 | 35 | B-302 | 65 |
| Exemplary compound 1416 | A-105 | 20 | B-302 | 80 |
| Exemplary compound 1417 | A-105 | 49 | B-303 | 51 |
| Exemplary compound 1418 | A-105 | 80 | B-303 | 20 |
| Exemplary compound 1419 | A-105 | 35 | B-303 | 65 |
| Exemplary compound 1420 | A-105 | 20 | B-303 | 80 |
| Exemplary compound 1421 | A-105 | 49 | B-304 | 51 |
| Exemplary compound 1422 | A-105 | 80 | B-304 | 20 |
| Exemplary compound 1423 | A-105 | 35 | B-304 | 65 |
| Exemplary compound 1424 | A-105 | 20 | B-304 | 80 |
| Exemplary compound 1425 | A-105 | 49 | B-305 | 51 |
| Exemplary compound 1426 | A-105 | 80 | B-305 | 20 |
| Exemplary compound 1427 | A-105 | 35 | B-305 | 65 |
| Exemplary compound 1428 | A-105 | 20 | B-305 | 80 |
| Exemplary compound 1429 | A-105 | 49 | B-306 | 51 |
| Exemplary compound 1430 | A-105 | 80 | B-306 | 20 |
| Exemplary compound 1431 | A-105 | 35 | B-306 | 65 |
| Exemplary compound 1432 | A-105 | 20 | B-306 | 80 |
| Exemplary compound 1433 | A-105 | 49 | B-307 | 51 |
| Exemplary compound 1434 | A-105 | 80 | B-307 | 20 |
| Exemplary compound 1435 | A-105 | 35 | B-307 | 65 |
| Exemplary compound 1436 | A-105 | 20 | B-307 | 80 |
| Exemplary compound 1437 | A-105 | 49 | B-308 | 51 |
| Exemplary compound 1438 | A-105 | 80 | B-308 | 20 |
| Exemplary compound 1439 | A-105 | 35 | B-308 | 65 |
| Exemplary compound 1440 | A-105 | 20 | B-308 | 80 |
| Exemplary compound 1441 | A-105 | 49 | B-401 | 51 |
| Exemplary compound 1442 | A-105 | 80 | B-401 | 20 |
| Exemplary compound 1443 | A-105 | 35 | B-401 | 65 |
| Exemplary compound 1444 | A-105 | 20 | B-401 | 80 |
| Exemplary compound 1445 | A-105 | 49 | B-402 | 51 |
| Exemplary compound 1446 | A-105 | 80 | B-402 | 20 |
| Exemplary compound 1447 | A-105 | 35 | B-402 | 65 |
| Exemplary compound 1448 | A-105 | 20 | B-402 | 80 |
| Exemplary compound 1449 | A-105 | 49 | B-403 | 51 |
| Exemplary compound 1450 | A-105 | 80 | B-403 | 20 |
| Exemplary compound 1451 | A-105 | 35 | B-403 | 65 |
| Exemplary compound 1452 | A-105 | 20 | B-403 | 80 |
| Exemplary compound 1453 | A-105 | 49 | B-404 | 51 |
| Exemplary compound 1454 | A-105 | 80 | B-404 | 20 |
| Exemplary compound 1455 | A-105 | 35 | B-404 | 65 |

TABLE 4-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1456 | A-105 | 20 | B-404 | 80 |
| Exemplary compound 1457 | A-105 | 49 | B-405 | 51 |
| Exemplary compound 1458 | A-105 | 80 | B-405 | 20 |
| Exemplary compound 1459 | A-105 | 35 | B-405 | 65 |
| Exemplary compound 1460 | A-105 | 20 | B-405 | 80 |
| Exemplary compound 1461 | A-201 | 49 | B-101 | 51 |
| Exemplary compound 1462 | A-201 | 80 | B-101 | 20 |
| Exemplary compound 1463 | A-201 | 35 | B-101 | 65 |
| Exemplary compound 1464 | A-201 | 20 | B-101 | 80 |
| Exemplary compound 1465 | A-201 | 49 | B-102 | 51 |
| Exemplary compound 1466 | A-201 | 80 | B-102 | 20 |
| Exemplary compound 1467 | A-201 | 35 | B-102 | 65 |
| Exemplary compound 1468 | A-201 | 20 | B-102 | 80 |
| Exemplary compound 1469 | A-201 | 49 | B-103 | 51 |
| Exemplary compound 1470 | A-201 | 80 | B-103 | 20 |
| Exemplary compound 1471 | A-201 | 35 | B-103 | 65 |
| Exemplary compound 1472 | A-201 | 20 | B-103 | 80 |
| Exemplary compound 1473 | A-201 | 49 | B-104 | 51 |
| Exemplary compound 1474 | A-201 | 80 | B-104 | 20 |
| Exemplary compound 1475 | A-201 | 35 | B-104 | 65 |
| Exemplary compound 1476 | A-201 | 20 | B-104 | 80 |
| Exemplary compound 1477 | A-201 | 49 | B-105 | 51 |
| Exemplary compound 1478 | A-201 | 80 | B-105 | 20 |
| Exemplary compound 1479 | A-201 | 35 | B-105 | 65 |
| Exemplary compound 1480 | A-201 | 20 | B-105 | 80 |

TABLE 5

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1481 | A-201 | 49 | B-201 | 51 |
| Exemplary compound 1482 | A-201 | 80 | B-201 | 20 |
| Exemplary compound 1483 | A-201 | 35 | B-201 | 65 |
| Exemplary compound 1484 | A-201 | 20 | B-201 | 80 |
| Exemplary compound 1485 | A-201 | 49 | B-202 | 51 |
| Exemplary compound 1486 | A-201 | 80 | B-202 | 20 |
| Exemplary compound 1487 | A-201 | 35 | B-202 | 65 |
| Exemplary compound 1488 | A-201 | 20 | B-202 | 80 |
| Exemplary compound 1489 | A-201 | 49 | B-203 | 51 |
| Exemplary compound 1490 | A-201 | 80 | B-203 | 20 |
| Exemplary compound 1491 | A-201 | 35 | B-203 | 65 |
| Exemplary compound 1492 | A-201 | 20 | B-203 | 80 |
| Exemplary compound 1493 | A-201 | 49 | B-204 | 51 |
| Exemplary compound 1494 | A-201 | 80 | B-204 | 20 |
| Exemplary compound 1495 | A-201 | 35 | B-204 | 65 |
| Exemplary compound 1496 | A-201 | 20 | B-204 | 80 |
| Exemplary compound 1497 | A-201 | 49 | B-205 | 51 |
| Exemplary compound 1498 | A-201 | 80 | B-205 | 20 |
| Exemplary compound 1499 | A-201 | 35 | B-205 | 65 |
| Exemplary compound 1500 | A-201 | 20 | B-205 | 80 |
| Exemplary compound 1501 | A-201 | 49 | B-301 | 51 |
| Exemplary compound 1502 | A-201 | 80 | B-301 | 20 |
| Exemplary compound 1503 | A-201 | 35 | B-301 | 65 |
| Exemplary compound 1504 | A-201 | 20 | B-301 | 80 |
| Exemplary compound 1505 | A-201 | 49 | B-302 | 51 |
| Exemplary compound 1506 | A-201 | 80 | B-302 | 20 |
| Exemplary compound 1507 | A-201 | 35 | B-302 | 65 |
| Exemplary compound 1508 | A-201 | 20 | B-302 | 80 |
| Exemplary compound 1509 | A-201 | 49 | B-303 | 51 |
| Exemplary compound 1510 | A-201 | 80 | B-303 | 20 |
| Exemplary compound 1511 | A-201 | 35 | B-303 | 65 |
| Exemplary compound 1512 | A-201 | 20 | B-303 | 80 |
| Exemplary compound 1513 | A-201 | 49 | B-304 | 51 |

TABLE 5-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1514 | A-201 | 80 | B-304 | 20 |
| Exemplary compound 1515 | A-201 | 35 | B-304 | 65 |
| Exemplary compound 1516 | A-201 | 20 | B-304 | 80 |
| Exemplary compound 1517 | A-201 | 49 | B-305 | 51 |
| Exemplary compound 1518 | A-201 | 80 | B-305 | 20 |
| Exemplary compound 1519 | A-201 | 35 | B-305 | 65 |
| Exemplary compound 1520 | A-201 | 20 | B-305 | 80 |
| Exemplary compound 1521 | A-201 | 49 | B-306 | 51 |
| Exemplary compound 1522 | A-201 | 80 | B-306 | 20 |
| Exemplary compound 1523 | A-201 | 35 | B-306 | 65 |
| Exemplary compound 1524 | A-201 | 20 | B-306 | 80 |
| Exemplary compound 1525 | A-201 | 49 | B-307 | 51 |
| Exemplary compound 1526 | A-201 | 80 | B-307 | 20 |
| Exemplary compound 1527 | A-201 | 35 | B-307 | 65 |
| Exemplary compound 1528 | A-201 | 20 | B-307 | 80 |
| Exemplary compound 1529 | A-201 | 49 | B-308 | 51 |
| Exemplary compound 1530 | A-201 | 80 | B-308 | 20 |
| Exemplary compound 1531 | A-201 | 35 | B-308 | 65 |
| Exemplary compound 1532 | A-201 | 20 | B-308 | 80 |
| Exemplary compound 1533 | A-201 | 49 | B-401 | 51 |
| Exemplary compound 1534 | A-201 | 80 | B-401 | 20 |
| Exemplary compound 1535 | A-201 | 35 | B-401 | 65 |
| Exemplary compound 1536 | A-201 | 20 | B-401 | 80 |
| Exemplary compound 1537 | A-201 | 49 | B-402 | 51 |
| Exemplary compound 1538 | A-201 | 80 | B-402 | 20 |
| Exemplary compound 1539 | A-201 | 35 | B-402 | 65 |
| Exemplary compound 1540 | A-201 | 20 | B-402 | 80 |
| Exemplary compound 1541 | A-201 | 49 | B-403 | 51 |
| Exemplary compound 1542 | A-201 | 80 | B-403 | 20 |
| Exemplary compound 1543 | A-201 | 35 | B-403 | 65 |
| Exemplary compound 1544 | A-201 | 20 | B-403 | 80 |
| Exemplary compound 1545 | A-201 | 49 | B-404 | 51 |
| Exemplary compound 1546 | A-201 | 80 | B-404 | 20 |
| Exemplary compound 1547 | A-201 | 35 | B-404 | 65 |
| Exemplary compound 1548 | A-201 | 20 | B-404 | 80 |
| Exemplary compound 1549 | A-201 | 49 | B-405 | 51 |
| Exemplary compound 1550 | A-201 | 80 | B-405 | 20 |
| Exemplary compound 1551 | A-201 | 35 | B-405 | 65 |
| Exemplary compound 1552 | A-201 | 20 | B-405 | 80 |
| Exemplary compound 1553 | A-202 | 49 | B-101 | 51 |
| Exemplary compound 1554 | A-202 | 80 | B-101 | 20 |
| Exemplary compound 1555 | A-202 | 35 | B-101 | 65 |
| Exemplary compound 1556 | A-202 | 20 | B-101 | 80 |
| Exemplary compound 1557 | A-202 | 49 | B-102 | 51 |
| Exemplary compound 1558 | A-202 | 80 | B-102 | 20 |
| Exemplary compound 1559 | A-202 | 35 | B-102 | 65 |
| Exemplary compound 1560 | A-202 | 20 | B-102 | 80 |
| Exemplary compound 1561 | A-202 | 49 | B-103 | 51 |
| Exemplary compound 1562 | A-202 | 80 | B-103 | 20 |
| Exemplary compound 1563 | A-202 | 35 | B-103 | 65 |
| Exemplary compound 1564 | A-202 | 20 | B-103 | 80 |
| Exemplary compound 1565 | A-202 | 49 | B-104 | 51 |
| Exemplary compound 1566 | A-202 | 80 | B-104 | 20 |
| Exemplary compound 1567 | A-202 | 35 | B-104 | 65 |
| Exemplary compound 1568 | A-202 | 20 | B-104 | 80 |
| Exemplary compound 1569 | A-202 | 49 | B-105 | 51 |
| Exemplary compound 1570 | A-202 | 80 | B-105 | 20 |
| Exemplary compound 1571 | A-202 | 35 | B-105 | 65 |
| Exemplary compound 1572 | A-202 | 20 | B-105 | 80 |
| Exemplary compound 1573 | A-202 | 49 | B-201 | 51 |
| Exemplary compound 1574 | A-202 | 80 | B-201 | 20 |
| Exemplary compound 1575 | A-202 | 35 | B-201 | 65 |
| Exemplary compound 1576 | A-202 | 20 | B-201 | 80 |
| Exemplary compound 1577 | A-202 | 49 | B-202 | 51 |
| Exemplary compound 1578 | A-202 | 80 | B-202 | 20 |
| Exemplary compound 1579 | A-202 | 35 | B-202 | 65 |
| Exemplary compound 1580 | A-202 | 20 | B-202 | 80 |
| Exemplary compound 1581 | A-202 | 49 | B-203 | 51 |
| Exemplary compound 1582 | A-202 | 80 | B-203 | 20 |
| Exemplary compound 1583 | A-202 | 35 | B-203 | 65 |
| Exemplary compound 1584 | A-202 | 20 | B-203 | 80 |
| Exemplary compound 1585 | A-202 | 49 | B-204 | 51 |

TABLE 5-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1586 | A-202 | 80 | B-204 | 20 |
| Exemplary compound 1587 | A-202 | 35 | B-204 | 65 |
| Exemplary compound 1588 | A-202 | 20 | B-204 | 80 |
| Exemplary compound 1589 | A-202 | 49 | B-205 | 51 |
| Exemplary compound 1590 | A-202 | 80 | B-205 | 20 |
| Exemplary compound 1591 | A-202 | 35 | B-205 | 65 |
| Exemplary compound 1592 | A-202 | 20 | B-205 | 80 |
| Exemplary compound 1593 | A-202 | 49 | B-301 | 51 |
| Exemplary compound 1594 | A-202 | 80 | B-301 | 20 |
| Exemplary compound 1595 | A-202 | 35 | B-301 | 65 |
| Exemplary compound 1596 | A-202 | 20 | B-301 | 80 |
| Exemplary compound 1597 | A-202 | 49 | B-302 | 51 |
| Exemplary compound 1598 | A-202 | 80 | B-302 | 20 |
| Exemplary compound 1599 | A-202 | 35 | B-302 | 65 |
| Exemplary compound 1600 | A-202 | 20 | B-302 | 80 |

TABLE 6

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1601 | A-202 | 49 | B-303 | 51 |
| Exemplary compound 1602 | A-202 | 80 | B-303 | 20 |
| Exemplary compound 1603 | A-202 | 35 | B-303 | 65 |
| Exemplary compound 1604 | A-202 | 20 | B-303 | 80 |
| Exemplary compound 1605 | A-202 | 49 | B-304 | 51 |
| Exemplary compound 1606 | A-202 | 80 | B-304 | 20 |
| Exemplary compound 1607 | A-202 | 35 | B-304 | 65 |
| Exemplary compound 1608 | A-202 | 20 | B-304 | 80 |
| Exemplary compound 1609 | A-202 | 49 | B-305 | 51 |
| Exemplary compound 1610 | A-202 | 80 | B-305 | 20 |
| Exemplary compound 1611 | A-202 | 35 | B-305 | 65 |
| Exemplary compound 1612 | A-202 | 20 | B-305 | 80 |
| Exemplary compound 1613 | A-202 | 49 | B-306 | 51 |
| Exemplary compound 1614 | A-202 | 80 | B-306 | 20 |
| Exemplary compound 1615 | A-202 | 35 | B-306 | 65 |
| Exemplary compound 1616 | A-202 | 20 | B-306 | 80 |
| Exemplary compound 1617 | A-202 | 49 | B-307 | 51 |
| Exemplary compound 1618 | A-202 | 80 | B-307 | 20 |
| Exemplary compound 1619 | A-202 | 35 | B-307 | 65 |
| Exemplary compound 1620 | A-202 | 20 | B-307 | 80 |
| Exemplary compound 1621 | A-202 | 49 | B-308 | 51 |
| Exemplary compound 1622 | A-202 | 80 | B-308 | 20 |
| Exemplary compound 1623 | A-202 | 35 | B-308 | 65 |
| Exemplary compound 1624 | A-202 | 20 | B-308 | 80 |
| Exemplary compound 1625 | A-202 | 49 | B-401 | 51 |
| Exemplary compound 1626 | A-202 | 80 | B-401 | 20 |
| Exemplary compound 1627 | A-202 | 35 | B-401 | 65 |
| Exemplary compound 1628 | A-202 | 20 | B-401 | 80 |
| Exemplary compound 1629 | A-202 | 49 | B-402 | 51 |
| Exemplary compound 1630 | A-202 | 80 | B-402 | 20 |
| Exemplary compound 1631 | A-202 | 35 | B-402 | 65 |
| Exemplary compound 1632 | A-202 | 20 | B-402 | 80 |
| Exemplary compound 1633 | A-202 | 49 | B-403 | 51 |
| Exemplary compound 1634 | A-202 | 80 | B-403 | 20 |
| Exemplary compound 1635 | A-202 | 35 | B-403 | 65 |
| Exemplary compound 1636 | A-202 | 20 | B-403 | 80 |
| Exemplary compound 1637 | A-202 | 49 | B-404 | 51 |
| Exemplary compound 1638 | A-202 | 80 | B-404 | 20 |
| Exemplary compound 1639 | A-202 | 35 | B-404 | 65 |
| Exemplary compound 1640 | A-202 | 20 | B-404 | 80 |
| Exemplary compound 1641 | A-202 | 49 | B-405 | 51 |
| Exemplary compound 1642 | A-202 | 80 | B-405 | 20 |
| Exemplary compound 1643 | A-202 | 35 | B-405 | 65 |

TABLE 6-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1644 | A-202 | 20 | B-405 | 80 |
| Exemplary compound 1645 | A-203 | 49 | B-101 | 51 |
| Exemplary compound 1646 | A-203 | 80 | B-101 | 20 |
| Exemplary compound 1647 | A-203 | 35 | B-101 | 65 |
| Exemplary compound 1648 | A-203 | 20 | B-101 | 80 |
| Exemplary compound 1649 | A-203 | 49 | B-102 | 51 |
| Exemplary compound 1650 | A-203 | 80 | B-102 | 20 |
| Exemplary compound 1651 | A-203 | 35 | B-102 | 65 |
| Exemplary compound 1652 | A-203 | 20 | B-102 | 80 |
| Exemplary compound 1653 | A-203 | 49 | B-103 | 51 |
| Exemplary compound 1654 | A-203 | 80 | B-103 | 20 |
| Exemplary compound 1655 | A-203 | 35 | B-103 | 65 |
| Exemplary compound 1656 | A-203 | 20 | B-103 | 80 |
| Exemplary compound 1657 | A-203 | 49 | B-104 | 51 |
| Exemplary compound 1658 | A-203 | 80 | B-104 | 20 |
| Exemplary compound 1659 | A-203 | 35 | B-104 | 65 |
| Exemplary compound 1660 | A-203 | 20 | B-104 | 80 |
| Exemplary compound 1661 | A-203 | 49 | B-105 | 51 |
| Exemplary compound 1662 | A-203 | 80 | B-105 | 20 |
| Exemplary compound 1663 | A-203 | 35 | B-105 | 65 |
| Exemplary compound 1664 | A-203 | 20 | B-105 | 80 |
| Exemplary compound 1665 | A-203 | 49 | B-201 | 51 |
| Exemplary compound 1666 | A-203 | 80 | B-201 | 20 |
| Exemplary compound 1667 | A-203 | 35 | B-201 | 65 |
| Exemplary compound 1668 | A-203 | 20 | B-201 | 80 |
| Exemplary compound 1669 | A-203 | 49 | B-202 | 51 |
| Exemplary compound 1670 | A-203 | 80 | B-202 | 20 |
| Exemplary compound 1671 | A-203 | 35 | B-202 | 65 |
| Exemplary compound 1672 | A-203 | 20 | B-202 | 80 |
| Exemplary compound 1673 | A-203 | 49 | B-203 | 51 |
| Exemplary compound 1674 | A-203 | 80 | B-203 | 20 |
| Exemplary compound 1675 | A-203 | 35 | B-203 | 65 |
| Exemplary compound 1676 | A-203 | 20 | B-203 | 80 |
| Exemplary compound 1677 | A-203 | 49 | B-204 | 51 |
| Exemplary compound 1678 | A-203 | 80 | B-204 | 20 |
| Exemplary compound 1679 | A-203 | 35 | B-204 | 65 |
| Exemplary compound 1680 | A-203 | 20 | B-204 | 80 |
| Exemplary compound 1681 | A-203 | 49 | B-205 | 51 |
| Exemplary compound 1682 | A-203 | 80 | B-205 | 20 |
| Exemplary compound 1683 | A-203 | 35 | B-205 | 65 |
| Exemplary compound 1684 | A-203 | 20 | B-205 | 80 |
| Exemplary compound 1685 | A-203 | 49 | B-301 | 51 |
| Exemplary compound 1686 | A-203 | 80 | B-301 | 20 |
| Exemplary compound 1687 | A-203 | 35 | B-301 | 65 |
| Exemplary compound 1688 | A-203 | 20 | B-301 | 80 |
| Exemplary compound 1689 | A-203 | 49 | B-302 | 51 |
| Exemplary compound 1690 | A-203 | 80 | B-302 | 20 |
| Exemplary compound 1691 | A-203 | 35 | B-302 | 65 |
| Exemplary compound 1692 | A-203 | 20 | B-302 | 80 |
| Exemplary compound 1693 | A-203 | 49 | B-303 | 51 |
| Exemplary compound 1694 | A-203 | 80 | B-303 | 20 |
| Exemplary compound 1695 | A-203 | 35 | B-303 | 65 |
| Exemplary compound 1696 | A-203 | 20 | B-303 | 80 |
| Exemplary compound 1697 | A-203 | 49 | B-304 | 51 |
| Exemplary compound 1698 | A-203 | 80 | B-304 | 20 |
| Exemplary compound 1699 | A-203 | 35 | B-304 | 65 |
| Exemplary compound 1700 | A-203 | 20 | B-304 | 80 |
| Exemplary compound 1701 | A-203 | 49 | B-305 | 51 |
| Exemplary compound 1702 | A-203 | 80 | B-305 | 20 |
| Exemplary compound 1703 | A-203 | 35 | B-305 | 65 |
| Exemplary compound 1704 | A-203 | 20 | B-305 | 80 |
| Exemplary compound 1705 | A-203 | 49 | B-306 | 51 |
| Exemplary compound 1706 | A-203 | 80 | B-306 | 20 |
| Exemplary compound 1707 | A-203 | 35 | B-306 | 65 |
| Exemplary compound 1708 | A-203 | 20 | B-306 | 80 |
| Exemplary compound 1709 | A-203 | 49 | B-307 | 51 |
| Exemplary compound 1710 | A-203 | 80 | B-307 | 20 |
| Exemplary compound 1711 | A-203 | 35 | B-307 | 65 |
| Exemplary compound 1712 | A-203 | 20 | B-307 | 80 |
| Exemplary compound 1713 | A-203 | 49 | B-308 | 51 |
| Exemplary compound 1714 | A-203 | 80 | B-308 | 20 |
| Exemplary compound 1715 | A-203 | 35 | B-308 | 65 |

TABLE 6-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1716 | A-203 | 20 | B-308 | 80 |
| Exemplary compound 1717 | A-203 | 49 | B-401 | 51 |
| Exemplary compound 1718 | A-203 | 80 | B-401 | 20 |
| Exemplary compound 1719 | A-203 | 35 | B-401 | 65 |
| Exemplary compound 1720 | A-203 | 20 | B-401 | 80 |

TABLE 7

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1721 | A-203 | 49 | B-402 | 51 |
| Exemplary compound 1722 | A-203 | 80 | B-402 | 20 |
| Exemplary compound 1723 | A-203 | 35 | B-402 | 65 |
| Exemplary compound 1724 | A-203 | 20 | B-402 | 80 |
| Exemplary compound 1725 | A-203 | 49 | B-403 | 51 |
| Exemplary compound 1726 | A-203 | 80 | B-403 | 20 |
| Exemplary compound 1727 | A-203 | 35 | B-403 | 65 |
| Exemplary compound 1728 | A-203 | 20 | B-403 | 80 |
| Exemplary compound 1729 | A-203 | 49 | B-404 | 51 |
| Exemplary compound 1730 | A-203 | 80 | B-404 | 20 |
| Exemplary compound 1731 | A-203 | 35 | B-404 | 65 |
| Exemplary compound 1732 | A-203 | 20 | B-404 | 80 |
| Exemplary compound 1733 | A-203 | 49 | B-405 | 51 |
| Exemplary compound 1734 | A-203 | 80 | B-405 | 20 |
| Exemplary compound 1735 | A-203 | 35 | B-405 | 65 |
| Exemplary compound 1736 | A-203 | 20 | B-405 | 80 |
| Exemplary compound 1737 | A-204 | 49 | B-101 | 51 |
| Exemplary compound 1738 | A-204 | 80 | B-101 | 20 |
| Exemplary compound 1739 | A-204 | 35 | B-101 | 65 |
| Exemplary compound 1740 | A-204 | 20 | B-101 | 80 |
| Exemplary compound 1741 | A-204 | 49 | B-102 | 51 |
| Exemplary compound 1742 | A-204 | 80 | B-102 | 20 |
| Exemplary compound 1743 | A-204 | 35 | B-102 | 65 |
| Exemplary compound 1744 | A-204 | 20 | B-102 | 80 |
| Exemplary compound 1745 | A-204 | 49 | B-103 | 51 |
| Exemplary compound 1746 | A-204 | 80 | B-103 | 20 |
| Exemplary compound 1747 | A-204 | 35 | B-103 | 65 |
| Exemplary compound 1748 | A-204 | 20 | B-103 | 80 |
| Exemplary compound 1749 | A-204 | 49 | B-104 | 51 |
| Exemplary compound 1750 | A-204 | 80 | B-104 | 20 |
| Exemplary compound 1751 | A-204 | 35 | B-104 | 65 |
| Exemplary compound 1752 | A-204 | 20 | B-104 | 80 |
| Exemplary compound 1753 | A-204 | 49 | B-105 | 51 |
| Exemplary compound 1754 | A-204 | 80 | B-105 | 20 |
| Exemplary compound 1755 | A-204 | 35 | B-105 | 65 |
| Exemplary compound 1756 | A-204 | 20 | B-105 | 80 |
| Exemplary compound 1757 | A-204 | 49 | B-201 | 51 |
| Exemplary compound 1758 | A-204 | 80 | B-201 | 20 |
| Exemplary compound 1759 | A-204 | 35 | B-201 | 65 |
| Exemplary compound 1760 | A-204 | 20 | B-201 | 80 |
| Exemplary compound 1761 | A-204 | 49 | B-202 | 51 |
| Exemplary compound 1762 | A-204 | 80 | B-202 | 20 |
| Exemplary compound 1763 | A-204 | 35 | B-202 | 65 |
| Exemplary compound 1764 | A-204 | 20 | B-202 | 80 |
| Exemplary compound 1765 | A-204 | 49 | B-203 | 51 |
| Exemplary compound 1766 | A-204 | 80 | B-203 | 20 |
| Exemplary compound 1767 | A-204 | 35 | B-203 | 65 |
| Exemplary compound 1768 | A-204 | 20 | B-203 | 80 |
| Exemplary compound 1769 | A-204 | 49 | B-204 | 51 |
| Exemplary compound 1770 | A-204 | 80 | B-204 | 20 |
| Exemplary compound 1771 | A-204 | 35 | B-204 | 65 |
| Exemplary compound 1772 | A-204 | 20 | B-204 | 80 |
| Exemplary compound 1773 | A-204 | 49 | B-205 | 51 |

TABLE 7-continued

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1774 | A-204 | 80 | B-205 | 20 |
| Exemplary compound 1775 | A-204 | 35 | B-205 | 65 |
| Exemplary compound 1776 | A-204 | 20 | B-205 | 80 |
| Exemplary compound 1777 | A-204 | 49 | B-301 | 51 |
| Exemplary compound 1778 | A-204 | 80 | B-301 | 20 |
| Exemplary compound 1779 | A-204 | 35 | B-301 | 65 |
| Exemplary compound 1780 | A-204 | 20 | B-301 | 80 |
| Exemplary compound 1781 | A-204 | 49 | B-302 | 51 |
| Exemplary compound 1782 | A-204 | 80 | B-302 | 20 |
| Exemplary compound 1783 | A-204 | 35 | B-302 | 65 |
| Exemplary compound 1784 | A-204 | 20 | B-302 | 80 |
| Exemplary compound 1785 | A-204 | 49 | B-303 | 51 |
| Exemplary compound 1786 | A-204 | 80 | B-303 | 20 |
| Exemplary compound 1787 | A-204 | 35 | B-303 | 65 |
| Exemplary compound 1788 | A-204 | 20 | B-303 | 80 |
| Exemplary compound 1789 | A-204 | 49 | B-304 | 51 |
| Exemplary compound 1790 | A-204 | 80 | B-304 | 20 |
| Exemplary compound 1791 | A-204 | 35 | B-304 | 65 |
| Exemplary compound 1792 | A-204 | 20 | B-304 | 80 |
| Exemplary compound 1793 | A-204 | 49 | B-305 | 51 |
| Exemplary compound 1794 | A-204 | 80 | B-305 | 20 |
| Exemplary compound 1795 | A-204 | 35 | B-305 | 65 |
| Exemplary compound 1796 | A-204 | 20 | B-305 | 80 |
| Exemplary compound 1797 | A-204 | 49 | B-306 | 51 |
| Exemplary compound 1798 | A-204 | 80 | B-306 | 20 |
| Exemplary compound 1799 | A-204 | 35 | B-306 | 65 |
| Exemplary compound 1800 | A-204 | 20 | B-306 | 80 |
| Exemplary compound 1801 | A-204 | 49 | B-307 | 51 |
| Exemplary compound 1802 | A-204 | 80 | B-307 | 20 |
| Exemplary compound 1803 | A-204 | 35 | B-307 | 65 |
| Exemplary compound 1804 | A-204 | 20 | B-307 | 80 |
| Exemplary compound 1805 | A-204 | 49 | B-308 | 51 |
| Exemplary compound 1806 | A-204 | 80 | B-308 | 20 |
| Exemplary compound 1807 | A-204 | 35 | B-308 | 65 |
| Exemplary compound 1808 | A-204 | 20 | B-308 | 80 |
| Exemplary compound 1809 | A-204 | 49 | B-401 | 51 |
| Exemplary compound 1810 | A-204 | 80 | B-401 | 20 |
| Exemplary compound 1811 | A-204 | 35 | B-401 | 65 |
| Exemplary compound 1812 | A-204 | 20 | B-401 | 80 |
| Exemplary compound 1813 | A-204 | 49 | B-402 | 51 |
| Exemplary compound 1814 | A-204 | 80 | B-402 | 20 |
| Exemplary compound 1815 | A-204 | 35 | B-402 | 65 |
| Exemplary compound 1816 | A-204 | 20 | B-402 | 80 |
| Exemplary compound 1817 | A-204 | 49 | B-403 | 51 |
| Exemplary compound 1818 | A-204 | 80 | B-403 | 20 |
| Exemplary compound 1819 | A-204 | 35 | B-403 | 65 |
| Exemplary compound 1820 | A-204 | 20 | B-403 | 80 |
| Exemplary compound 1821 | A-204 | 49 | B-404 | 51 |
| Exemplary compound 1822 | A-204 | 80 | B-404 | 20 |
| Exemplary compound 1823 | A-204 | 35 | B-404 | 65 |
| Exemplary compound 1824 | A-204 | 20 | B-404 | 80 |
| Exemplary compound 1825 | A-204 | 49 | B-405 | 51 |
| Exemplary compound 1826 | A-204 | 80 | B-405 | 20 |
| Exemplary compound 1827 | A-204 | 35 | B-405 | 65 |
| Exemplary compound 1828 | A-204 | 20 | B-405 | 80 |
| Exemplary compound 1829 | A-205 | 49 | B-101 | 51 |
| Exemplary compound 1830 | A-205 | 80 | B-101 | 20 |
| Exemplary compound 1831 | A-205 | 35 | B-101 | 65 |
| Exemplary compound 1832 | A-205 | 20 | B-101 | 80 |
| Exemplary compound 1833 | A-205 | 49 | B-102 | 51 |
| Exemplary compound 1834 | A-205 | 80 | B-102 | 20 |
| Exemplary compound 1835 | A-205 | 35 | B-102 | 65 |
| Exemplary compound 1836 | A-205 | 20 | B-102 | 80 |
| Exemplary compound 1837 | A-205 | 49 | B-103 | 51 |
| Exemplary compound 1838 | A-205 | 80 | B-103 | 20 |
| Exemplary compound 1839 | A-205 | 35 | B-103 | 65 |
| Exemplary compound 1840 | A-205 | 20 | B-103 | 80 |

TABLE 8

Specific examples of polycarbonate resin

| Exemplary compound No. | Group A Structure | Group A Content ratio (mol %) | Group B Structure | Group B Content ratio (mol %) |
|---|---|---|---|---|
| Exemplary compound 1841 | A-205 | 49 | B-104 | 51 |
| Exemplary compound 1842 | A-205 | 80 | B-104 | 20 |
| Exemplary compound 1843 | A-205 | 35 | B-104 | 65 |
| Exemplary compound 1844 | A-205 | 20 | B-104 | 80 |
| Exemplary compound 1845 | A-205 | 49 | B-105 | 51 |
| Exemplary compound 1846 | A-205 | 80 | B-105 | 20 |
| Exemplary compound 1847 | A-205 | 35 | B-105 | 65 |
| Exemplary compound 1848 | A-205 | 20 | B-105 | 80 |
| Exemplary compound 1849 | A-205 | 49 | B-201 | 51 |
| Exemplary compound 1850 | A-205 | 80 | B-201 | 20 |
| Exemplary compound 1851 | A-205 | 35 | B-201 | 65 |
| Exemplary compound 1852 | A-205 | 20 | B-201 | 80 |
| Exemplary compound 1853 | A-205 | 49 | B-202 | 51 |
| Exemplary compound 1854 | A-205 | 80 | B-202 | 20 |
| Exemplary compound 1855 | A-205 | 35 | B-202 | 65 |
| Exemplary compound 1856 | A-205 | 20 | B-202 | 80 |
| Exemplary compound 1857 | A-205 | 49 | B-203 | 51 |
| Exemplary compound 1858 | A-205 | 80 | B-203 | 20 |
| Exemplary compound 1859 | A-205 | 35 | B-203 | 65 |
| Exemplary compound 1860 | A-205 | 20 | B-203 | 80 |
| Exemplary compound 1861 | A-205 | 49 | B-204 | 51 |
| Exemplary compound 1862 | A-205 | 80 | B-204 | 20 |
| Exemplary compound 1863 | A-205 | 35 | B-204 | 65 |
| Exemplary compound 1864 | A-205 | 20 | B-204 | 80 |
| Exemplary compound 1865 | A-205 | 49 | B-205 | 51 |
| Exemplary compound 1866 | A-205 | 80 | B-205 | 20 |
| Exemplary compound 1867 | A-205 | 35 | B-205 | 65 |
| Exemplary compound 1868 | A-205 | 20 | B-205 | 80 |
| Exemplary compound 1869 | A-205 | 49 | B-301 | 51 |
| Exemplary compound 1870 | A-205 | 80 | B-301 | 20 |
| Exemplary compound 1871 | A-205 | 35 | B-301 | 65 |
| Exemplary compound 1872 | A-205 | 20 | B-301 | 80 |
| Exemplary compound 1873 | A-205 | 49 | B-302 | 51 |
| Exemplary compound 1874 | A-205 | 80 | B-302 | 20 |
| Exemplary compound 1875 | A-205 | 35 | B-302 | 65 |
| Exemplary compound 1876 | A-205 | 20 | B-302 | 80 |
| Exemplary compound 1877 | A-205 | 49 | B-303 | 51 |
| Exemplary compound 1878 | A-205 | 80 | B-303 | 20 |
| Exemplary compound 1879 | A-205 | 35 | B-303 | 65 |
| Exemplary compound 1880 | A-205 | 20 | B-303 | 80 |
| Exemplary compound 1881 | A-205 | 49 | B-304 | 51 |
| Exemplary compound 1882 | A-205 | 80 | B-304 | 20 |
| Exemplary compound 1883 | A-205 | 35 | B-304 | 65 |
| Exemplary compound 1884 | A-205 | 20 | B-304 | 80 |
| Exemplary compound 1885 | A-205 | 49 | B-305 | 51 |
| Exemplary compound 1886 | A-205 | 80 | B-305 | 20 |
| Exemplary compound 1887 | A-205 | 35 | B-305 | 65 |
| Exemplary compound 1888 | A-205 | 20 | B-305 | 80 |
| Exemplary compound 1889 | A-205 | 49 | B-306 | 51 |
| Exemplary compound 1890 | A-205 | 80 | B-306 | 20 |
| Exemplary compound 1891 | A-205 | 35 | B-306 | 65 |
| Exemplary compound 1892 | A-205 | 20 | B-306 | 80 |
| Exemplary compound 1893 | A-205 | 49 | B-307 | 51 |
| Exemplary compound 1894 | A-205 | 80 | B-307 | 20 |
| Exemplary compound 1895 | A-205 | 35 | B-307 | 65 |
| Exemplary compound 1896 | A-205 | 20 | B-307 | 80 |
| Exemplary compound 1897 | A-205 | 49 | B-308 | 51 |
| Exemplary compound 1898 | A-205 | 80 | B-308 | 20 |
| Exemplary compound 1899 | A-205 | 35 | B-308 | 65 |
| Exemplary compound 1900 | A-205 | 20 | B-308 | 80 |
| Exemplary compound 1901 | A-205 | 49 | B-401 | 51 |
| Exemplary compound 1902 | A-205 | 80 | B-401 | 20 |
| Exemplary compound 1903 | A-205 | 35 | B-401 | 65 |
| Exemplary compound 1904 | A-205 | 20 | B-401 | 80 |
| Exemplary compound 1905 | A-205 | 49 | B-402 | 51 |
| Exemplary compound 1906 | A-205 | 80 | B-402 | 20 |
| Exemplary compound 1907 | A-205 | 35 | B-402 | 65 |
| Exemplary compound 1908 | A-205 | 20 | B-402 | 80 |
| Exemplary compound 1909 | A-205 | 49 | B-403 | 51 |
| Exemplary compound 1910 | A-205 | 80 | B-403 | 20 |
| Exemplary compound 1911 | A-205 | 35 | B-403 | 65 |
| Exemplary compound 1912 | A-205 | 20 | B-403 | 80 |

TABLE 8-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 1913 | A-205 | 49 | B-404 | 51 |
| Exemplary compound 1914 | A-205 | 80 | B-404 | 20 |
| Exemplary compound 1915 | A-205 | 35 | B-404 | 65 |
| Exemplary compound 1916 | A-205 | 20 | B-404 | 80 |
| Exemplary compound 1917 | A-205 | 49 | B-405 | 51 |
| Exemplary compound 1918 | A-205 | 80 | B-405 | 20 |
| Exemplary compound 1919 | A-205 | 35 | B-405 | 65 |
| Exemplary compound 1920 | A-205 | 20 | B-405 | 80 |
| Exemplary compound 2281 | A-401 | 49 | B-101 | 51 |
| Exemplary compound 2282 | A-401 | 80 | B-101 | 20 |
| Exemplary compound 2283 | A-401 | 35 | B-101 | 65 |
| Exemplary compound 2284 | A-401 | 20 | B-101 | 80 |
| Exemplary compound 2285 | A-401 | 49 | B-102 | 51 |
| Exemplary compound 2286 | A-401 | 80 | B-102 | 20 |
| Exemplary compound 2287 | A-401 | 35 | B-102 | 65 |
| Exemplary compound 2288 | A-401 | 20 | B-102 | 80 |
| Exemplary compound 2289 | A-401 | 49 | B-103 | 51 |
| Exemplary compound 2290 | A-401 | 80 | B-103 | 20 |
| Exemplary compound 2291 | A-401 | 35 | B-103 | 65 |
| Exemplary compound 2292 | A-401 | 20 | B-103 | 80 |
| Exemplary compound 2293 | A-401 | 49 | B-104 | 51 |
| Exemplary compound 2294 | A-401 | 80 | B-104 | 20 |
| Exemplary compound 2295 | A-401 | 35 | B-104 | 65 |
| Exemplary compound 2296 | A-401 | 20 | B-104 | 80 |
| Exemplary compound 2297 | A-401 | 49 | B-105 | 51 |
| Exemplary compound 2298 | A-401 | 80 | B-105 | 20 |
| Exemplary compound 2299 | A-401 | 35 | B-105 | 65 |
| Exemplary compound 2300 | A-401 | 20 | B-105 | 80 |
| Exemplary compound 2301 | A-401 | 49 | B-201 | 51 |
| Exemplary compound 2302 | A-401 | 80 | B-201 | 20 |
| Exemplary compound 2303 | A-401 | 35 | B-201 | 65 |
| Exemplary compound 2304 | A-401 | 20 | B-201 | 80 |
| Exemplary compound 2305 | A-401 | 49 | B-202 | 51 |
| Exemplary compound 2306 | A-401 | 80 | B-202 | 20 |
| Exemplary compound 2307 | A-401 | 35 | B-202 | 65 |
| Exemplary compound 2308 | A-401 | 20 | B-202 | 80 |
| Exemplary compound 2309 | A-401 | 49 | B-203 | 51 |
| Exemplary compound 2310 | A-401 | 80 | B-203 | 20 |
| Exemplary compound 2311 | A-401 | 35 | B-203 | 65 |
| Exemplary compound 2312 | A-401 | 20 | B-203 | 80 |
| Exemplary compound 2313 | A-401 | 49 | B-204 | 51 |
| Exemplary compound 2314 | A-401 | 80 | B-204 | 20 |
| Exemplary compound 2315 | A-401 | 35 | B-204 | 65 |
| Exemplary compound 2316 | A-401 | 20 | B-204 | 80 |
| Exemplary compound 2317 | A-401 | 49 | B-205 | 51 |
| Exemplary compound 2318 | A-401 | 80 | B-205 | 20 |
| Exemplary compound 2319 | A-401 | 35 | B-205 | 65 |
| Exemplary compound 2320 | A-401 | 20 | B-205 | 80 |

TABLE 9

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2321 | A-401 | 49 | B-301 | 51 |
| Exemplary compound 2322 | A-401 | 80 | B-301 | 20 |
| Exemplary compound 2323 | A-401 | 35 | B-301 | 65 |
| Exemplary compound 2324 | A-401 | 20 | B-301 | 80 |
| Exemplary compound 2325 | A-401 | 49 | B-302 | 51 |
| Exemplary compound 2326 | A-401 | 80 | B-302 | 20 |
| Exemplary compound 2327 | A-401 | 35 | B-302 | 65 |
| Exemplary compound 2328 | A-401 | 20 | B-302 | 80 |
| Exemplary compound 2329 | A-401 | 49 | B-303 | 51 |
| Exemplary compound 2330 | A-401 | 80 | B-303 | 20 |

TABLE 9-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2331 | A-401 | 35 | B-303 | 65 |
| Exemplary compound 2332 | A-401 | 20 | B-303 | 80 |
| Exemplary compound 2333 | A-401 | 49 | B-304 | 51 |
| Exemplary compound 2334 | A-401 | 80 | B-304 | 20 |
| Exemplary compound 2335 | A-401 | 35 | B-304 | 65 |
| Exemplary compound 2336 | A-401 | 20 | B-304 | 80 |
| Exemplary compound 2337 | A-401 | 49 | B-305 | 51 |
| Exemplary compound 2338 | A-401 | 80 | B-305 | 20 |
| Exemplary compound 2339 | A-401 | 35 | B-305 | 65 |
| Exemplary compound 2340 | A-401 | 20 | B-305 | 80 |
| Exemplary compound 2341 | A-401 | 49 | B-306 | 51 |
| Exemplary compound 2342 | A-401 | 80 | B-306 | 20 |
| Exemplary compound 2343 | A-401 | 35 | B-306 | 65 |
| Exemplary compound 2344 | A-401 | 20 | B-306 | 80 |
| Exemplary compound 2345 | A-401 | 49 | B-307 | 51 |
| Exemplary compound 2346 | A-401 | 80 | B-307 | 20 |
| Exemplary compound 2347 | A-401 | 35 | B-307 | 65 |
| Exemplary compound 2348 | A-401 | 20 | B-307 | 80 |
| Exemplary compound 2349 | A-401 | 49 | B-308 | 51 |
| Exemplary compound 2350 | A-401 | 80 | B-308 | 20 |
| Exemplary compound 2351 | A-401 | 35 | B-308 | 65 |
| Exemplary compound 2352 | A-401 | 20 | B-308 | 80 |
| Exemplary compound 2353 | A-401 | 49 | B-401 | 51 |
| Exemplary compound 2354 | A-401 | 80 | B-401 | 20 |
| Exemplary compound 2355 | A-401 | 35 | B-401 | 65 |
| Exemplary compound 2356 | A-401 | 20 | B-401 | 80 |
| Exemplary compound 2357 | A-401 | 49 | B-402 | 51 |
| Exemplary compound 2358 | A-401 | 80 | B-402 | 20 |
| Exemplary compound 2359 | A-401 | 35 | B-402 | 65 |
| Exemplary compound 2360 | A-401 | 20 | B-402 | 80 |
| Exemplary compound 2361 | A-401 | 49 | B-403 | 51 |
| Exemplary compound 2362 | A-401 | 80 | B-403 | 20 |
| Exemplary compound 2363 | A-401 | 35 | B-403 | 65 |
| Exemplary compound 2364 | A-401 | 20 | B-403 | 80 |
| Exemplary compound 2365 | A-401 | 49 | B-404 | 51 |
| Exemplary compound 2366 | A-401 | 80 | B-404 | 20 |
| Exemplary compound 2367 | A-401 | 35 | B-404 | 65 |
| Exemplary compound 2368 | A-401 | 20 | B-404 | 80 |
| Exemplary compound 2369 | A-401 | 49 | B-405 | 51 |
| Exemplary compound 2370 | A-401 | 80 | B-405 | 20 |
| Exemplary compound 2371 | A-401 | 35 | B-405 | 65 |
| Exemplary compound 2372 | A-401 | 20 | B-405 | 80 |
| Exemplary compound 2373 | A-402 | 49 | B-101 | 51 |
| Exemplary compound 2374 | A-402 | 80 | B-101 | 20 |
| Exemplary compound 2375 | A-402 | 35 | B-101 | 65 |
| Exemplary compound 2376 | A-402 | 20 | B-101 | 80 |
| Exemplary compound 2377 | A-402 | 49 | B-102 | 51 |
| Exemplary compound 2378 | A-402 | 80 | B-102 | 20 |
| Exemplary compound 2379 | A-402 | 35 | B-102 | 65 |
| Exemplary compound 2380 | A-402 | 20 | B-102 | 80 |
| Exemplary compound 2381 | A-402 | 49 | B-103 | 51 |
| Exemplary compound 2382 | A-402 | 80 | B-103 | 20 |
| Exemplary compound 2383 | A-402 | 35 | B-103 | 65 |
| Exemplary compound 2384 | A-402 | 20 | B-103 | 80 |
| Exemplary compound 2385 | A-402 | 49 | B-104 | 51 |
| Exemplary compound 2386 | A-402 | 80 | B-104 | 20 |
| Exemplary compound 2387 | A-402 | 35 | B-104 | 65 |
| Exemplary compound 2388 | A-402 | 20 | B-104 | 80 |
| Exemplary compound 2389 | A-402 | 49 | B-105 | 51 |
| Exemplary compound 2390 | A-402 | 80 | B-105 | 20 |
| Exemplary compound 2391 | A-402 | 35 | B-105 | 65 |
| Exemplary compound 2392 | A-402 | 20 | B-105 | 80 |
| Exemplary compound 2393 | A-402 | 49 | B-201 | 51 |
| Exemplary compound 2394 | A-402 | 80 | B-201 | 20 |
| Exemplary compound 2395 | A-402 | 35 | B-201 | 65 |
| Exemplary compound 2396 | A-402 | 20 | B-201 | 80 |
| Exemplary compound 2397 | A-402 | 49 | B-202 | 51 |
| Exemplary compound 2398 | A-402 | 80 | B-202 | 20 |
| Exemplary compound 2399 | A-402 | 35 | B-202 | 65 |
| Exemplary compound 2400 | A-402 | 20 | B-202 | 80 |
| Exemplary compound 2401 | A-402 | 49 | B-203 | 51 |
| Exemplary compound 2402 | A-402 | 80 | B-203 | 20 |

TABLE 9-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2403 | A-402 | 35 | B-203 | 65 |
| Exemplary compound 2404 | A-402 | 20 | B-203 | 80 |
| Exemplary compound 2405 | A-402 | 49 | B-204 | 51 |
| Exemplary compound 2406 | A-402 | 80 | B-204 | 20 |
| Exemplary compound 2407 | A-402 | 35 | B-204 | 65 |
| Exemplary compound 2408 | A-402 | 20 | B-204 | 80 |
| Exemplary compound 2409 | A-402 | 49 | B-205 | 51 |
| Exemplary compound 2410 | A-402 | 80 | B-205 | 20 |
| Exemplary compound 2411 | A-402 | 35 | B-205 | 65 |
| Exemplary compound 2412 | A-402 | 20 | B-205 | 80 |
| Exemplary compound 2413 | A-402 | 49 | B-301 | 51 |
| Exemplary compound 2414 | A-402 | 80 | B-301 | 20 |
| Exemplary compound 2415 | A-402 | 35 | B-301 | 65 |
| Exemplary compound 2416 | A-402 | 20 | B-301 | 80 |
| Exemplary compound 2417 | A-402 | 49 | B-302 | 51 |
| Exemplary compound 2418 | A-402 | 80 | B-302 | 20 |
| Exemplary compound 2419 | A-402 | 35 | B-302 | 65 |
| Exemplary compound 2420 | A-402 | 20 | B-302 | 80 |
| Exemplary compound 2421 | A-402 | 49 | B-303 | 51 |
| Exemplary compound 2422 | A-402 | 80 | B-303 | 20 |
| Exemplary compound 2423 | A-402 | 35 | B-303 | 65 |
| Exemplary compound 2424 | A-402 | 20 | B-303 | 80 |
| Exemplary compound 2425 | A-402 | 49 | B-304 | 51 |
| Exemplary compound 2426 | A-402 | 80 | B-304 | 20 |
| Exemplary compound 2427 | A-402 | 35 | B-304 | 65 |
| Exemplary compound 2428 | A-402 | 20 | B-304 | 80 |
| Exemplary compound 2429 | A-402 | 49 | B-305 | 51 |
| Exemplary compound 2430 | A-402 | 80 | B-305 | 20 |
| Exemplary compound 2431 | A-402 | 35 | B-305 | 65 |
| Exemplary compound 2432 | A-402 | 20 | B-305 | 80 |
| Exemplary compound 2433 | A-402 | 49 | B-306 | 51 |
| Exemplary compound 2434 | A-402 | 80 | B-306 | 20 |
| Exemplary compound 2435 | A-402 | 35 | B-306 | 65 |
| Exemplary compound 2436 | A-402 | 20 | B-306 | 80 |
| Exemplary compound 2437 | A-402 | 49 | B-307 | 51 |
| Exemplary compound 2438 | A-402 | 80 | B-307 | 20 |
| Exemplary compound 2439 | A-402 | 35 | B-307 | 65 |
| Exemplary compound 2440 | A-402 | 20 | B-307 | 80 |

TABLE 10

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2441 | A-402 | 49 | B-308 | 51 |
| Exemplary compound 2442 | A-402 | 80 | B-308 | 20 |
| Exemplary compound 2443 | A-402 | 35 | B-308 | 65 |
| Exemplary compound 2444 | A-402 | 20 | B-308 | 80 |
| Exemplary compound 2445 | A-402 | 49 | B-401 | 51 |
| Exemplary compound 2446 | A-402 | 80 | B-401 | 20 |
| Exemplary compound 2447 | A-402 | 35 | B-401 | 65 |
| Exemplary compound 2448 | A-402 | 20 | B-401 | 80 |
| Exemplary compound 2449 | A-402 | 49 | B-402 | 51 |
| Exemplary compound 2450 | A-402 | 80 | B-402 | 20 |
| Exemplary compound 2451 | A-402 | 35 | B-402 | 65 |
| Exemplary compound 2452 | A-402 | 20 | B-402 | 80 |
| Exemplary compound 2453 | A-402 | 49 | B-403 | 51 |
| Exemplary compound 2454 | A-402 | 80 | B-403 | 20 |
| Exemplary compound 2455 | A-402 | 35 | B-403 | 65 |
| Exemplary compound 2456 | A-402 | 20 | B-403 | 80 |
| Exemplary compound 2457 | A-402 | 49 | B-404 | 51 |
| Exemplary compound 2458 | A-402 | 80 | B-404 | 20 |
| Exemplary compound 2459 | A-402 | 35 | B-404 | 65 |
| Exemplary compound 2460 | A-402 | 20 | B-404 | 80 |

TABLE 10-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2461 | A-402 | 49 | B-405 | 51 |
| Exemplary compound 2462 | A-402 | 80 | B-405 | 20 |
| Exemplary compound 2463 | A-402 | 35 | B-405 | 65 |
| Exemplary compound 2464 | A-402 | 20 | B-405 | 80 |
| Exemplary compound 2465 | A-403 | 49 | B-101 | 51 |
| Exemplary compound 2466 | A-403 | 80 | B-101 | 20 |
| Exemplary compound 2467 | A-403 | 35 | B-101 | 65 |
| Exemplary compound 2468 | A-403 | 20 | B-101 | 80 |
| Exemplary compound 2469 | A-403 | 49 | B-102 | 51 |
| Exemplary compound 2470 | A-403 | 80 | B-102 | 20 |
| Exemplary compound 2471 | A-403 | 35 | B-102 | 65 |
| Exemplary compound 2472 | A-403 | 20 | B-102 | 80 |
| Exemplary compound 2473 | A-403 | 49 | B-103 | 51 |
| Exemplary compound 2474 | A-403 | 80 | B-103 | 20 |
| Exemplary compound 2475 | A-403 | 35 | B-103 | 65 |
| Exemplary compound 2476 | A-403 | 20 | B-103 | 80 |
| Exemplary compound 2477 | A-403 | 49 | B-104 | 51 |
| Exemplary compound 2478 | A-403 | 80 | B-104 | 20 |
| Exemplary compound 2479 | A-403 | 35 | B-104 | 65 |
| Exemplary compound 2480 | A-403 | 20 | B-104 | 80 |
| Exemplary compound 2481 | A-403 | 49 | B-105 | 51 |
| Exemplary compound 2482 | A-403 | 80 | B-105 | 20 |
| Exemplary compound 2483 | A-403 | 35 | B-105 | 65 |
| Exemplary compound 2484 | A-403 | 20 | B-105 | 80 |
| Exemplary compound 2485 | A-403 | 49 | B-201 | 51 |
| Exemplary compound 2486 | A-403 | 80 | B-201 | 20 |
| Exemplary compound 2487 | A-403 | 35 | B-201 | 65 |
| Exemplary compound 2488 | A-403 | 20 | B-201 | 80 |
| Exemplary compound 2489 | A-403 | 49 | B-202 | 51 |
| Exemplary compound 2490 | A-403 | 80 | B-202 | 20 |
| Exemplary compound 2491 | A-403 | 35 | B-202 | 65 |
| Exemplary compound 2492 | A-403 | 20 | B-202 | 80 |
| Exemplary compound 2493 | A-403 | 49 | B-203 | 51 |
| Exemplary compound 2494 | A-403 | 80 | B-203 | 20 |
| Exemplary compound 2495 | A-403 | 35 | B-203 | 65 |
| Exemplary compound 2496 | A-403 | 20 | B-203 | 80 |
| Exemplary compound 2497 | A-403 | 49 | B-204 | 51 |
| Exemplary compound 2498 | A-403 | 80 | B-204 | 20 |
| Exemplary compound 2499 | A-403 | 35 | B-204 | 65 |
| Exemplary compound 2500 | A-403 | 20 | B-204 | 80 |
| Exemplary compound 2501 | A-403 | 49 | B-205 | 51 |
| Exemplary compound 2502 | A-403 | 80 | B-205 | 20 |
| Exemplary compound 2503 | A-403 | 35 | B-205 | 65 |
| Exemplary compound 2504 | A-403 | 20 | B-205 | 80 |
| Exemplary compound 2505 | A-403 | 49 | B-301 | 51 |
| Exemplary compound 2506 | A-403 | 80 | B-301 | 20 |
| Exemplary compound 2507 | A-403 | 35 | B-301 | 65 |
| Exemplary compound 2508 | A-403 | 20 | B-301 | 80 |
| Exemplary compound 2509 | A-403 | 49 | B-302 | 51 |
| Exemplary compound 2510 | A-403 | 80 | B-302 | 20 |
| Exemplary compound 2511 | A-403 | 35 | B-302 | 65 |
| Exemplary compound 2512 | A-403 | 20 | B-302 | 80 |
| Exemplary compound 2513 | A-403 | 49 | B-303 | 51 |
| Exemplary compound 2514 | A-403 | 80 | B-303 | 20 |
| Exemplary compound 2515 | A-403 | 35 | B-303 | 65 |
| Exemplary compound 2516 | A-403 | 20 | B-303 | 80 |
| Exemplary compound 2517 | A-403 | 49 | B-304 | 51 |
| Exemplary compound 2518 | A-403 | 80 | B-304 | 20 |
| Exemplary compound 2519 | A-403 | 35 | B-304 | 65 |
| Exemplary compound 2520 | A-403 | 20 | B-304 | 80 |
| Exemplary compound 2521 | A-403 | 49 | B-305 | 51 |
| Exemplary compound 2522 | A-403 | 80 | B-305 | 20 |
| Exemplary compound 2523 | A-403 | 35 | B-305 | 65 |
| Exemplary compound 2524 | A-403 | 20 | B-305 | 80 |
| Exemplary compound 2525 | A-403 | 49 | B-306 | 51 |
| Exemplary compound 2526 | A-403 | 80 | B-306 | 20 |
| Exemplary compound 2527 | A-403 | 35 | B-306 | 65 |
| Exemplary compound 2528 | A-403 | 20 | B-306 | 80 |
| Exemplary compound 2529 | A-403 | 49 | B-307 | 51 |
| Exemplary compound 2530 | A-403 | 80 | B-307 | 20 |
| Exemplary compound 2531 | A-403 | 35 | B-307 | 65 |
| Exemplary compound 2532 | A-403 | 20 | B-307 | 80 |

TABLE 10-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2533 | A-403 | 49 | B-308 | 51 |
| Exemplary compound 2534 | A-403 | 80 | B-308 | 20 |
| Exemplary compound 2535 | A-403 | 35 | B-308 | 65 |
| Exemplary compound 2536 | A-403 | 20 | B-308 | 80 |
| Exemplary compound 2537 | A-403 | 49 | B-401 | 51 |
| Exemplary compound 2538 | A-403 | 80 | B-401 | 20 |
| Exemplary compound 2539 | A-403 | 35 | B-401 | 65 |
| Exemplary compound 2540 | A-403 | 20 | B-401 | 80 |
| Exemplary compound 2541 | A-403 | 49 | B-402 | 51 |
| Exemplary compound 2542 | A-403 | 80 | B-402 | 20 |
| Exemplary compound 2543 | A-403 | 35 | B-402 | 65 |
| Exemplary compound 2544 | A-403 | 20 | B-402 | 80 |
| Exemplary compound 2545 | A-403 | 49 | B-403 | 51 |
| Exemplary compound 2546 | A-403 | 80 | B-403 | 20 |
| Exemplary compound 2547 | A-403 | 35 | B-403 | 65 |
| Exemplary compound 2548 | A-403 | 20 | B-403 | 80 |
| Exemplary compound 2549 | A-403 | 49 | B-404 | 51 |
| Exemplary compound 2550 | A-403 | 80 | B-404 | 20 |
| Exemplary compound 2551 | A-403 | 35 | B-404 | 65 |
| Exemplary compound 2552 | A-403 | 20 | B-404 | 80 |
| Exemplary compound 2553 | A-403 | 49 | B-405 | 51 |
| Exemplary compound 2554 | A-403 | 80 | B-405 | 20 |
| Exemplary compound 2555 | A-403 | 35 | B-405 | 65 |
| Exemplary compound 2556 | A-403 | 20 | B-405 | 80 |
| Exemplary compound 2557 | A-404 | 49 | B-101 | 51 |
| Exemplary compound 2558 | A-404 | 80 | B-101 | 20 |
| Exemplary compound 2559 | A-404 | 35 | B-101 | 65 |
| Exemplary compound 2560 | A-404 | 20 | B-101 | 80 |

TABLE 11

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2561 | A-404 | 49 | B-102 | 51 |
| Exemplary compound 2562 | A-404 | 80 | B-102 | 20 |
| Exemplary compound 2563 | A-404 | 35 | B-102 | 65 |
| Exemplary compound 2564 | A-404 | 20 | B-102 | 80 |
| Exemplary compound 2565 | A-404 | 49 | B-103 | 51 |
| Exemplary compound 2566 | A-404 | 80 | B-103 | 20 |
| Exemplary compound 2567 | A-404 | 35 | B-103 | 65 |
| Exemplary compound 2568 | A-404 | 20 | B-103 | 80 |
| Exemplary compound 2569 | A-404 | 49 | B-104 | 51 |
| Exemplary compound 2570 | A-404 | 80 | B-104 | 20 |
| Exemplary compound 2571 | A-404 | 35 | B-104 | 65 |
| Exemplary compound 2572 | A-404 | 20 | B-104 | 80 |
| Exemplary compound 2573 | A-404 | 49 | B-105 | 51 |
| Exemplary compound 2574 | A-404 | 80 | B-105 | 20 |
| Exemplary compound 2575 | A-404 | 35 | B-105 | 65 |
| Exemplary compound 2576 | A-404 | 20 | B-105 | 80 |
| Exemplary compound 2577 | A-404 | 49 | B-201 | 51 |
| Exemplary compound 2578 | A-404 | 80 | B-201 | 20 |
| Exemplary compound 2579 | A-404 | 35 | B-201 | 65 |
| Exemplary compound 2580 | A-404 | 20 | B-201 | 80 |
| Exemplary compound 2581 | A-404 | 49 | B-202 | 51 |
| Exemplary compound 2582 | A-404 | 80 | B-202 | 20 |
| Exemplary compound 2583 | A-404 | 35 | B-202 | 65 |
| Exemplary compound 2584 | A-404 | 20 | B-202 | 80 |
| Exemplary compound 2585 | A-404 | 49 | B-203 | 51 |
| Exemplary compound 2586 | A-404 | 80 | B-203 | 20 |
| Exemplary compound 2587 | A-404 | 35 | B-203 | 65 |
| Exemplary compound 2588 | A-404 | 20 | B-203 | 80 |
| Exemplary compound 2589 | A-404 | 49 | B-204 | 51 |
| Exemplary compound 2590 | A-404 | 80 | B-204 | 20 |

TABLE 11-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2591 | A-404 | 35 | B-204 | 65 |
| Exemplary compound 2592 | A-404 | 20 | B-204 | 80 |
| Exemplary compound 2593 | A-404 | 49 | B-205 | 51 |
| Exemplary compound 2594 | A-404 | 80 | B-205 | 20 |
| Exemplary compound 2595 | A-404 | 35 | B-205 | 65 |
| Exemplary compound 2596 | A-404 | 20 | B-205 | 80 |
| Exemplary compound 2597 | A-404 | 49 | B-301 | 51 |
| Exemplary compound 2598 | A-404 | 80 | B-301 | 20 |
| Exemplary compound 2599 | A-404 | 35 | B-301 | 65 |
| Exemplary compound 2600 | A-404 | 20 | B-301 | 80 |
| Exemplary compound 2601 | A-404 | 49 | B-302 | 51 |
| Exemplary compound 2602 | A-404 | 80 | B-302 | 20 |
| Exemplary compound 2603 | A-404 | 35 | B-302 | 65 |
| Exemplary compound 2604 | A-404 | 20 | B-302 | 80 |
| Exemplary compound 2605 | A-404 | 49 | B-303 | 51 |
| Exemplary compound 2606 | A-404 | 80 | B-303 | 20 |
| Exemplary compound 2607 | A-404 | 35 | B-303 | 65 |
| Exemplary compound 2608 | A-404 | 20 | B-303 | 80 |
| Exemplary compound 2609 | A-404 | 49 | B-304 | 51 |
| Exemplary compound 2610 | A-404 | 80 | B-304 | 20 |
| Exemplary compound 2611 | A-404 | 35 | B-304 | 65 |
| Exemplary compound 2612 | A-404 | 20 | B-304 | 80 |
| Exemplary compound 2613 | A-404 | 49 | B-305 | 51 |
| Exemplary compound 2614 | A-404 | 80 | B-305 | 20 |
| Exemplary compound 2615 | A-404 | 35 | B-305 | 65 |
| Exemplary compound 2616 | A-404 | 20 | B-305 | 80 |
| Exemplary compound 2617 | A-404 | 49 | B-306 | 51 |
| Exemplary compound 2618 | A-404 | 80 | B-306 | 20 |
| Exemplary compound 2619 | A-404 | 35 | B-306 | 65 |
| Exemplary compound 2620 | A-404 | 20 | B-306 | 80 |
| Exemplary compound 2621 | A-404 | 49 | B-307 | 51 |
| Exemplary compound 2622 | A-404 | 80 | B-307 | 20 |
| Exemplary compound 2623 | A-404 | 35 | B-307 | 65 |
| Exemplary compound 2624 | A-404 | 20 | B-307 | 80 |
| Exemplary compound 2625 | A-404 | 49 | B-308 | 51 |
| Exemplary compound 2626 | A-404 | 80 | B-308 | 20 |
| Exemplary compound 2627 | A-404 | 35 | B-308 | 65 |
| Exemplary compound 2628 | A-404 | 20 | B-308 | 80 |
| Exemplary compound 2629 | A-404 | 49 | B-401 | 51 |
| Exemplary compound 2630 | A-404 | 80 | B-401 | 20 |
| Exemplary compound 2631 | A-404 | 35 | B-401 | 65 |
| Exemplary compound 2632 | A-404 | 20 | B-401 | 80 |
| Exemplary compound 2633 | A-404 | 49 | B-402 | 51 |
| Exemplary compound 2634 | A-404 | 80 | B-402 | 20 |
| Exemplary compound 2635 | A-404 | 35 | B-402 | 65 |
| Exemplary compound 2636 | A-404 | 20 | B-402 | 80 |
| Exemplary compound 2637 | A-404 | 49 | B-403 | 51 |
| Exemplary compound 2638 | A-404 | 80 | B-403 | 20 |
| Exemplary compound 2639 | A-404 | 35 | B-403 | 65 |
| Exemplary compound 2640 | A-404 | 20 | B-403 | 80 |
| Exemplary compound 2641 | A-404 | 49 | B-404 | 51 |
| Exemplary compound 2642 | A-404 | 80 | B-404 | 20 |
| Exemplary compound 2643 | A-404 | 35 | B-404 | 65 |
| Exemplary compound 2644 | A-404 | 20 | B-404 | 80 |
| Exemplary compound 2645 | A-404 | 49 | B-405 | 51 |
| Exemplary compound 2646 | A-404 | 80 | B-405 | 20 |
| Exemplary compound 2647 | A-404 | 35 | B-405 | 65 |
| Exemplary compound 2648 | A-404 | 20 | B-405 | 80 |
| Exemplary compound 2649 | A-405 | 49 | B-101 | 51 |
| Exemplary compound 2650 | A-405 | 80 | B-101 | 20 |
| Exemplary compound 2651 | A-405 | 35 | B-101 | 65 |
| Exemplary compound 2652 | A-405 | 20 | B-101 | 80 |
| Exemplary compound 2653 | A-405 | 49 | B-102 | 51 |
| Exemplary compound 2654 | A-405 | 80 | B-102 | 20 |
| Exemplary compound 2655 | A-405 | 35 | B-102 | 65 |
| Exemplary compound 2656 | A-405 | 20 | B-102 | 80 |
| Exemplary compound 2657 | A-405 | 49 | B-103 | 51 |
| Exemplary compound 2658 | A-405 | 80 | B-103 | 20 |
| Exemplary compound 2659 | A-405 | 35 | B-103 | 65 |
| Exemplary compound 2660 | A-405 | 20 | B-103 | 80 |
| Exemplary compound 2661 | A-405 | 49 | B-104 | 51 |
| Exemplary compound 2662 | A-405 | 80 | B-104 | 20 |

TABLE 11-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2663 | A-405 | 35 | B-104 | 65 |
| Exemplary compound 2664 | A-405 | 20 | B-104 | 80 |
| Exemplary compound 2665 | A-405 | 49 | B-105 | 51 |
| Exemplary compound 2666 | A-405 | 80 | B-105 | 20 |
| Exemplary compound 2667 | A-405 | 35 | B-105 | 65 |
| Exemplary compound 2668 | A-405 | 20 | B-105 | 80 |
| Exemplary compound 2669 | A-405 | 49 | B-201 | 51 |
| Exemplary compound 2670 | A-405 | 80 | B-201 | 20 |
| Exemplary compound 2671 | A-405 | 35 | B-201 | 65 |
| Exemplary compound 2672 | A-405 | 20 | B-201 | 80 |
| Exemplary compound 2673 | A-405 | 49 | B-202 | 51 |
| Exemplary compound 2674 | A-405 | 80 | B-202 | 20 |
| Exemplary compound 2675 | A-405 | 35 | B-202 | 65 |
| Exemplary compound 2676 | A-405 | 20 | B-202 | 80 |
| Exemplary compound 2677 | A-405 | 49 | B-203 | 51 |
| Exemplary compound 2678 | A-405 | 80 | B-203 | 20 |
| Exemplary compound 2679 | A-405 | 35 | B-203 | 65 |
| Exemplary compound 2680 | A-405 | 20 | B-203 | 80 |

TABLE 12

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2681 | A-405 | 49 | B-204 | 51 |
| Exemplary compound 2682 | A-405 | 80 | B-204 | 20 |
| Exemplary compound 2683 | A-405 | 35 | B-204 | 65 |
| Exemplary compound 2684 | A-405 | 20 | B-204 | 80 |
| Exemplary compound 2685 | A-405 | 49 | B-205 | 51 |
| Exemplary compound 2686 | A-405 | 80 | B-205 | 20 |
| Exemplary compound 2687 | A-405 | 35 | B-205 | 65 |
| Exemplary compound 2688 | A-405 | 20 | B-205 | 80 |
| Exemplary compound 2689 | A-405 | 49 | B-301 | 51 |
| Exemplary compound 2690 | A-405 | 80 | B-301 | 20 |
| Exemplary compound 2691 | A-405 | 35 | B-301 | 65 |
| Exemplary compound 2692 | A-405 | 20 | B-301 | 80 |
| Exemplary compound 2693 | A-405 | 49 | B-302 | 51 |
| Exemplary compound 2694 | A-405 | 80 | B-302 | 20 |
| Exemplary compound 2695 | A-405 | 35 | B-302 | 65 |
| Exemplary compound 2696 | A-405 | 20 | B-302 | 80 |
| Exemplary compound 2697 | A-405 | 49 | B-303 | 51 |
| Exemplary compound 2698 | A-405 | 80 | B-303 | 20 |
| Exemplary compound 2699 | A-405 | 35 | B-303 | 65 |
| Exemplary compound 2700 | A-405 | 20 | B-303 | 80 |
| Exemplary compound 2701 | A-405 | 49 | B-304 | 51 |
| Exemplary compound 2702 | A-405 | 80 | B-304 | 20 |
| Exemplary compound 2703 | A-405 | 35 | B-304 | 65 |
| Exemplary compound 2704 | A-405 | 20 | B-304 | 80 |
| Exemplary compound 2705 | A-405 | 49 | B-305 | 51 |
| Exemplary compound 2706 | A-405 | 80 | B-305 | 20 |
| Exemplary compound 2707 | A-405 | 35 | B-305 | 65 |
| Exemplary compound 2708 | A-405 | 20 | B-305 | 80 |
| Exemplary compound 2709 | A-405 | 49 | B-306 | 51 |
| Exemplary compound 2710 | A-405 | 80 | B-306 | 20 |
| Exemplary compound 2711 | A-405 | 35 | B-306 | 65 |
| Exemplary compound 2712 | A-405 | 20 | B-306 | 80 |
| Exemplary compound 2713 | A-405 | 49 | B-307 | 51 |
| Exemplary compound 2714 | A-405 | 80 | B-307 | 20 |
| Exemplary compound 2715 | A-405 | 35 | B-307 | 65 |
| Exemplary compound 2716 | A-405 | 20 | B-307 | 80 |
| Exemplary compound 2717 | A-405 | 49 | B-308 | 51 |
| Exemplary compound 2718 | A-405 | 80 | B-308 | 20 |
| Exemplary compound 2719 | A-405 | 35 | B-308 | 65 |
| Exemplary compound 2720 | A-405 | 20 | B-308 | 80 |

TABLE 12-continued

| Specific examples of polycarbonate resin | | | | |
|---|---|---|---|---|
| | Group A | | Group B | |
| Exemplary compound No. | Structure | Content ratio (mol %) | Structure | Content ratio (mol %) |
| Exemplary compound 2721 | A-405 | 49 | B-401 | 51 |
| Exemplary compound 2722 | A-405 | 80 | B-401 | 20 |
| Exemplary compound 2723 | A-405 | 35 | B-401 | 65 |
| Exemplary compound 2724 | A-405 | 20 | B-401 | 80 |
| Exemplary compound 2725 | A-405 | 49 | B-402 | 51 |
| Exemplary compound 2726 | A-405 | 80 | B-402 | 20 |
| Exemplary compound 2727 | A-405 | 35 | B-402 | 65 |
| Exemplary compound 2728 | A-405 | 20 | B-402 | 80 |
| Exemplary compound 2729 | A-405 | 49 | B-403 | 51 |
| Exemplary compound 2730 | A-405 | 80 | B-403 | 20 |
| Exemplary compound 2731 | A-405 | 35 | B-403 | 65 |
| Exemplary compound 2732 | A-405 | 20 | B-403 | 80 |
| Exemplary compound 2733 | A-405 | 49 | B-404 | 51 |
| Exemplary compound 2734 | A-405 | 80 | B-404 | 20 |
| Exemplary compound 2735 | A-405 | 35 | B-404 | 65 |
| Exemplary compound 2736 | A-405 | 20 | B-404 | 80 |
| Exemplary compound 2737 | A-405 | 49 | B-405 | 51 |
| Exemplary compound 2738 | A-405 | 80 | B-405 | 20 |
| Exemplary compound 2739 | A-405 | 35 | B-405 | 65 |
| Exemplary compound 2740 | A-405 | 20 | B-405 | 80 |

Specific examples of the polycarbonate resin having the structure represented by the formula (121) and the structure represented by the formula (104) are listed in the following Tables 13 and 14.

TABLE 13

| Specific examples of polycarbonate resin | | | | |
|---|---|---|---|---|
| | Formula (121) | | Formula (104) | |
| Exemplary compound No. | Structure | Content ratio (mol %) | Structure | Content ratio (mol %) |
| Exemplary compound 5001 | C-101 | 49 | B-101 | 51 |
| Exemplary compound 5002 | C-101 | 80 | B-101 | 20 |
| Exemplary compound 5003 | C-101 | 35 | B-101 | 65 |
| Exemplary compound 5004 | C-101 | 20 | B-101 | 80 |
| Exemplary compound 5005 | C-101 | 49 | B-102 | 51 |
| Exemplary compound 5006 | C-101 | 80 | B-102 | 20 |
| Exemplary compound 5007 | C-101 | 35 | B-102 | 65 |
| Exemplary compound 5008 | C-101 | 20 | B-102 | 80 |
| Exemplary compound 5009 | C-101 | 49 | B-103 | 51 |
| Exemplary compound 5010 | C-101 | 80 | B-103 | 20 |
| Exemplary compound 5011 | C-101 | 35 | B-103 | 65 |
| Exemplary compound 5012 | C-101 | 20 | B-103 | 80 |
| Exemplary compound 5013 | C-101 | 49 | B-104 | 51 |
| Exemplary compound 5014 | C-101 | 80 | B-104 | 20 |
| Exemplary compound 5015 | C-101 | 35 | B-104 | 65 |
| Exemplary compound 5016 | C-101 | 20 | B-104 | 80 |
| Exemplary compound 5017 | C-101 | 49 | B-105 | 51 |
| Exemplary compound 5018 | C-101 | 80 | B-105 | 20 |
| Exemplary compound 5019 | C-101 | 35 | B-105 | 65 |
| Exemplary compound 5020 | C-101 | 20 | B-105 | 80 |
| Exemplary compound 5021 | C-101 | 49 | B-201 | 51 |
| Exemplary compound 5022 | C-101 | 80 | B-201 | 20 |
| Exemplary compound 5023 | C-101 | 35 | B-201 | 65 |
| Exemplary compound 5024 | C-101 | 20 | B-201 | 80 |
| Exemplary compound 5025 | C-101 | 49 | B-202 | 51 |
| Exemplary compound 5026 | C-101 | 80 | B-202 | 20 |
| Exemplary compound 5027 | C-101 | 35 | B-202 | 65 |
| Exemplary compound 5028 | C-101 | 20 | B-202 | 80 |
| Exemplary compound 5029 | C-101 | 49 | B-203 | 51 |
| Exemplary compound 5030 | C-101 | 80 | B-203 | 20 |
| Exemplary compound 5031 | C-101 | 35 | B-203 | 65 |
| Exemplary compound 5032 | C-101 | 20 | B-203 | 80 |
| Exemplary compound 5033 | C-101 | 49 | B-204 | 51 |
| Exemplary compound 5034 | C-101 | 80 | B-204 | 20 |

TABLE 13-continued

| Specific examples of polycarbonate resin | | | | |
|---|---|---|---|---|
| | Formula (121) | | Formula (104) | |
| Exemplary compound No. | Structure | Content ratio (mol %) | Structure | Content ratio (mol %) |
| Exemplary compound 5035 | C-101 | 35 | B-204 | 65 |
| Exemplary compound 5036 | C-101 | 20 | B-204 | 80 |
| Exemplary compound 5037 | C-101 | 49 | B-205 | 51 |
| Exemplary compound 5038 | C-101 | 80 | B-205 | 20 |
| Exemplary compound 5039 | C-101 | 35 | B-205 | 65 |
| Exemplary compound 5040 | C-101 | 20 | B-205 | 80 |
| Exemplary compound 5041 | C-102 | 49 | B-101 | 51 |
| Exemplary compound 5042 | C-102 | 80 | B-101 | 20 |
| Exemplary compound 5043 | C-102 | 35 | B-101 | 65 |
| Exemplary compound 5044 | C-102 | 20 | B-101 | 80 |
| Exemplary compound 5045 | C-102 | 49 | B-102 | 51 |
| Exemplary compound 5046 | C-102 | 80 | B-102 | 20 |
| Exemplary compound 5047 | C-102 | 35 | B-102 | 65 |
| Exemplary compound 5048 | C-102 | 20 | B-102 | 80 |
| Exemplary compound 5049 | C-102 | 49 | B-103 | 51 |
| Exemplary compound 5050 | C-102 | 80 | B-103 | 20 |
| Exemplary compound 5051 | C-102 | 35 | B-103 | 65 |
| Exemplary compound 5052 | C-102 | 20 | B-103 | 80 |
| Exemplary compound 5053 | C-102 | 49 | B-104 | 51 |
| Exemplary compound 5054 | C-102 | 80 | B-104 | 20 |
| Exemplary compound 5055 | C-102 | 35 | B-104 | 65 |
| Exemplary compound 5056 | C-102 | 20 | B-104 | 80 |
| Exemplary compound 5057 | C-102 | 49 | B-105 | 51 |
| Exemplary compound 5058 | C-102 | 80 | B-105 | 20 |
| Exemplary compound 5059 | C-102 | 35 | B-105 | 65 |
| Exemplary compound 5060 | C-102 | 20 | B-105 | 80 |
| Exemplary compound 5061 | C-102 | 49 | B-201 | 51 |
| Exemplary compound 5062 | C-102 | 80 | B-201 | 20 |
| Exemplary compound 5063 | C-102 | 35 | B-201 | 65 |
| Exemplary compound 5064 | C-102 | 20 | B-201 | 80 |
| Exemplary compound 5065 | C-102 | 49 | B-202 | 51 |
| Exemplary compound 5066 | C-102 | 80 | B-202 | 20 |
| Exemplary compound 5067 | C-102 | 35 | B-202 | 65 |
| Exemplary compound 5068 | C-102 | 20 | B-202 | 80 |
| Exemplary compound 5069 | C-102 | 49 | B-203 | 51 |
| Exemplary compound 5070 | C-102 | 80 | B-203 | 20 |
| Exemplary compound 5071 | C-102 | 35 | B-203 | 65 |
| Exemplary compound 5072 | C-102 | 20 | B-203 | 80 |
| Exemplary compound 5073 | C-102 | 49 | B-204 | 51 |
| Exemplary compound 5074 | C-102 | 80 | B-204 | 20 |
| Exemplary compound 5075 | C-102 | 35 | B-204 | 65 |
| Exemplary compound 5076 | C-102 | 20 | B-204 | 80 |
| Exemplary compound 5077 | C-102 | 49 | B-205 | 51 |
| Exemplary compound 5078 | C-102 | 80 | B-205 | 20 |
| Exemplary compound 5079 | C-102 | 35 | B-205 | 65 |
| Exemplary compound 5080 | C-102 | 20 | B-205 | 80 |
| Exemplary compound 5081 | C-103 | 49 | B-101 | 51 |
| Exemplary compound 5082 | C-103 | 80 | B-101 | 20 |
| Exemplary compound 5083 | C-103 | 35 | B-101 | 65 |
| Exemplary compound 5084 | C-103 | 20 | B-101 | 80 |
| Exemplary compound 5085 | C-103 | 49 | B-102 | 51 |
| Exemplary compound 5086 | C-103 | 80 | B-102 | 20 |
| Exemplary compound 5087 | C-103 | 35 | B-102 | 65 |
| Exemplary compound 5088 | C-103 | 20 | B-102 | 80 |
| Exemplary compound 5089 | C-103 | 49 | B-103 | 51 |
| Exemplary compound 5090 | C-103 | 80 | B-103 | 20 |
| Exemplary compound 5091 | C-103 | 35 | B-103 | 65 |
| Exemplary compound 5092 | C-103 | 20 | B-103 | 80 |
| Exemplary compound 5093 | C-103 | 49 | B-104 | 51 |
| Exemplary compound 5094 | C-103 | 80 | B-104 | 20 |
| Exemplary compound 5095 | C-103 | 35 | B-104 | 65 |
| Exemplary compound 5096 | C-103 | 20 | B-104 | 80 |
| Exemplary compound 5097 | C-103 | 49 | B-105 | 51 |
| Exemplary compound 5098 | C-103 | 80 | B-105 | 20 |
| Exemplary compound 5099 | C-103 | 35 | B-105 | 65 |
| Exemplary compound 5100 | C-103 | 20 | B-105 | 80 |

TABLE 14

| Specific examples of polycarbonate resin | | | | |
|---|---|---|---|---|
| | Formula (121) | | Formula (104) | |
| Exemplary compound No. | Structure | Content ratio (mol %) | Structure | Content ratio (mol %) |
| Exemplary compound 5101 | C-103 | 49 | B-201 | 51 |
| Exemplary compound 5102 | C-103 | 80 | B-201 | 20 |
| Exemplary compound 5103 | C-103 | 35 | B-201 | 65 |
| Exemplary compound 5104 | C-103 | 20 | B-201 | 80 |
| Exemplary compound 5105 | C-103 | 49 | B-202 | 51 |
| Exemplary compound 5106 | C-103 | 80 | B-202 | 20 |
| Exemplary compound 5107 | C-103 | 35 | B-202 | 65 |
| Exemplary compound 5108 | C-103 | 20 | B-202 | 80 |
| Exemplary compound 5109 | C-103 | 49 | B-203 | 51 |
| Exemplary compound 5110 | C-103 | 80 | B-203 | 20 |
| Exemplary compound 5111 | C-103 | 35 | B-203 | 65 |
| Exemplary compound 5112 | C-103 | 20 | B-203 | 80 |
| Exemplary compound 5113 | C-103 | 49 | B-204 | 51 |
| Exemplary compound 5114 | C-103 | 80 | B-204 | 20 |
| Exemplary compound 5115 | C-103 | 35 | B-204 | 65 |
| Exemplary compound 5116 | C-103 | 20 | B-204 | 80 |
| Exemplary compound 5117 | C-103 | 49 | B-205 | 51 |
| Exemplary compound 5118 | C-103 | 80 | B-205 | 20 |
| Exemplary compound 5119 | C-103 | 35 | B-205 | 65 |
| Exemplary compound 5120 | C-103 | 20 | B-205 | 80 |
| Exemplary compound 5121 | C-104 | 49 | B-101 | 51 |
| Exemplary compound 5122 | C-104 | 80 | B-101 | 20 |
| Exemplary compound 5123 | C-104 | 35 | B-101 | 65 |
| Exemplary compound 5124 | C-104 | 20 | B-101 | 80 |
| Exemplary compound 5125 | C-104 | 49 | B-102 | 51 |
| Exemplary compound 5126 | C-104 | 80 | B-102 | 20 |
| Exemplary compound 5127 | C-104 | 35 | B-102 | 65 |
| Exemplary compound 5128 | C-104 | 20 | B-102 | 80 |
| Exemplary compound 5129 | C-104 | 49 | B-103 | 51 |
| Exemplary compound 5130 | C-104 | 80 | B-103 | 20 |
| Exemplary compound 5131 | C-104 | 35 | B-103 | 65 |
| Exemplary compound 5132 | C-104 | 20 | B-103 | 80 |
| Exemplary compound 5133 | C-104 | 49 | B-104 | 51 |
| Exemplary compound 5134 | C-104 | 80 | B-104 | 20 |
| Exemplary compound 5135 | C-104 | 35 | B-104 | 65 |
| Exemplary compound 5136 | C-104 | 20 | B-104 | 80 |
| Exemplary compound 5137 | C-104 | 49 | B-105 | 51 |
| Exemplary compound 5138 | C-104 | 80 | B-105 | 20 |
| Exemplary compound 5139 | C-104 | 35 | B-105 | 65 |
| Exemplary compound 5140 | C-104 | 20 | B-105 | 80 |
| Exemplary compound 5141 | C-104 | 49 | B-201 | 51 |
| Exemplary compound 5142 | C-104 | 80 | B-201 | 20 |
| Exemplary compound 5143 | C-104 | 35 | B-201 | 65 |
| Exemplary compound 5144 | C-104 | 20 | B-201 | 80 |
| Exemplary compound 5145 | C-104 | 49 | B-202 | 51 |
| Exemplary compound 5146 | C-104 | 80 | B-202 | 20 |
| Exemplary compound 5147 | C-104 | 35 | B-202 | 65 |
| Exemplary compound 5148 | C-104 | 20 | B-202 | 80 |
| Exemplary compound 5149 | C-104 | 49 | B-203 | 51 |
| Exemplary compound 5150 | C-104 | 80 | B-203 | 20 |
| Exemplary compound 5151 | C-104 | 35 | B-203 | 65 |
| Exemplary compound 5152 | C-104 | 20 | B-203 | 80 |
| Exemplary compound 5153 | C-104 | 49 | B-204 | 51 |
| Exemplary compound 5154 | C-104 | 80 | B-204 | 20 |
| Exemplary compound 5155 | C-104 | 35 | B-204 | 65 |
| Exemplary compound 5156 | C-104 | 20 | B-204 | 80 |
| Exemplary compound 5157 | C-104 | 49 | B-205 | 51 |
| Exemplary compound 5158 | C-104 | 80 | B-205 | 20 |
| Exemplary compound 5159 | C-104 | 35 | B-205 | 65 |
| Exemplary compound 5160 | C-104 | 20 | B-205 | 80 |
| Exemplary compound 5161 | C-105 | 49 | B-101 | 51 |
| Exemplary compound 5162 | C-105 | 80 | B-101 | 20 |
| Exemplary compound 5163 | C-105 | 35 | B-101 | 65 |
| Exemplary compound 5164 | C-105 | 20 | B-101 | 80 |
| Exemplary compound 5165 | C-105 | 49 | B-102 | 51 |
| Exemplary compound 5166 | C-105 | 80 | B-102 | 20 |
| Exemplary compound 5167 | C-105 | 35 | B-102 | 65 |
| Exemplary compound 5168 | C-105 | 20 | B-102 | 80 |
| Exemplary compound 5169 | C-105 | 49 | B-103 | 51 |
| Exemplary compound 5170 | C-105 | 80 | B-103 | 20 |
| Exemplary compound 5171 | C-105 | 35 | B-103 | 65 |
| Exemplary compound 5172 | C-105 | 20 | B-103 | 80 |

TABLE 14-continued

| Specific examples of polycarbonate resin | | | | |
|---|---|---|---|---|
| | Formula (121) | | Formula (104) | |
| Exemplary compound No. | Structure | Content ratio (mol %) | Structure | Content ratio (mol %) |
| Exemplary compound 5173 | C-105 | 49 | B-104 | 51 |
| Exemplary compound 5174 | C-105 | 80 | B-104 | 20 |
| Exemplary compound 5175 | C-105 | 35 | B-104 | 65 |
| Exemplary compound 5176 | C-105 | 20 | B-104 | 80 |
| Exemplary compound 5177 | C-105 | 49 | B-105 | 51 |
| Exemplary compound 5178 | C-105 | 80 | B-105 | 20 |
| Exemplary compound 5179 | C-105 | 35 | B-105 | 65 |
| Exemplary compound 5180 | C-105 | 20 | B-105 | 80 |
| Exemplary compound 5181 | C-105 | 49 | B-201 | 51 |
| Exemplary compound 5182 | C-105 | 80 | B-201 | 20 |
| Exemplary compound 5183 | C-105 | 35 | B-201 | 65 |
| Exemplary compound 5184 | C-105 | 20 | B-201 | 80 |
| Exemplary compound 5185 | C-105 | 49 | B-202 | 51 |
| Exemplary compound 5186 | C-105 | 80 | B-202 | 20 |
| Exemplary compound 5187 | C-105 | 35 | B-202 | 65 |
| Exemplary compound 5188 | C-105 | 20 | B-202 | 80 |
| Exemplary compound 5189 | C-105 | 49 | B-203 | 51 |
| Exemplary compound 5190 | C-105 | 80 | B-203 | 20 |
| Exemplary compound 5191 | C-105 | 35 | B-203 | 65 |
| Exemplary compound 5192 | C-105 | 20 | B-203 | 80 |
| Exemplary compound 5193 | C-105 | 49 | B-204 | 51 |
| Exemplary compound 5194 | C-105 | 80 | B-204 | 20 |
| Exemplary compound 5195 | C-105 | 35 | B-204 | 65 |
| Exemplary compound 5196 | C-105 | 20 | B-204 | 80 |
| Exemplary compound 5197 | C-105 | 49 | B-205 | 51 |
| Exemplary compound 5198 | C-105 | 80 | B-205 | 20 |
| Exemplary compound 5199 | C-105 | 35 | B-205 | 65 |
| Exemplary compound 5200 | C-105 | 20 | B-205 | 80 |

<Method for Synthesizing Polycarbonate Resin>

As an example, a method for synthesizing the exemplary compound 1001 is illustrated below. The other polycarbonate resins can be synthesized through appropriately changing the type and quantity to be added for a raw material of the structure of the group A and a raw material of the structure of the group B in a method for synthesizing the exemplary compound 1001 below. The viscosity-average molecular weight of a resin can be adjusted through appropriately changing the quantity of a molecular weight modifier to be added.

(Method for Synthesizing Exemplary Compound 1001)

In 1100 mL of 5% by mass aqueous solution of sodium hydroxide, 53.0 g (0.196 mol) of 2,2-bis(4-hydroxyphenyl)-4-methylpentane (manufactured by Tokyo Chemical Industry Co., Ltd., product code: D3267) as a raw material of the structure of the group A, 41.2 g (0.204 mol) of bis(4-hydroxyphenyl) ether (manufactured by Tokyo Chemical Industry Co., Ltd., product code: D2121) as a raw material of the structure of the group B, and 0.1 g of hydrosulfite were dissolved together. Thereto, 500 mL of methylene chloride was added with stirring, and 60 g of phosgene was then blown therein over 60 minutes while the temperature was kept at 15° C.

After the completion of blowing of phosgene, 1.3 g of p-t-butylphenol (manufactured by Tokyo Chemical Industry Co., Ltd., product code: B0383) was added as a molecular weight modifier, and the reaction solution was stirred to emulsify. After the emulsification, 0.4 mL of triethylamine was added, and the reaction solution was stirred at 23° C. for 1 hour to polymerize.

After the completion of polymerization, the reaction solution was separated into an aqueous phase and an organic phase, and the organic phase was neutralized with phosphoric acid, and washing was repeated until the electroconductivity of the washing solution (aqueous phase) reached 10 μS/cm or lower. The polymer solution obtained was dropped in warm water kept at 45° C., and the solvent was removed through evaporation to afford a precipitate of a white powder. The precipitate obtained was filtered out, and dried at 110° C. for 24 hours to afford a polycarbonate resin of the exemplary compound 1001 derived from copolymerization of a structure of the group A, A-101, and the structure of the group B, B-101.

The infrared absorption spectrum of the polycarbonate resin obtained was analyzed, and absorptions derived from a carbonyl group and an ether bond were found around 1770 $cm^{-1}$ and around 1240 $cm^{-1}$, respectively, and thus the resin was confirmed to be a polycarbonate resin.

[Electrophotographic Photosensitive Member]

The electrophotographic photosensitive member according to the present invention includes a support, a charge generation layer, a charge transport layer, and a protective layer, in the order presented. Between the support and the charge transport layer, an additional layer (electroconductive layer, undercoat layer) may be provided. Now, the layers will be described.

Examples of methods for producing the electrophotographic photosensitive member include a method in which coating solutions for the layers, which will be described later, are prepared, and applied and dried in a desired order of layers. Examples of the method for applying a coating solution include a dip application method (dip coating method), a spray coating method, a curtain coating method, and a spin coating method. Among these methods, a dip application method can be used from the viewpoint of efficiency and productivity.

<Support>

In the present invention, the support can be an electroconductive support with electroconductivity. Examples of electroconductive supports include supports formed of metal such as aluminum, iron, nickel, copper and gold or alloy; and supports including a thin film of metal such as aluminum, chromium, silver and gold, a thin film of an electroconductive material such as indium oxide, tin oxide, and zinc oxide, or a thin film of an electroconductive ink with silver nanowires, on an insulating support such as polyester resin, polycarbonate resin, polyimide resin, and glass.

The surface of the support may be subjected to electrochemical treatment such as anodic oxidation, wet honing, blasting, cutting or the like, to improve the electric characteristics or reduce interference fringes.

Examples of the shape of the support include a cylinder and a film.

<Electroconductive Layer>

In the present invention, an electroconductive layer may be provided on the support. The electroconductive layer provided can cover unevenness or defects of the support and prevent the occurrence of interference fringes. The average thickness of the electroconductive layer is preferably 5 μm or larger and 40 μm or smaller, and more preferably 10 μm or larger and 30 μm or smaller.

The electroconductive layer can contain an electroconductive particle and a binder resin. Examples of the electroconductive particle include carbon black, metal particles, and metal oxide particles.

Examples of the metal oxide particle include particles of zinc oxide, white lead, aluminum oxide, indium oxide, silicon oxide, zirconium oxide, tin oxide, titanium oxide, magnesium oxide, antimony oxide, bismuth oxide, indium oxide with tin doped therein, and tin oxide with antimony or tantalum doped therein. Two or more of these particles may be used in combination. Among these particles, particles of zinc oxide, tin oxide, and titanium oxide are preferred. The particle of titanium oxide absorbs very little visible light and near-infrared light and the color is white, and thus the particle of titanium oxide is particularly preferred from the viewpoint of achievement of high sensitivity. Examples of the crystal form of titanium oxide include rutile type, anatase type, brookite type, and amorphous type, and any of these crystal forms may be used. In addition, a particle of titanium oxide with needle crystals or granular crystals may be used. The particle is more preferably a particle of rutile-type crystals of titanium oxide. The average primary particle diameter based on the number of metal oxide particles is preferably 0.05 to 1 μm, and more preferably 0.1 to 0.5 μm.

Examples of the binder resin include phenol resin, polyurethane resin, polyamide resin, polyimide resin, polyamideimide resin, polyvinyl acetal resin, epoxy resin, acrylic resin, melamine resin, and polyester resin. Two or more of these binder resins may be used in combination. Among these binder resins, curable resins are preferred from the viewpoint of resistance to a solvent in a coating solution for formation of another layer, close adhesion to an electroconductive support, and dispersibility/dispersion stability of a metal oxide particle. Thermosetting resins are more preferred. Examples of thermosetting resins include thermosetting phenol resin and thermosetting polyurethane resin.

<Undercoat Layer>

In the present invention, an undercoat layer may be provided on the support or the electroconductive layer. The undercoat layer provided enhances the barrier function and bonding function. The average film thickness of the undercoat layer can be 0.3 μm or larger and 5.0 μm or smaller.

The undercoat layer can contain a charge transporting material or metal oxide particle and a binder resin. This configuration allows electrons, among charges generated in the charge generation layer, to be transported to the support, and thus the frequency of deactivation or trapping of charge in the charge generation layer can be prevented from increasing, even in the situation that the charge transporting ability of the charge transport layer is enhanced. Accordingly, the initial electric characteristics and the electric characteristics in repeated use are enhanced.

Examples of the charge transporting material include quinone compounds, imide compounds, benzimidazole compounds, cyclopentadienylidene compounds, fluorenone compounds, xanthone compounds, benzophenone compounds, cyanovinyl compounds, naphthylimide compounds, and peryleneimide compounds. The charge transporting material can have a polymerizable functional group such as a hydroxy group, a thiol group, an amino group, a carboxyl group, and a methoxy group.

The metal oxide particle and binder resin are the same as those described above for the electroconductive layer.

<Charge Generation Layer>

In the present invention, a charge generation layer is provided between the support and the charge transport layer. The charge generation layer can be adjacent to the charge transport layer. The film thickness of the charge generation layer is preferably 0.05 μm or larger and 1 μm or smaller, and more preferably 0.1 μm or larger and 0.3 μm or smaller.

In the present invention, the charge generation layer can contain a charge generating material and a binder resin.

The content of the charge generating material in the charge generation layer is preferably 40% by mass or more and 85% by mass or less, and more preferably 60% by mass or more and 80% by mass or less.

Examples of the charge generating material include azo pigments such as monoazo, disazo and trisazo pigments; phthalocyanine pigments such as metal phthalocyanine and non-metal phthalocyanine pigments; indigo pigment; perylene pigment; polycyclic quinone pigments; squarylium dyes; thiapyrylium salts; triphenylmethane dyes; quinacridone pigment; azlenium salt pigments; cyanine dyes; xanthene dyes; quinonimine dyes; and styryl dyes. Among these charge generating materials, phthalocyanine pigments are preferred, and gallium phthalocyanine crystals are more preferred.

Among gallium phthalocyanine crystals, a hydroxy gallium phthalocyanine crystal, chloro gallium phthalocyanine crystal, bromo gallium phthalocyanine crystal, and iodo gallium phthalocyanine crystal, each having excellent sensitivity, are preferred. Especially, a hydroxy gallium phthalocyanine crystal and chloro gallium phthalocyanine crystal are particularly preferred. In the hydroxy gallium phthalocyanine crystal, a gallium atom has hydroxy groups as axial ligands. In the chloro gallium phthalocyanine crystal, a gallium atom has chlorine atoms as axial ligands. In the bromo gallium phthalocyanine crystal, a gallium atom has bromine atoms as axial ligands. In the iodo gallium phthalocyanine crystal, a gallium atom has iodine atoms as axial ligands. From the viewpoint of enhancement of the sensitivity, the hydroxy gallium phthalocyanine crystal, which has peaks at Bragg angles, 2θ, of 7.4°±0.3° and 28.30±0.3° in X-ray diffraction with CuKα radiation, and the chloro gallium phthalocyanine crystal, which has peaks at Bragg angles, 20±0.2°, of 7.4°, 16.6°, 25.5° and 28.3° in X-ray diffraction with CuKα radiation, are more preferred.

The gallium phthalocyanine crystal can be a gallium phthalocyanine crystal containing an amide compound shown below in the crystal.

Specific examples of the amide compound include N-methylformamide, N,N-dimethylformamide, N-propylformamide, and N-vinylformamide.

The content of the amide compound is preferably 0.1% by mass or more and 3.0% by mass or less, and more preferably 0.3% by mass or more and 1.5% by mass or less, based on gallium phthalocyanine in the gallium phthalocyanine crystal. The present inventors infer that, in the case that the content of the amide compound is 0.1% by mass or more and 3.0% by mass or less, a lower dark current is generated from the charge generation layer when electric field intensity increases, and the fogging-preventing effect of the charge transport layer of the present invention can be further enhanced. The content of the amide compound can be measured by using a $^{1}$H-NMR method.

The gallium phthalocyanine crystal containing the amide compound in the crystal can be obtained through a process in which a solvent containing gallium phthalocyanine treated by using an acid pasting method or dry milling and the amide compound is subjected to wet milling to convert to a crystal.

Wet milling is a process performed by using a milling apparatus such as a sand mill and a ball mill with a dispersing medium such as glass beads, steel beads, and alumina balls.

Examples of the binder resin include resins including polyester, acrylic resin, polycarbonate, polyvinylbutyral, polystyrene, polyvinyl acetate, polysulfone, acrylonitrile copolymer, and polyvinylbenzal. Among these binder resins, polyvinylbutyral and polyvinylbenzal can be used as a resin to disperse the gallium phthalocyanine crystal therein.

<Charge Transport Layer>

In the present invention, the charge transport layer contains a charge transporting material and a polycarbonate resin having a structure selected from the group A and a structure selected from the group B. A crystallization inhibitor for the purpose of inhibiting the precipitation of the charge transporting material, or a leveling agent for the purpose of enhancing the film formability may be further contained.

In the present invention, to form the charge transport layer, a charge transporting material and a polycarbonate resin are mixed with a solvent to prepare a coating solution for a charge transport layer, and a coating film of the coating solution for a charge transport layer is formed on the charge generation layer, and the coating film is dried.

Examples of the solvent to be used for a coating solution for a charge transport layer include ketone solvents such as acetone and methyl ethyl ketone; ester solvents such as methyl acetate and ethyl acetate; aromatic hydrocarbon solvents such as toluene, xylene and chlorobenzene; ether solvents such as 1,4-dioxane and tetrahydrofuran; and halogen atom-substituted hydrocarbon solvents such as chloroform. Two or more of these solvents may be used in combination. Among these solvents, solvents having a dipole moment of 1.0 D or lower can be used. Examples of solvents having a dipole moment of 1.0 D or lower include o-xylene (dipole moment=0.64 D) and methylal (dimethoxymethane) (dipole moment=0.91 D).

The film thickness of the charge transport layer is preferably 5 μm or larger and 40 μm or smaller, more preferably 7 μm or larger and 25 μm or smaller, and particularly preferably 15 μm or larger and 20 μm or smaller.

The content of the charge transporting material in the charge transport layer can be 80% by mass or more and 200% by mass or less based on the content of the polycarbonate resin, from the viewpoint of the potential variation-suppressing effect of the electrophotographic photosensitive member.

The molecular weight of the charge transporting material can be 300 or higher and 1,000 or lower.

Examples of the charge transporting material include triarylamine compounds, hydrazone compounds, stilbene compounds, pyrazoline compounds, oxazole compounds, thiazole compounds, and triallylmethane compounds. Two or more of these charge transporting materials may be used in combination. Among these charge transporting materials, triarylamine compounds can be used.

Here, general formulas and exemplary compounds satisfying each general formula are illustrated as specific examples of the charge transporting material.

(CTM-1)

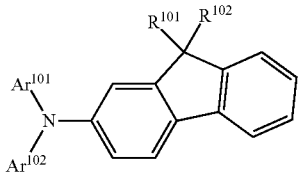

In the formula (CTM-1), $Ar^{101}$ and $Ar^{102}$ each independently represent a substituted or unsubstituted aryl group; $R^{101}$ and $R^{102}$ each independently represent a hydrogen atom, an alkyl group, or a substituted or unsubstituted aryl group; and the substituent of the substituted aryl group is an alkyl group, an alkoxy group, or a halogen atom.

Exemplary compounds of the general formula (CTM-1) are shown in the following.

(101)

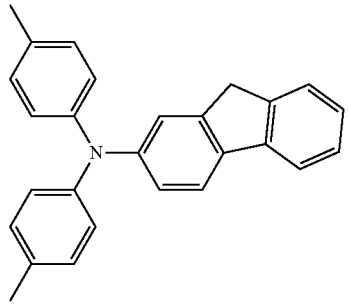

(102)

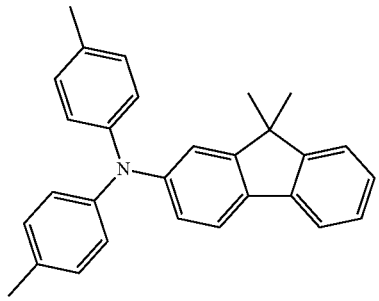

(103)

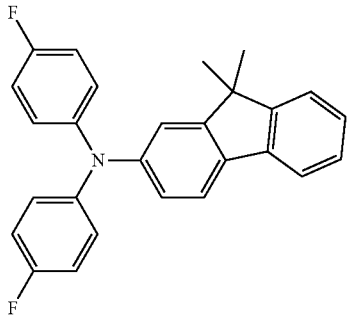

(104)

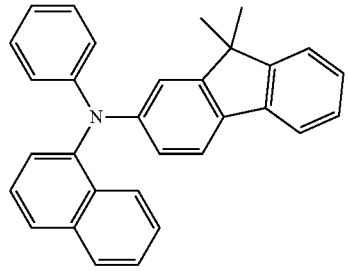

(105)

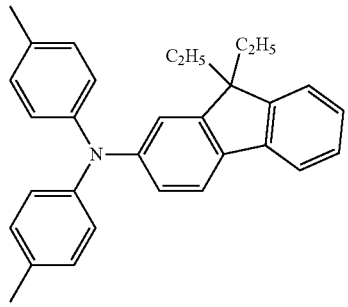

-continued (106)

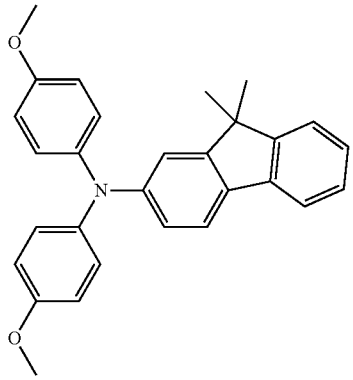

(107)

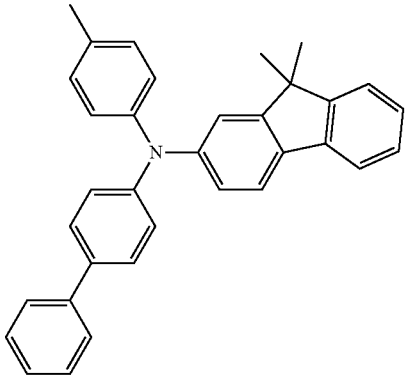

-continued (108)

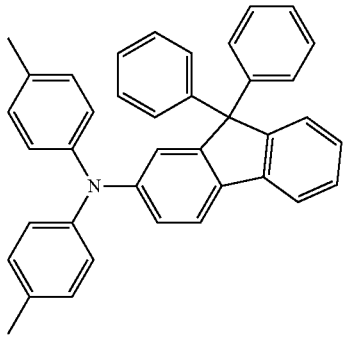

(CTM-2)

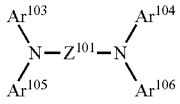

In the formula (CTM-2), $Ar^{103}$ to $Ar^{106}$ each independently represent a substituted or unsubstituted aryl group; $Z^{101}$ represents a substituted or unsubstituted arylene group, or a divalent group derived from a plurality of arylene groups bonding together via a vinylene group; two adjacent substituents on $Ar^{103}$ to $Ar^{106}$ may be bonding together to form a ring; and the substituent of the substituted aryl group and the substituted arylene group is an alkyl group, an alkoxy group, or a halogen atom.

Exemplary compounds of the general formula (CTM-2) are shown in the following.

(201)

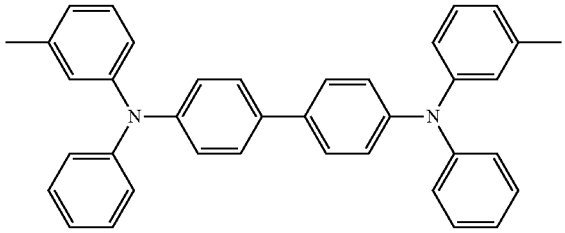

(202)

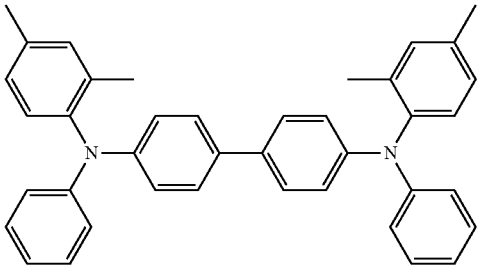

(203)

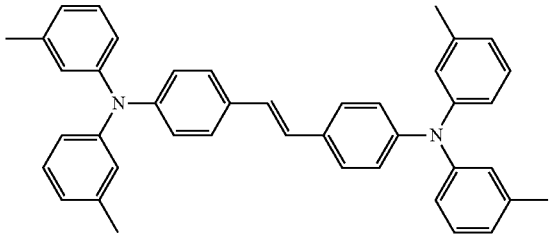

(204)

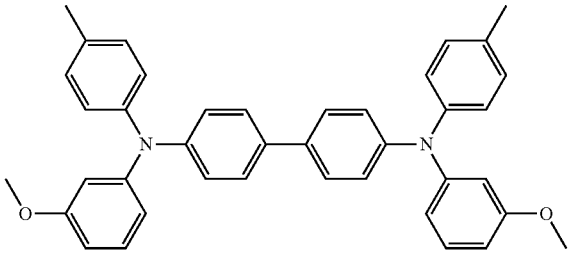

-continued
(205)
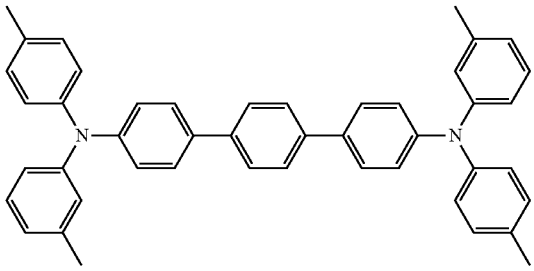
(206)
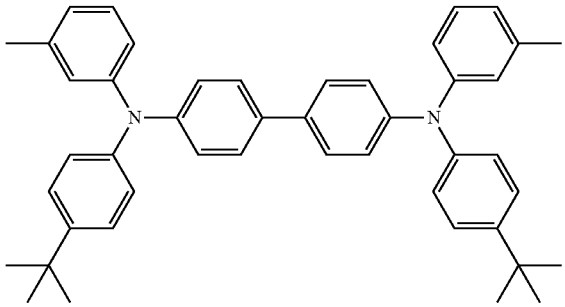
(207)
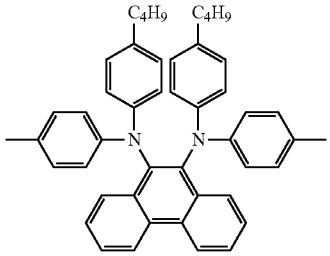
(208)
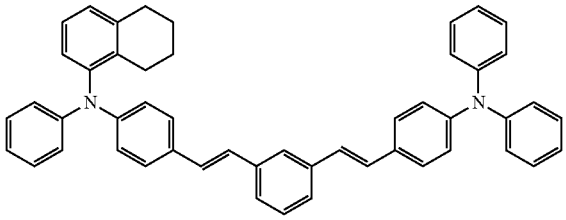
(209)
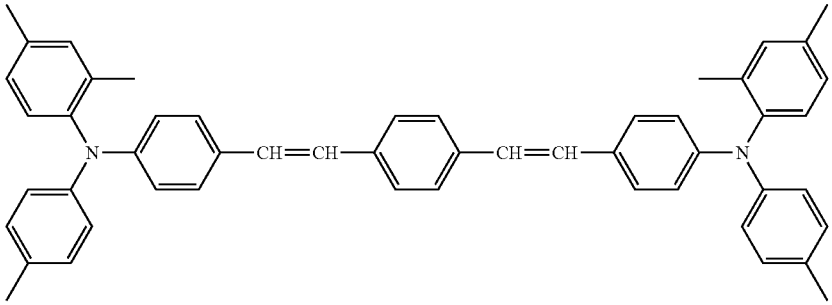
(210)
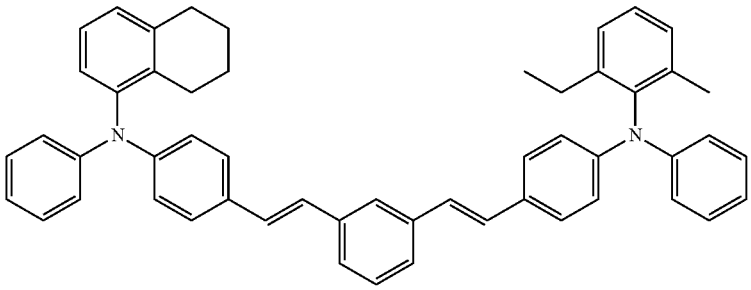
(211)
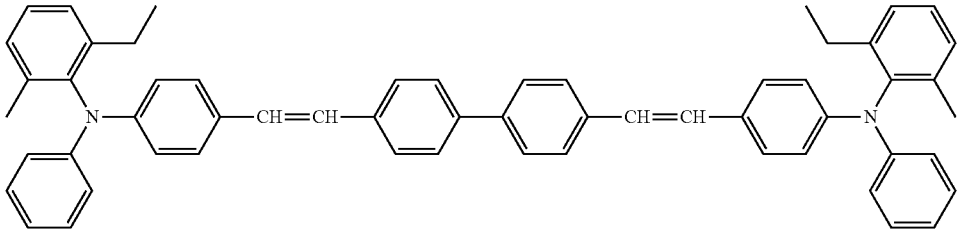

-continued (212)

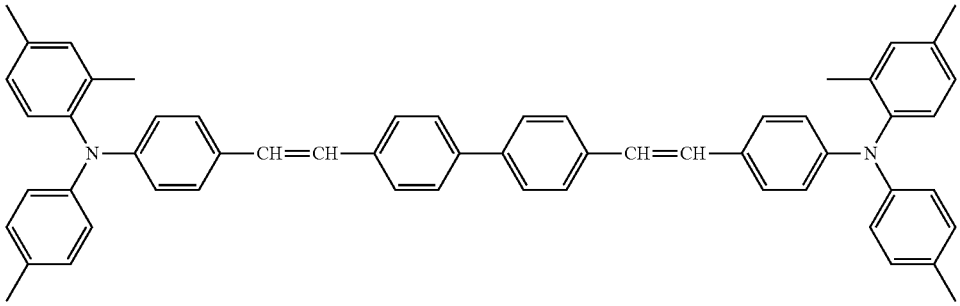

(CTM-3)

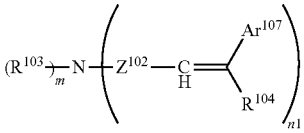

In the formula (CTM-3), $R^{103}$ represents an alkyl group, a cycloalkyl group, or a substituted or unsubstituted aryl group; $R^{104}$ represents a hydrogen atom, an alkyl group, or a substituted or unsubstituted aryl group; $Ar^{107}$ represents a substituted or unsubstituted aryl group; $Z^{102}$ represents a substituted or unsubstituted arylene group; n1 represents an integer of 1 to 3 and m represents an integer of 0 to 2, where m+n1=3; in the case that m is 2, the moieties $R^{103}$ may be the same or different; two adjacent substituents on the moieties $R^{103}$ may be bonding together to form a ring; $R^{103}$ and $Z^{102}$ may be bonding together to form a ring; $Ar^{107}$ and $R^{104}$ may be bonding together via a vinylene group to form a ring; and the substituent of the substituted aryl group and the substituted arylene group is an alkyl group, an alkoxy group, or a halogen atom.

Exemplary compounds of the general formula (CTM-3) are shown in the following.

(301)

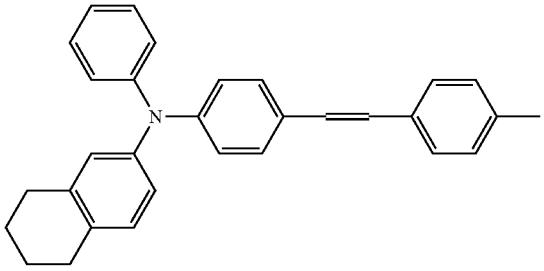

-continued (302)

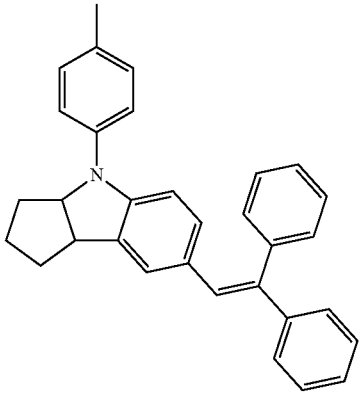

(303)

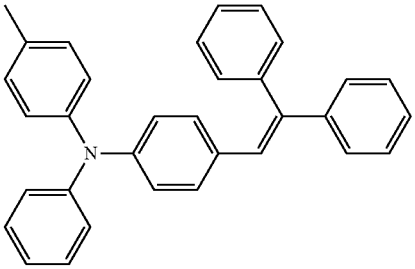

-continued
(304)
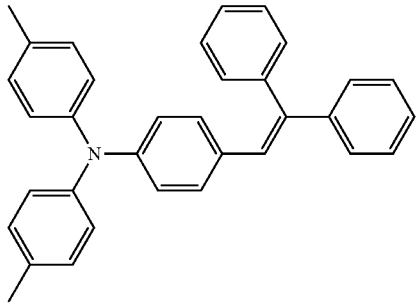
(305)
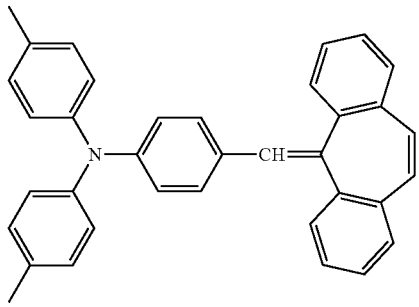
(306)
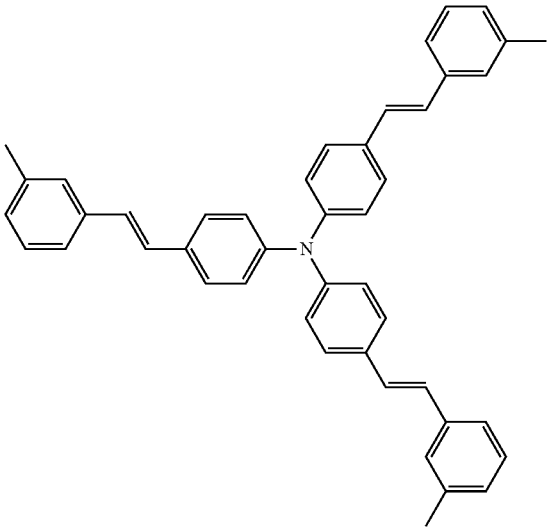
(307)
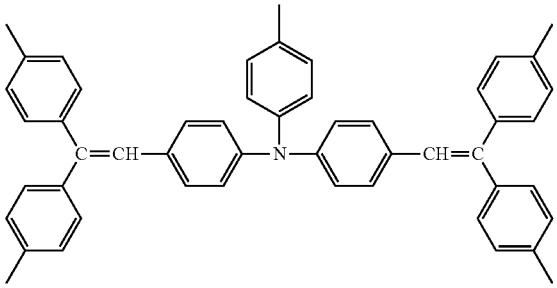
-continued
(308)
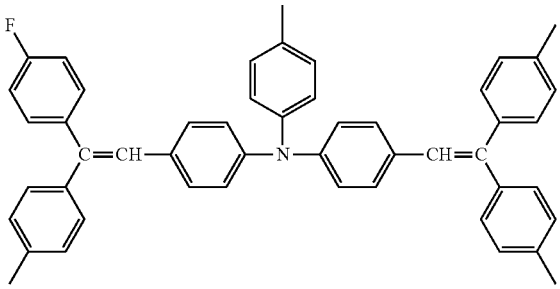
(309)
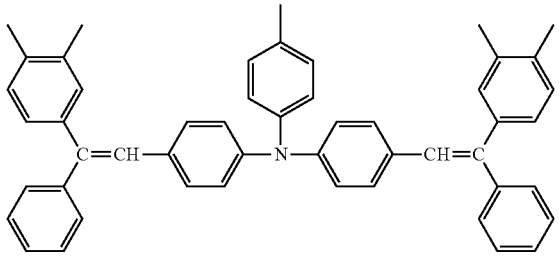
(CTM-4)
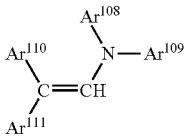
In the formula (CTM-4), $Ar^{108}$ to $Ar^{111}$ each independently represent a substituted or unsubstituted aryl group; and the substituent of the substituted aryl group is an alkyl group, an alkoxy group, a halogen atom, or a 4-phenyl-but-1,3-dienyl group.
Exemplary compounds of the general formula (CTM-4) are shown in the following.
(401)
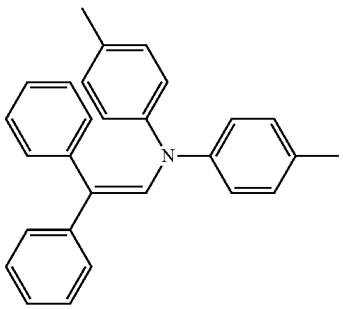

-continued (402)

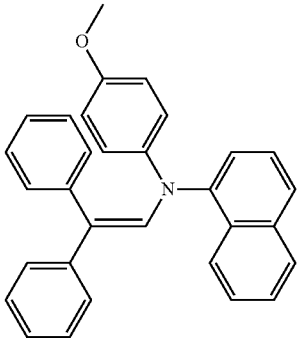

(403)

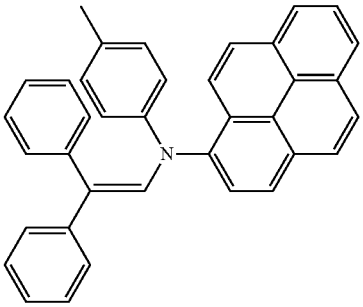

(404)

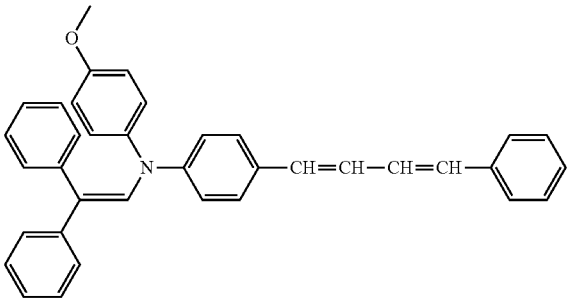

(405)

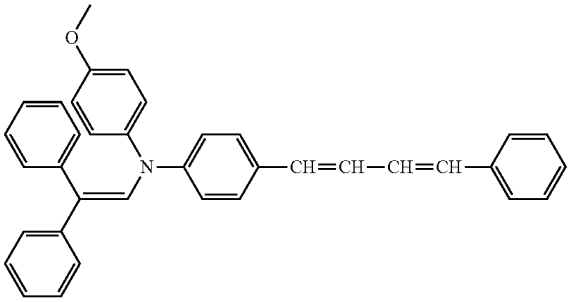

(CTM-5)

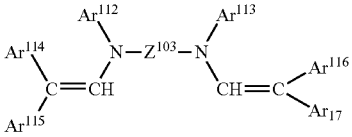

In the formula (CTM-5), $Ar^{112}$ to $Ar^{117}$ each independently represent a substituted or unsubstituted aryl group; $Z^{103}$ represents a phenylene group, a biphenylene group, or a divalent group derived from two phenylene groups bonding together via an alkylene group; and the substituent of the substituted aryl group is an alkyl group, an alkoxy group, or a halogen atom.

Exemplary compounds of the general formula (CTM-5) are shown in the following.

(501)

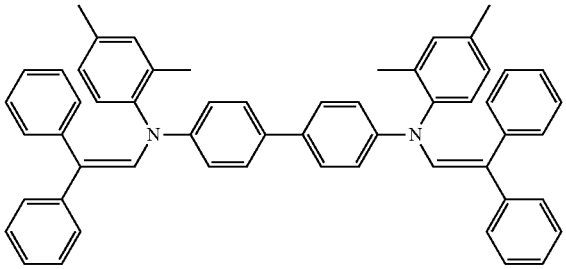

(502)

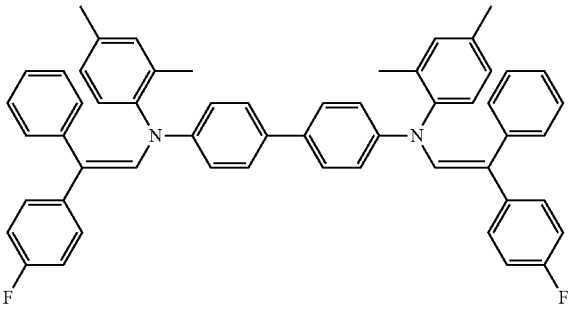

(503)

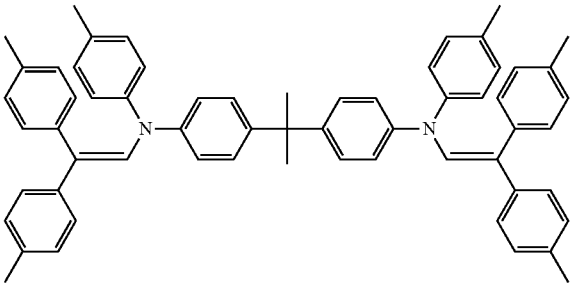

(504)

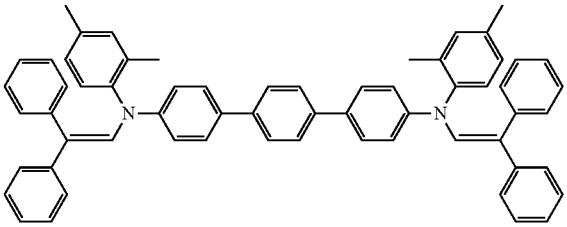

(505)

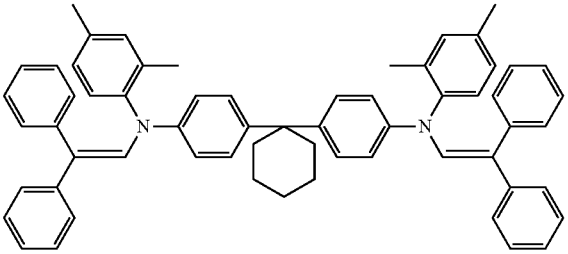

-continued (506)

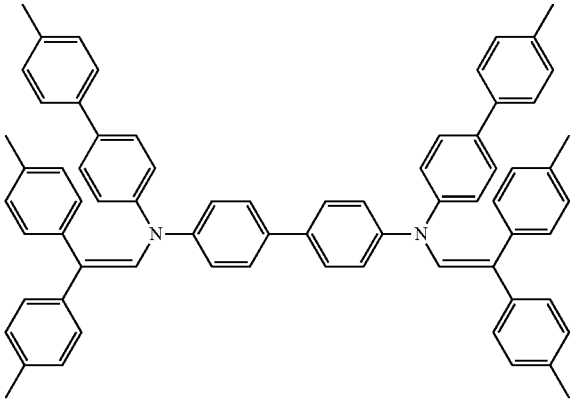

(CTM-6)

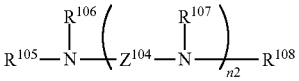

In the formula (CTM-6), at least one of $R^{105}$ to $R^{108}$ represents a monovalent group represented by a formula (6-1) below and the others each independently represent an alkyl group or a substituted or unsubstituted aryl group; $Z^{104}$ represents a substituted or unsubstituted arylene group, or a divalent group derived from a plurality of arylene groups bonding together via a vinylene group; n2 represents 0 or 1; and the substituent of the substituted aryl group and the substituted arylene group is an alkyl group, an alkoxy group, or a halogen atom.

(6-1)

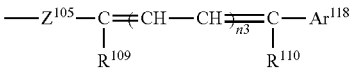

In the formula (6-1), $R^{109}$ and $R^{110}$ each independently represent a hydrogen atom, an alkyl group, or a substituted or unsubstituted aryl group; $Ar^{118}$ represents a substituted or unsubstituted aryl group; $Z^{105}$ represents a substituted or unsubstituted arylene group; n3 represents an integer of 1 to 3; the substituent of the substituted aryl group is an alkyl group, an alkoxy group, a dialkylamino group, or a diarylamino group; and the substituent of the substituted arylene group is an alkyl group, an alkoxy group, or a halogen atom.

Exemplary compounds of the general formula (CTM-6) are shown in the following.

(6-1)

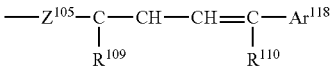

In the formula (CTM-7), $Ar^{119}$ represents a substituted or unsubstituted aryl group, or a monovalent group represented by a formula (7-1) or formula (7-2) below; $Ar^{120}$ and $Ar^{121}$ each independently represent a substituted or unsubstituted aryl group; and the substituent of the substituted aryl group is an alkyl group, an alkoxy group, or a halogen atom.

(7-1)

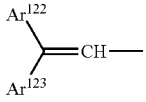

In the formula (7-1), $Ar^{122}$ and $Ar^{123}$ each independently represent a substituted or unsubstituted aryl group, or a substituted or unsubstituted aralkyl group; and the substituent of the substituted aryl group and the substituted aralkyl group is an alkyl group, an alkoxy group, or a halogen atom.

(7-2)

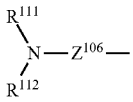

In the formula (7-2), $R^{111}$ and $R^{112}$ each independently represent a substituted or unsubstituted aryl group; $Z^{106}$ represents a substituted or unsubstituted arylene group; and the substituent of the substituted aryl group and the substituted arylene group is an alkyl group, an alkoxy group, or a halogen atom.

Exemplary compounds of the general formula (CTM-7) are shown in the following.

(701)

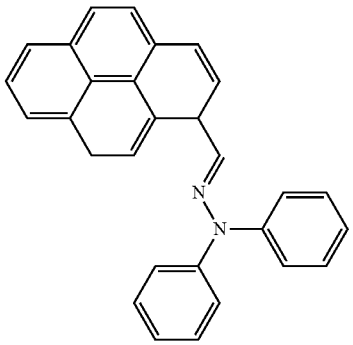

(702)

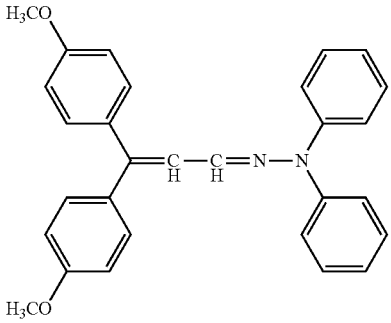

(703)

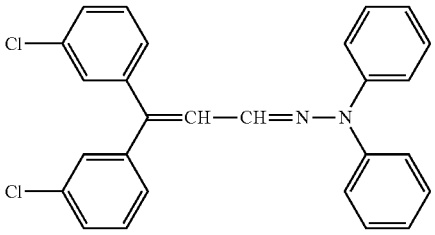

-continued (704)

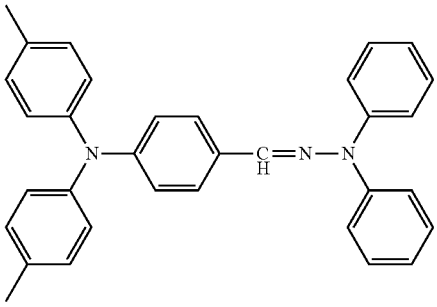

(705)

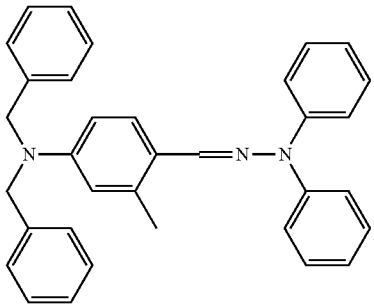

(706)

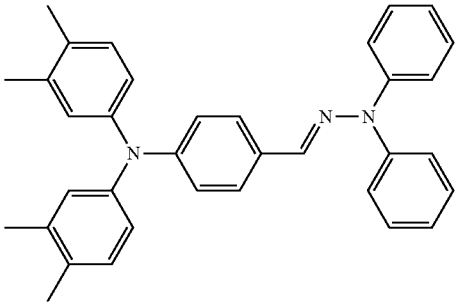

<Protective Layer>

In the present invention, a protective layer is provided on the charge transport layer. The protective layer includes a cured material of a composition containing a compound having at least a functional group selected from chain-polymerizable functional groups and sequential polymerizable functional groups, to enhance the abrasion resistance to mechanical force. A polymerization initiator for the purpose of initiation of polymerization reaction, a release agent for the purpose of enhancing the transfer efficiency for a toner, an anti-fingerprint agent for the purpose of prevention of fouling or the like, a filler for the purpose of prevention of chipping, or a lubricant for the purpose of enhancing the lubricity may be further contained.

In the present invention, for the protective layer, a composition containing a compound having at least a functional group selected from chain-polymerizable functional groups and sequential polymerizable functional groups is mixed with a solvent to prepare a coating solution for a protective layer, and a coating film of the coating solution for a protective layer is formed on the charge transport layer, and the coating film is dried and external energy such as heat, light (e.g., ultraviolet rays) and radiation (e.g., electron beams) is applied to the coating film to form a cured material.

A composition containing a compound having a chain-polymerizable functional group is cured through chain polymerization. Examples of the chain-polymerizable functional group include an acryloyloxy group, a methacryloyloxy group, an alkoxysilyl group, and an epoxy group.

A composition containing a compound having a sequential polymerizable functional group is cured through sequential polymerization. Examples of the sequential polymerizable functional group include a hydroxy group, a thiol group, an amino group, a carboxyl group, and a methoxy group.

In formation of the protective layer, a leaving group is generated on curing through sequential polymerization of a hydroxy group, a thiol group, an amino group, a carboxyl group, a methoxy group, or the like, and in contrast chain polymerization of an acryloyloxy group, a methacryloyloxy group, an alkoxysilyl group, an epoxy group, or the like is considered to be less likely to cause increase in the film density on curing, and thus more preferred.

For the external energy to cure the protective layer, use of an ultraviolet ray or radiation, which has high energy, is preferred, and use of radiation is more preferred in order to decrease the number of polymerizable functional groups unnecessary for charge transfer to reduce the barrier for charge transport in the interface to the charge transport layer.

To reduce the barrier for charge transport in the interface to the charge transport layer and enhance the charge transporting ability in the protective layer, it would be preferred that the protective layer include a cured material having a homogeneous three-dimensional crosslinked structure. To allow the protective layer to have a homogeneous three-dimensional crosslinked structure, the composition containing a compound having a polymerizable functional group can contain at least one compound having three or more polymerizable functional groups.

To enhance the potential variation-suppressing effect of the present invention, the protective layer can have charge transporting function. Examples of methods for allowing the protective layer to have charge transporting function include allowing the composition for formation of the protective layer to contain a charge transporting material having a polymerizable functional group, and allowing the composition for formation of the protective layer to contain a charge transporting material having no polymerizable functional group.

To achieve enhancement of the abrasion resistance to mechanical force, which is a traditional object of laminating a protective layer on a charge transport layer, and potential variation-suppressing effect to electric force in the present invention in combination at a higher level, it is more preferred to allow the composition for formation of the protective layer to contain a charge transporting material having a polymerizable functional group.

The film thickness of the protective layer is preferably 2 μm or larger and 10 μm or smaller, more preferably 3 μm or larger and 8 μm or smaller, and particularly preferably 4 μm or larger and 6 μm or smaller.

To enhance the potential variation-suppressing effect of the present invention, the ratio of the film thickness of the protective layer to the film thickness of the charge transport layer (film thickness of protective layer/film thickness of charge transport layer) is preferably 0.20 to 0.40, and more preferably 0.25 to 0.35.

[Process Cartridge, Electrophotographic Apparatus]

FIGURE is a diagram illustrating one example of the schematic configuration of an electrophotographic apparatus including a process cartridge including the electrophotographic photosensitive member according to the present invention.

The reference sign 1 indicates a cylindrical (drum-shaped) electrophotographic photosensitive member, which is rotary-driven around a shaft 2 at a predetermined rotational speed (process speed) in the direction of the arrow. The surface of the electrophotographic photosensitive member 1 is charged to a predetermined positive or negative potential by a charging unit 3 in the course of rotation. The surface of the electrophotographic photosensitive member 1 after being charged is then irradiated with exposure light 4 from an exposing unit (not illustrated), and an electrostatic latent image corresponding to intended image information is formed. The exposure light 4 is light output from an image-exposing unit such as units for slit exposure and beam scanning exposure, and having been subjected to intensity modulation according to a time series of electric digital image signals of intended image information.

The electrostatic latent image formed on the surface of the electrophotographic photosensitive member 1 is developed (normal development or reversal development) with a toner contained in a developing unit 5, and a toner image is formed on the surface of the electrophotographic photosensitive member 1. The toner image formed on the surface of the electrophotographic photosensitive member 1 is transferred to a transfer member 7 by a transferring unit 6. Then, a bias voltage with a polarity opposite to the charge possessed by the toner is applied from a bias power supply (not illustrated) to the transferring unit 6. In the case that the transfer member 7 is a paper, the transfer member 7 is taken out from a feeding unit (not illustrated) and fed between the electrophotographic photosensitive member 1 and the transferring unit 6 in synchronization with the rotation of the electrophotographic photosensitive member 1.

The transfer member 7 to which the toner image has been transferred from the electrophotographic photosensitive member 1 is separated from the surface of the electrophotographic photosensitive member 1, and conveyed to a fixing unit 8 and subjected to fixing for the toner image, and thus printed out of the electrophotographic apparatus as an image-bearing product (print, copy).

The surface of the electrophotographic photosensitive member 1 after transferring the toner image to the transfer member 7 is cleaned by a cleaning unit 9 through removal of a deposit such as a toner (untransferred residual toner). In recent years, a cleanerless system has been developed, and an untransferred residual toner can be removed directly, for example, in a developing device. Further, the surface of the electrophotographic photosensitive member 1 is subjected to charge removal with pre-exposure light 10 from a pre-exposing unit (not illustrated), and thereafter repeatedly used for image formation. In the case that the charging unit 3 is a contact charging unit with a charging roller or the like, the pre-exposing unit is not necessarily required.

In the present invention, a plurality of components selected from the above-described electrophotographic photosensitive member 1, charging unit 3, developing unit 5, transferring unit 6, cleaning unit 9, and so on, may be contained in a container and integrally supported to form a process cartridge. The process cartridge can be configured to be attachable to and detachable from a main body of an electrophotographic apparatus. For example, at least one selected from the group consisting of the charging unit 3, the developing unit 5, and the cleaning unit 9 is supported integrally with the electrophotographic photosensitive member 1 to produce a cartridge. Then, a guiding unit 12 such as a rail in a main body of an electrophotographic apparatus is used, and thus a process cartridge 11 being attachable to and detachable from a main body of an electrophotographic apparatus can be produced.

In the case that the electrophotographic apparatus is a copier or printer, the exposure light 4 may be reflected light or transmitted light from an original image. Alternatively, the exposure light 4 may be laser beam scanning according to signals obtained through reading and subsequent signalization of an original image by a sensor, or light emitted through the drive of an LED array or the drive of a liquid crystal shutter array.

The electrophotographic photosensitive member 1 according to the present invention can be widely applied to the application field of electrophotography including laser beam printers, CRT printers, LED printers, FAX, liquid crystal printers, and laser engraving.

EXAMPLES

Hereinafter, the present invention will be described in more detail by using Examples and Comparative Examples. The present invention is never limited to Examples below as long as the Examples do not depart from the gist of the present invention. In the description in the following Examples, "part" is in terms of mass unless otherwise specified.

Example 1

With stirring, 100 parts of a zinc oxide particle (average primary particle diameter: 50 nm, specific surface area: 19 $m^2/g$, powder resistance: $4.7\times10^6$ Ω·cm, manufactured by TAYCA CORPORATION) was mixed in 500 parts of toluene. To this mixture, 1.25 parts of N-2-(aminoethyl)-3-aminopropylmethyldimethoxysilane (trade name: KBM-602, manufactured by Shin-Etsu Chemical Co., Ltd.) as a surface-treating agent was added, and mixed with stirring for 6 hours. Thereafter, the toluene was distilled off under reduced pressure, and the residue was dried at 130° C. for 6 hours to afford a surface-treated zinc oxide particle. To a mixed solvent of 60 parts of methyl ethyl ketone and 60 parts of cyclohexanone, 75 parts of the surface-treated zinc oxide particle, 16 parts of a blocked isocyanate compound represented by a formula (A) below (trade name: Sumijule 3175, solid content: 75% by mass, manufactured by Sumika Bayer Urethane Co., Ltd.), 9 parts of a polyvinylbutyral resin (trade name: S-LEC BM-1, manufactured by SEKISUI CHEMICAL CO., LTD.), and 1 part of 2,3,4-trihydroxybenzophenone (manufactured by Tokyo Chemical Industry Co., Ltd.) were added to prepare a dispersion. This dispersion was dispersed by using a vertical sand mill with glass beads having an average particle diameter of 1.0 mm in an atmosphere of 23° C. at a rotational frequency of 1,500 rpm for 3 hours. After dispersing, 5 parts of a crosslinked polymethyl methacrylate particle (trade name: SSX-103, average particle diameter: 3 μm, manufactured by SEKISUI CHEMICAL CO., LTD.) and 0.01 parts of silicone oil (trade name: SH28PA, manufactured by Dow Corning Toray Co., Ltd.) were added to the dispersion obtained, and the dispersion was stirred to prepare a coating solution for an undercoat layer. The coating solution for an undercoat layer was applied onto a support through dip application to form a coating film, and the coating film was heated at 170° C. for 60 minutes for polymerization to form an undercoat layer UCL-1 having a film thickness of 30 μm.

(A)

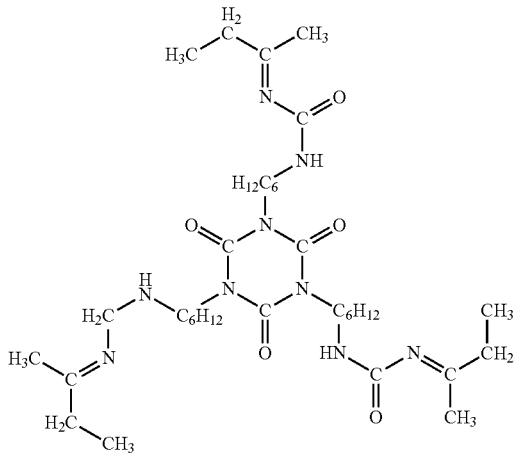

Subsequently, 10 parts of a hydroxy gallium phthalocyanine crystal (charge generating material) having a crystal system with peaks at Bragg angles (2θ±0.2°) of 7.5°, 9.9°, 12.5°, 16.3°, 18.6°, 25.1° and 28.3° in characteristic X-ray diffraction with CuKα radiation, 5 parts of polyvinylbutyral (trade name: S-LEC BX-1, manufactured by SEKISUI CHEMICAL CO., LTD.), and 250 parts of cyclohexanone were put in a sand mill with glass beads having a diameter of 1.0 mm, and dispersed for 6 hours. Next, 250 parts of ethyl acetate was added thereto to prepare a coating solution for a charge generation layer. The coating solution for a charge generation layer is applied onto the undercoat layer through dip application and the coating film obtained was dried at 100° C. for 10 minutes to form a charge generation layer having a film thickness of 0.23 μm.

Subsequently, 10 parts of the exemplary compound 1001 (viscosity-average molecular weight: 51,000) as a polycarbonate resin and 8 parts of a mixture of the compound CTM-102 and the compound CTM-205 (mixing ratio: 9:1) as a charge transporting material were dissolved in 70 parts of o-xylene and 20 parts of dimethoxymethane to prepare a coating solution for a charge transport layer. The coating solution for a charge transport layer was applied onto the charge generation layer through dip application, and the coating film obtained was dried at 125° C. for 60 minutes to form a charge transport layer having a film thickness of 15 μm.

Next, 1.5 parts of a fluorinated alkyl group-containing copolymer having structures represented by formulas (OCL-3-1) and (OCL-3-2) below at a ratio of 1:1 (weight average molecular weight: 130,000) as a dispersant was dissolved in a mixed solvent of 45 parts of 1,1,2,2,3,3,4-heptafluorocyclopentane (trade name: ZEOROLA H, manufactured by Zeon Corporation) and 45 parts of 1-propanol. Thereafter, 30 parts of a tetrafluoroethylene resin particle (trade name: LUBRON L-2, manufactured by DAIKIN INDUSTRIES, LTD.) was added, and the resultant was allowed to pass through a high-pressure disperser (trade name: Microfluidizer M-110EH, manufactured by Microfluidics) to obtain a dispersion. Further, 70 parts of a charge transporting compound having a polymerizable functional group represented by a formula (OCL-1-1) below, 30 parts of 1,1,2,2,3,3,4-heptafluorocyclopentane, and 30 parts of 1-propanol were added to the dispersion, and the dispersion was filtered with a POLYFLON filter (trade name: PF-040, manufactured by Advantec Toyo Kaisha, Ltd.) to prepare a coating solution for a protective layer. The coating solution for a protective layer was applied onto the charge transport layer through dip application, and the coating film obtained was dried at 50° C. for 5 minutes. After drying, the coating film was irradiated with an electron beam in a nitrogen atmosphere at an accelerating voltage of 60 kV and an absorbed dose of 8000 Gy for 1.6 seconds. Thereafter, the coating film was heated in a nitrogen atmosphere for 1 minute so that the temperature of the coating film reached 130° C. Here, the oxygen concentration from irradiation with an electron beam to 1 minute of heating was 20 ppm. Next, the coating film was heated in the atmosphere for 1 hour so that the temperature of the coating film reached 110° C. to form a protective layer 1 having a film thickness of 5 μm. Thus, an electrophotographic photosensitive member of Example 1 was produced.

(OCL-1-1)

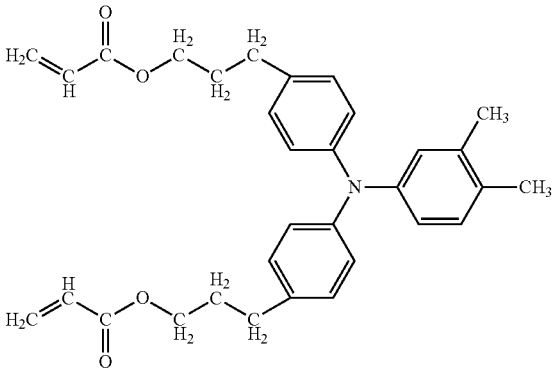

Examples 2 to 28

The type and viscosity-average molecular weight, Mv, of the resin for the charge transport layer, the type (the mass ratio in the case of combination use of two types) of the charge transporting material, the ratio by part between the charge transporting material (CTM) and the resin, the film thickness of the charge transport layer, the film thickness of the protective layer, and the film thickness ratio (film thickness of protective layer/film thickness of charge transport layer) in Example 1 were changed as listed in Table 15, and thus electrophotographic photosensitive members of Examples 2 to 28 were produced.

Example 29

An electrophotographic photosensitive member of Example 29 was produced in the same manner as in Example 1 except that the protective layer used in Example 1 was prepared as described below, and the charge transporting material was changed as listed in Table 15.

In 100 parts of tetrahydrofuran, 9 parts of trimethylolpropane triacrylate (trade name: KAYARAD TMPTA, manufactured by Nippon Kayaku Co., Ltd.) as a radical-polymerizable monomer, 9 parts of a charge transporting compound having a polymerizable functional group represented by a formula (OCL-2-1) below, and 2 parts of 1-hydroxy-cyclohexyl-phenyl-ketone (trade name: IRGACURE 184, manufactured by Ciba Specialty Chemicals Inc.) as a polymerization initiator were dissolved to prepare a coating solution for a protective layer. The coating solution for a protective layer was applied onto the charge transport layer through spray application, and the coating film was irradiated with light from a metal halide lamp at an irradiation intensity of 700 mW/cm$^2$ for 240 seconds. Thereafter, the coating film was dried at 130° C. for 30 minutes to form a protective layer 2 having a film thickness of 5 μm.

(OCL-2-1)

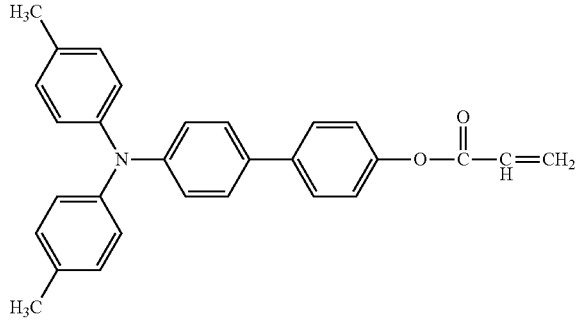

Examples 30 to 34

The type and viscosity-average molecular weight, Mv, of the resin for the charge transport layer, the type (the mass ratio in the case of combination use of two types) of the charge transporting material, the ratio by part between the charge transporting material and the resin, the film thickness of the charge transport layer, the film thickness of the protective layer, and the film thickness ratio (film thickness of protective layer/film thickness of charge transport layer) in Example 29 were changed as listed in Table 15, and thus electrophotographic photosensitive members of Examples 30 to 34 were produced.

Example 35

An electrophotographic photosensitive member of Example 35 was produced in the same manner as in Example 1 except that the protective layer used in Example 1 was prepared as described below, and the charge transporting material was changed as listed in Table 15.

Tetrafluoroethylene resin dispersion was produced through thoroughly stirring 10 parts of a tetrafluoroethylene resin particle (trade name: LUBRON L-2, manufactured by DAIKIN INDUSTRIES, LTD.), 0.3 parts of a fluorinated alkyl group-containing copolymer having structures represented by formulas (OCL-3-1) and (OCL-3-2) below at a ratio of 1:1 (weight average molecular weight: 130,000), and 40 parts of cyclopentanone to mix together.

Subsequently, 45 parts of a charge transporting compound having a polymerizable functional group represented by a formula (OCL-3-3) below, 15 parts of a charge transporting compound having a polymerizable functional group represented by a formula (OCL-3-4) below, 4 parts of a guanamine compound represented by a formula (OCL-3-5) below (trade name: NIKALAC BL-60, manufactured by SANWA CHEMICAL CO., LTD.), and 1.5 parts of bis(4-diethylamino-2-methylphenyl)-(4-diethylaminophenyl)-methane as an antioxidant were dissolved in 220 parts of cyclopentanone, and the tetrafuloroethylene resin dispersion was added thereto, and mixed with stirring.

Next, the mixed solution obtained was allowed to pass through a high-pressure disperser (trade name: homogenizer YSNM-1500AR), and 1 part of dimethylpolysiloxane (trade name: GRANOL 450, manufactured by Kyoeisha Chemical Co., Ltd.) and 0.1 parts of a curing catalyst (trade name: NACURE 5225, manufactured by King Industries, Inc.) were added thereto to prepare a coating solution for a protective layer. The coating solution for a protective layer was applied onto the charge transport layer through dip application, and the coating film obtained was dried at 160° C. for 30 minutes to form a protective layer 3 having a film thickness of 5 μm.

(OCL-3-1)

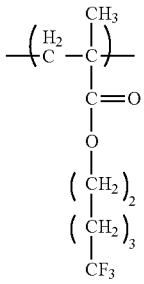

(OCL-3-2)

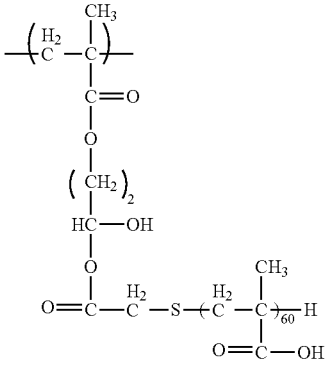

(OCL-3-3)

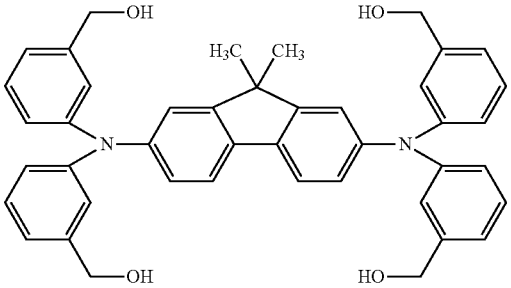

(OCL-3-4)

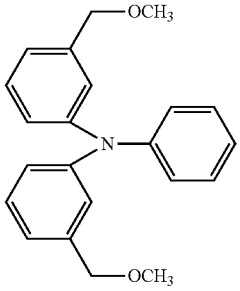

-continued (OCL-3-5)

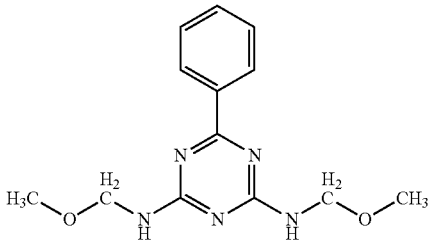

Examples 36 to 40

The type and viscosity-average molecular weight, Mv, of the resin for the charge transport layer, the type (the mass ratio in the case of combination use of two types) of the charge transporting material, the ratio by part between the charge transporting material and the resin, the film thickness of the charge transport layer, the film thickness of the protective layer, and the film thickness ratio (film thickness of protective layer/film thickness of charge transport layer) in Example 35 were changed as listed in Table 15, and thus electrophotographic photosensitive members of Examples 36 to 40 were produced.

Example 41

An electrophotographic photosensitive member of Example 41 was produced in the same manner as in Example 1 except that the protective layer used in Example 1 was prepared as described below, and the charge transporting material was changed as listed in Table 15.

By using a wet sand mill with glass beads having an average particle diameter of 0.5 mm, 10 parts of a tin oxide particle (average primary particle diameter: 30 nm), 3 parts of a surface-treating agent (structural formula: $CH_2{=}CHCOOSi(OCH_3)_3$), and 100 parts of methyl ethyl ketone were mixed together at 30° C. for 6 hours, and thereafter the methyl ethyl ketone and glass beads were separated through filtration, and the residue was dried at 60° C. to prepare a tin oxide particle having an acryloyl group.

Subsequently, 4 parts of the tin oxide particle having an acryloyl group, 5 parts of a compound having a polymerizable functional group represented by a formula (OCL-4-1) below, 5 parts of a polymerization initiator represented by a formula (OCL-4-2) below, and 20 parts of 1-propanol were added, and the resultant was allowed to pass through a high-pressure disperser (trade name: Microfluidizer M-110EH, manufactured by Microfluidics) to prepare a coating solution for a protective layer. The coating solution for a protective layer was applied onto the charge transport layer through spray application, and the coating film was irradiated with light from a metal halide lamp at an irradiation intensity of 500 mW/cm$^2$ for 90 seconds to form a protective layer 4 having a film thickness of 5 μm.

(OCL-4-1)

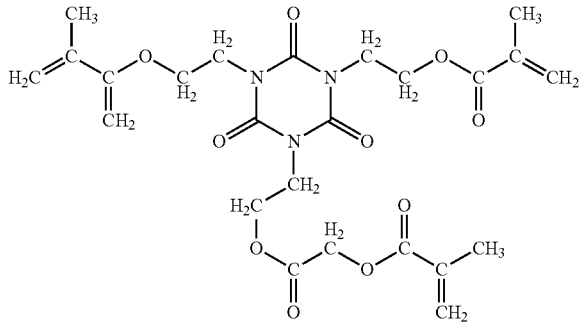

(OCL-4-2)

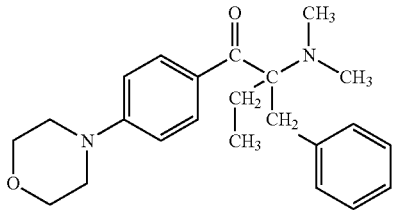

Examples 42 to 46

The type and viscosity-average molecular weight, Mv, of the resin for the charge transport layer, the type (the mass ratio in the case of combination use of two types) of the charge transporting material, the ratio by part between the charge transporting material and the resin, the film thickness of the charge transport layer, the film thickness of the protective layer, and the film thickness ratio (film thickness of protective layer/film thickness of charge transport layer) in Example 41 were changed as listed in Table 15, and thus electrophotographic photosensitive members of Examples 42 to 46 were produced.

Examples 47 to 50

The type and viscosity-average molecular weight, Mv, of the resin for the charge transport layer, the type (the mass ratio in the case of combination use of two types) of the charge transporting material, the ratio by part between the charge transporting material (CTM) and the resin, the film thickness of the charge transport layer, the film thickness of the protective layer, and the film thickness ratio (film thickness of protective layer/film thickness of charge transport layer) in Example 1 were changed as listed in Table 15, and thus electrophotographic photosensitive members of Examples 47 to 50 were produced.

Comparative Example 1

An electrophotographic photosensitive member of Comparative Example 1 was produced in the same manner as in Example 1 except that an exemplary compound 4001 for the charge transport layer and a protective layer were prepared as follows.

The exemplary compound 4001 was a copolymer having a structure represented by a formula (C-101) below and a structure represented by the formula (B-101) (content ratio: 20 mol %:80 mol %, viscosity-average molecular weight: 48,000).

Sixty parts of a compound having a polymerizable functional group represented by a formula (OCL-5-1) below, 30 parts of a tin oxide particle (average primary particle diameter: 40 nm), 0.1 parts of 2-methylthioxantone as a polymerization initiator, 100 parts of methanol, and 200 parts of methyl cellosolve were mixed together, and dispersed by using a vertical sand mill in an atmosphere of 23° C. at a rotational frequency of 1,500 rpm for 48 hours to prepare a coating solution for a protective layer. The coating solution for a protective layer was applied onto the charge transport layer through a beam coating method to produce a coating film, and the coating film was dried at 60° C. for 10 minutes, and then irradiated with light from a high-pressure mercury lamp at an irradiation intensity of 8 mW/cm$^2$ for 20 seconds to form a protective layer 5 having a film thickness of 4 μm.

(C-101)

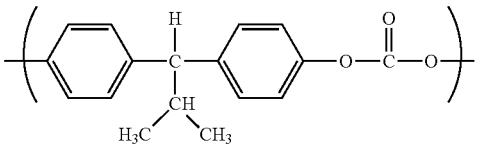

(OCL-5-1)

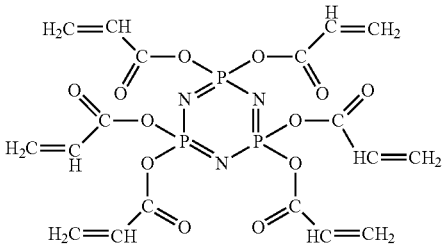

Comparative Example 2

An electrophotographic photosensitive member of Comparative Example 2 was produced in the same manner as in Example 1 except that an exemplary compound 4002 for the charge transport layer was prepared and the film thickness was set as described below, and a protective layer was prepared as described below.

The exemplary compound 4002 was a polymer having a structure represented by the formula (B-303) (viscosity-average molecular weight: 24,000). The film thickness of the charge transport layer was 18 μm.

By using a wet sand mill with glass beads having an average particle diameter of 0.5 mm, 10 parts of a titanium oxide particle (average primary particle diameter: 30 nm), 3 parts of a surface-treating agent (structural formula: $CH_2{=}C(CH_3)COO(CH_2)_3Si(OCH)_3$), and 100 parts of methyl ethyl ketone were mixed together at 30° C. for 6 hours, and then the methyl ethyl ketone and glass beads were separated through filtration, and the residue was dried at 60° C. to prepare a titanium oxide particle having an acryloyl group.

Subsequently, 10 parts of the titanium oxide particle having an acryloyl group, 10 parts of a compound having a polymerizable functional group (structural formula: $C(CH_2O(COC(CH_3){=}CH_2))_4$), 3 parts of a polymerization initiator represented by the formula (OCL-4-2), and 50 parts of 1-propanol were added, and the resultant was allowed to pass through a high-pressure disperser (trade name: Microfluidizer M-110EH, manufactured by Microfluidics) to prepare a coating solution for a protective layer. The coating solution for a protective layer was applied onto the charge transport layer through spray application, and the coating film was irradiated with light from a metal halide lamp at an irradiation intensity of 500 mW/cm$^2$ for 90 seconds to form a protective layer 6 having a film thickness of 3 μm.

TABLE 15

Production conditions for photosensitive members

| | Resin | | | CTM/ | Film thickness of charge | | Film thickness of | Film |
|---|---|---|---|---|---|---|---|---|
| | Exemplary compound | Molecular weight | Type of charge transporting material | resin ratio | transport layer/μm | Protective layer | protective layer/μm | thickness ratio |
| Example | | | | | | | | |
| 1 | 1001 | 51000 | Mixture of CTM-102 and CTM-205 (9/1) | 8/10 | 15 | 1 | 5 | 0.33 |
| 2 | 1001 | 21000 | Mixture of CTM-102 and CTM-205 (9/1) | 8/10 | 15 | 1 | 5 | 0.33 |
| 3 | 1001 | 25000 | Mixture of CTM-102 and CTM-205 (9/1) | 8/10 | 15 | 1 | 5 | 0.33 |
| 4 | 1001 | 38000 | Mixture of CTM-102 and CTM-205 (9/1) | 8/10 | 15 | 1 | 5 | 0.33 |
| 5 | 1001 | 69000 | Mixture of CTM-102 and CTM-205 (9/1) | 8/10 | 15 | 1 | 5 | 0.33 |
| 6 | 1001 | 83000 | Mixture of CTM-102 and CTM-205 (9/1) | 8/10 | 15 | 1 | 5 | 0.33 |
| 7 | 1002 | 55000 | Mixture of CTM-102 and CTM-205 (9/1) | 8/10 | 15 | 1 | 5 | 0.33 |
| 8 | 1003 | 50000 | Mixture of CTM-102 and CTM-205 (9/1) | 8/10 | 15 | 1 | 5 | 0.33 |
| 9 | 1093 | 47000 | Mixture of CTM-102 and CTM-205 (9/1) | 8/10 | 15 | 1 | 5 | 0.33 |
| 10 | 1003 | 50000 | Mixture of CTM-102 and CTM-205 (9/1) | 10/10 | 15 | 1 | 5 | 0.33 |
| 11 | 1003 | 50000 | Mixture of CTM-102 and CTM-205 (9/1) | 12/10 | 15 | 1 | 5 | 0.33 |
| 12 | 1003 | 50000 | Mixture of CTM-102 and CTM-205 (9/1) | 20/10 | 15 | 1 | 5 | 0.33 |
| 13 | 1021 | 52000 | Mixture of CTM-102 and CTM-205 (9/1) | 8/10 | 15 | 1 | 5 | 0.33 |
| 14 | 1022 | 57000 | Mixture of CTM-102 and CTM-205 (9/1) | 8/10 | 15 | 1 | 5 | 0.33 |
| 15 | 1113 | 53000 | Mixture of CTM-102 and CTM-205 (9/1) | 8/10 | 15 | 1 | 5 | 0.33 |
| 16 | 1045 | 52000 | CTM-211 | 8/10 | 15 | 1 | 5 | 0.33 |
| 17 | 1049 | 49000 | CTM-309 | 8/10 | 15 | 1 | 5 | 0.33 |
| 18 | 1065 | 51000 | CTM-603 | 8/10 | 15 | 1 | 5 | 0.33 |
| 19 | 1001 | 51000 | Mixture of CTM-102 and CTM-205 (9/1) | 8/10 | 21 | 1 | 3 | 0.14 |
| 20 | 1001 | 51000 | Mixture of CTM-102 and CTM-205 (9/1) | 8/10 | 20 | 1 | 4 | 0.20 |
| 21 | 1001 | 51000 | Mixture of CTM-102 and CTM-205 (9/1) | 8/10 | 18 | 1 | 4.5 | 0.25 |
| 22 | 1001 | 51000 | Mixture of CTM-102 and CTM-205 (9/1) | 8/10 | 16 | 1 | 5.5 | 0.34 |

TABLE 15-continued

| Production conditions for photosensitive members | | | | | | | | |
|---|---|---|---|---|---|---|---|---|
| | Resin | | | CTM/ | Film thickness of charge | | Film thickness of | Film |
| | Exemplary compound | Molecular weight | Type of charge transporting material | resin ratio | transport layer/μm | Protective layer | protective layer/μm | thickness ratio |
| 23 | 1001 | 51000 | Mixture of CTM-102 and CTM-205 (9/1) | 8/10 | 12 | 1 | 6 | 0.50 |
| 24 | 1645 | 46000 | Mixture of CTM-102 and CTM-205 (9/1) | 8/10 | 15 | 1 | 5 | 0.33 |
| 25 | 1461 | 49000 | Mixture of CTM-102 and CTM-205 (9/1) | 8/10 | 15 | 1 | 5 | 0.33 |
| 26 | 1553 | 57000 | Mixture of CTM-102 and CTM-205 (9/1) | 8/10 | 15 | 1 | 5 | 0.33 |
| 27 | 2281 | 32000 | Mixture of CTM-102 and CTM-205 (9/1) | 8/10 | 15 | 1 | 5 | 0.33 |
| 28 | 2373 | 68000 | Mixture of CTM-102 and CTM-205 (9/1) | 8/10 | 15 | 1 | 5 | 0.33 |
| 29 | 1001 | 51000 | CTM-304 | 8/10 | 15 | 2 | 5 | 0.33 |
| 30 | 1001 | 21000 | CTM-304 | 8/10 | 15 | 2 | 5 | 0.33 |
| 31 | 1001 | 25000 | CTM-304 | 8/10 | 15 | 2 | 5 | 0.33 |
| 32 | 1001 | 38000 | CTM-304 | 8/10 | 15 | 2 | 5 | 0.33 |
| 33 | 1001 | 69000 | CTM-304 | 8/10 | 15 | 2 | 5 | 0.33 |
| 34 | 1001 | 83000 | CTM-304 | 8/10 | 15 | 2 | 5 | 0.33 |
| 35 | 1001 | 51000 | CTM-201 | 8/10 | 15 | 3 | 5 | 0.33 |
| 36 | 1001 | 21000 | CTM-201 | 8/10 | 15 | 3 | 5 | 0.33 |
| 37 | 1001 | 25000 | CTM-201 | 8/10 | 15 | 3 | 5 | 0.33 |
| 38 | 1001 | 38000 | CTM-201 | 8/10 | 15 | 3 | 5 | 0.33 |
| 39 | 1001 | 69000 | CTM-201 | 8/10 | 15 | 3 | 5 | 0.33 |
| 40 | 1001 | 83000 | CTM-201 | 8/10 | 15 | 3 | 5 | 0.33 |
| 41 | 1001 | 51000 | CTM-307 | 8/10 | 15 | 4 | 5 | 0.33 |
| 42 | 1001 | 21000 | CTM-307 | 8/10 | 15 | 4 | 5 | 0.33 |
| 43 | 1001 | 25000 | CTM-307 | 8/10 | 15 | 4 | 5 | 0.33 |
| 44 | 1001 | 38000 | CTM-307 | 8/10 | 15 | 4 | 5 | 0.33 |
| 45 | 1001 | 69000 | CTM-307 | 8/10 | 15 | 4 | 5 | 0.33 |
| 46 | 1001 | 83000 | CTM-307 | 8/10 | 15 | 4 | 5 | 0.33 |
| 47 | 5001 | 53000 | Mixture of CTM-102 and CTM-205 (9/1) | 8/10 | 15 | 1 | 5 | 0.33 |
| 48 | 5021 | 49000 | Mixture of CTM-102 and CTM-205 (9/1) | 8/10 | 15 | 1 | 5 | 0.33 |
| 49 | 5041 | 47000 | Mixture of CTM-102 and CTM-205 (9/1) | 8/10 | 15 | 1 | 5 | 0.33 |
| 50 | 5169 | 50000 | Mixture of CTM-102 and CTM-205 (9/1) | 8/10 | 15 | 1 | 5 | 0.33 |
| Comparative Example | | | | | | | | |
| 1 | 4001 | 48000 | Mixture of CTM-102 and CTM-205 (9/1) | 8/10 | 18 | 5 | 4 | 0.22 |
| 2 | 4002 | 24000 | Mixture of CTM-102 and CTM-205 (9/1) | 8/10 | 18 | 6 | 3 | 0.17 |

[Evaluation]

By using the electrophotographic photosensitive members produced as described above or coating solutions for a charge transport layer, evaluations described below were performed. The evaluation results are shown in Table 16.

<Evaluation of Electrophotographic Photosensitive Member>

(Electric Characteristics in Repeated Use)

The laser beam printer CP-4525 (manufactured by Hewlett-Packard Company) was customized to provide the printer with the ability to adjust the charging potential (dark potential) and the intensity of exposure light for an electrophotographic photosensitive member, and used as an evaluation apparatus.

Each of the electrophotographic photosensitive members produced as described above was installed in a process cartridge (cyan) of the evaluation apparatus, and an image of a test chart having a coverage rate of 5% was continuously output on 20,000 sheets of A4 plain paper in an environment with a temperature of 15° C. and a relative humidity of 10%. For the charging conditions, a bias to be applied was adjusted so as to control the charging potential (dark potential) of an electrophotographic photosensitive member to −550 V. For the exposure conditions, the intensity of exposure light was adjusted to 0.4 $\mu J/cm^2$.

The bright potential of an electrophotographic photosensitive member was measured before and after the repeated use by using the following method. For measurement of the bright potential of an electrophotographic photosensitive member, a developing device was detached from the process cartridge of the evaluation apparatus, and a probe for measurement of potential (trade name: model 6000B-8, manufactured by TREK INC.) was disposed at a developing position, and the bright potential was measured with a surface potential gauge (model 344, manufactured by TREK INC.). The position of the probe for measurement of potential to the electrophotographic photosensitive member was the center of the electrophotographic photosensitive member in the axial direction, and the distance between the surface of the electrophotographic photosensitive member and the measuring surface of the probe for measurement of potential was 3 mm.

From the change (difference) in bright potential of an electrophotographic photosensitive member between before and after the repeated use, the electric characteristics of an electrophotographic photosensitive member in repeated use were evaluated. The smaller the change in bright potential is, the higher the potential variation-suppressing effect of an electrophotographic photosensitive member in repeated use is. In this evaluation, a change in bright potential of smaller than 50 V was rated as a preferable level, and a change in bright potential of 50 V or larger was rated as an unacceptable level.

(Spot-Preventing Effect: Fogging Value)

The laser beam printer CP-4525 (manufactured by Hewlett-Packard Company) was customized to provide the printer with the ability to adjust the charging potential (dark potential) for an electrophotographic photosensitive member, and used as an evaluation apparatus with the charging potential (dark potential) set at −550 V.

Each of the electrophotographic photosensitive members produced as described above was installed in a process cartridge (cyan) of the evaluation apparatus, and an image of a test chart having a coverage rate of 1% was continuously output on 100,000 sheets of A4 plain paper in an environment with a temperature of 15° C. and a relative humidity of 10%. In the output of the image of the test chart, a cycle including continuous output of 5 sheets and 10 seconds of suspension was repeated.

After duration of 100,000 sheets, the worst reflection density of a white part of the image, $F_1$, and the average reflection density of a plain paper before formation of the image, $F_0$, were measured, and $F_1-F_0$ was used as a fogging value. In measurement of the density, a reflection densitometer (Reflectometer Model TC-6DS, manufactured by Tokyo Denshoku Co., Ltd.) was used. The smaller the numerical value is, the higher the spot-preventing effect is. In this evaluation, ratings of A to C were each regarded as a preferable level, and D was regarded as an unacceptable level.

A: the fogging value was less than 1.0.
B: the fogging value was 1.0 or more and less than 2.0.
C: the fogging value was 2.0 or more and less than 4.0.
D: the fogging value was 4.0 or more.

<Evaluation of Coating Solution for Charge Transport Layer>

(Storage Stability)

A coating solution for a charge transport layer was prepared and stirred for 24 hours, and then stored in a sealed state in an environment with a temperature of 23° C. and a relative humidity of 50% for 1 month. The coating solution for a charge transport layer after storage was visually observed to evaluate the storage stability. Evaluation criteria were as follows.

A: No undissolved solid was present, and the coating solution was transparent.
B: Although no undissolved solid was present, the coating solution was found to have cloudiness to a certain degree.
C: Although no undissolved solid was present, the coating film was found to have apparent cloudiness.
D: An undissolved solid was present.

TABLE 16

| | Evaluation results | | |
|---|---|---|---|
| | Change in bright potential/V | Fogging value | Storage stability |
| Example | | | |
| 1 | 12 | A | A |
| 2 | 19 | A | A |
| 3 | 15 | A | A |
| 4 | 14 | A | A |
| 5 | 17 | A | B |
| 6 | 23 | B | C |
| 7 | 11 | A | A |
| 8 | 16 | B | B |
| 9 | 13 | A | A |
| 10 | 12 | B | A |
| 11 | 10 | A | A |
| 12 | 7 | A | A |
| 13 | 14 | A | B |
| 14 | 12 | A | A |
| 15 | 15 | A | A |

TABLE 16-continued

| | Evaluation results | | |
|---|---|---|---|
| | Change in bright potential/V | Fogging value | Storage stability |
| 16 | 19 | B | A |
| 17 | 23 | B | A |
| 18 | 21 | B | A |
| 19 | 15 | C | A |
| 20 | 17 | B | A |
| 21 | 12 | A | A |
| 22 | 16 | A | A |
| 23 | 25 | B | A |
| 24 | 21 | A | A |
| 25 | 27 | A | A |
| 26 | 29 | B | A |
| 27 | 33 | B | A |
| 28 | 35 | C | A |
| 29 | 24 | A | A |
| 30 | 30 | A | A |
| 31 | 26 | A | A |
| 32 | 25 | A | A |
| 33 | 28 | A | B |
| 34 | 33 | B | C |
| 35 | 27 | A | A |
| 36 | 34 | A | A |
| 37 | 30 | A | A |
| 38 | 28 | A | A |
| 39 | 32 | A | B |
| 40 | 38 | B | C |
| 41 | 33 | B | A |
| 42 | 39 | B | A |
| 43 | 37 | B | A |
| 44 | 35 | B | A |
| 45 | 34 | C | B |
| 46 | 41 | C | C |
| 47 | 30 | B | B |
| 48 | 32 | B | B |
| 49 | 35 | B | A |
| 50 | 39 | B | C |
| Comparative Example | | | |
| 1 | 69 | C | C |
| 2 | 52 | D | A |

Example 51

An electrophotographic photosensitive member of Example 51 was produced in the same manner as in Example 1 except that the protective layer used in Example 1 was prepared as described below, and the charge transporting material was changed as listed in Table 17.

With stirring, 10 parts of a compound having a polymerizable functional group represented by a formula (OCL-7-1) below, 10 parts of urethane acrylate (EBECRYL 8301, manufactured by DAICEL-ALLNEX LTD.), 1 part of methyl benzoylformate, 170 parts of 2-propanol, and 19 parts of tetrahydrofuran were mixed together to prepare a coating solution for a protective layer. The coating solution for a protective layer was applied onto the charge transport layer through dip application, and dried at 60° C. for 10 minutes, and the coating film was then irradiated with light from a fusion UV source (H-valve) for 5 seconds, and further dried at 120° C. for 60 minutes to form a protective layer 7 having a film thickness of 5 μm.

(OCL-7-1)

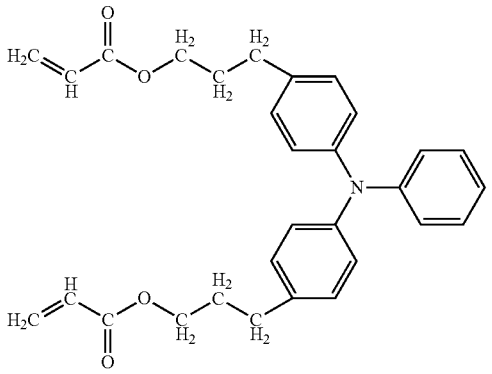

Examples 52 to 56

The type and viscosity-average molecular weight, Mv, of the resin for the charge transport layer, the type of the charge transporting material, the ratio by part between the charge transporting material (CTM) and the resin, the film thickness of the charge transport layer, the film thickness of the protective layer, and the film thickness ratio (film thickness of protective layer/film thickness of charge transport layer) in Example 1 were changed as listed in Table 17, and thus electrophotographic photosensitive members of Examples 52 to 56 were produced.

By using the electrophotographic photosensitive members produced in Examples 51 to 56 or coating solutions for a charge transport layer, evaluation for the electrophotographic photosensitive member and evaluation for the coating solutions for a charge transport layer were performed in the same manner as for Example 1. The evaluation results are shown in Table 18.

TABLE 17

Production conditions for photosensitive members

| Example | Resin: Exemplary compound | Resin: Molecular weight | Type of charge transporting material | CTM/resin ratio | Film thickness of charge transport layer/μm | Protective layer | Film thickness of protective layer/μm | Film thickness ratio |
|---|---|---|---|---|---|---|---|---|
| 51 | 1001 | 51000 | CTM-205 | 8/10 | 15 | 7 | 5 | 0.33 |
| 52 | 1001 | 21000 | CTM-205 | 8/10 | 15 | 7 | 5 | 0.33 |
| 53 | 1001 | 25000 | CTM-205 | 8/10 | 15 | 7 | 5 | 0.33 |
| 54 | 1001 | 38000 | CTM-205 | 8/10 | 15 | 7 | 5 | 0.33 |
| 55 | 1001 | 69000 | CTM-205 | 8/10 | 15 | 7 | 5 | 0.33 |
| 56 | 1001 | 83000 | CTM-205 | 8/10 | 15 | 7 | 5 | 0.33 |

TABLE 18

Evaluation results

| Example | Change in bright potential/V | Rank of fogging after duration | Storage stability of coating solution |
|---|---|---|---|
| 51 | 18 | A | A |
| 52 | 24 | A | A |
| 53 | 21 | A | A |
| 54 | 15 | A | A |

TABLE 18-continued

Evaluation results

| Example | Change in bright potential/V | Rank of fogging after duration | Storage stability of coating solution |
|---|---|---|---|
| 55 | 22 | A | B |
| 56 | 28 | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-165851, filed Aug. 26, 2016, which is hereby incorporated by reference herein in its entirety.

What is claimed is:

1. An electrophotographic photosensitive member comprising, in this order:

a support;

a charge generation layer;

a charge transport layer comprising a charge transporting material, and a polycarbonate resin having a structure selected from group A and a structure selected from group B; and a protective layer comprising a cured material of a composition comprising a compound having at least a functional group selected from chain-polymerizable functional groups and sequential polymerizable functional groups, wherein Group A is represented by formulae (101) and (102)

(101)

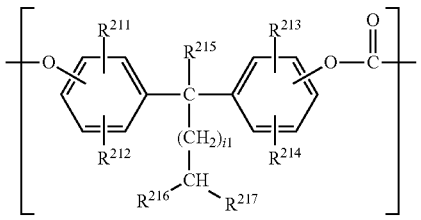

where $R^{211}$ to $R^{214}$ independently represent a hydrogen atom, an alkyl group, an aryl group or an alkoxy group; $R^{215}$ represents an alkyl group, an aryl group or an alkoxy group; $R^{216}$ and $R^{217}$ independently represent an alkyl group having one to nine carbon atoms; and i1 represents an integer of 0 to 3, provided that $R^{215}$ and $(CH_2)_{i1}CHR^{216}R^{217}$ are not the same;

(102)

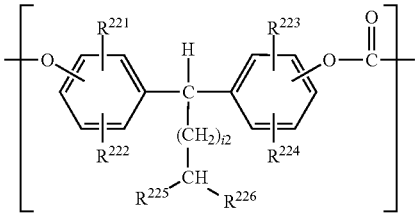

where $R^{221}$ to $R^{224}$ independently represent a hydrogen atom, an alkyl group, an aryl group or an alkoxy group; $R^{225}$ and $R^{226}$ independently represent an alkyl group having one to nine carbon atoms, provided that $R^{225}$ and $R^{226}$ are not the same; and i2 represents an integer of 0 to 3;

Group B is represented by formulae (104) to (106)

(104)

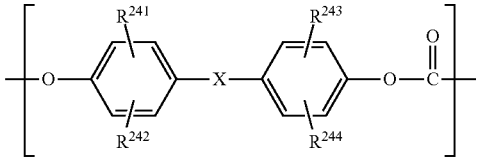

where $R^{241}$ to $R^{244}$ independently represent a hydrogen atom, an alkyl group, an aryl group or an alkoxy group; and X represents a single bond, an oxygen atom, a sulfur atom or a sulfonyl group;

(105)

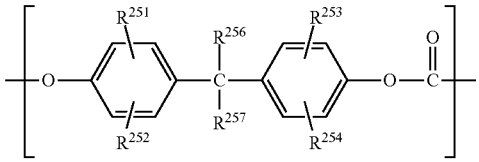

where $R^{251}$ to $R^{254}$ independently represent a hydrogen atom, an alkyl group, an aryl group or an alkoxy group; and $R^{256}$ and $R^{257}$ independently represent a hydrogen atom, an alkyl group, an aryl group or a halogenated alkyl group; and (106)

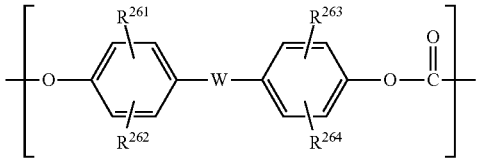

where $R^{261}$ to $R^{264}$ independently represent a hydrogen atom, an alkyl group, an aryl group or an alkoxy group; and W represents a cycloalkylidene group having 5 to 12 carbon atoms.

2. The electrophotographic photosensitive member according to claim 1, wherein the ratio of the film thickness of the protective layer to the film thickness of the charge transport layer is 0.20 to 0.40.

3. The electrophotographic photosensitive member according to claim 1, wherein the structure of the polycarbonate resin selected from group A is formula (101).

4. The electrophotographic photosensitive member according to claim 3, wherein $R^{215}$ is a methyl group.

5. The electrophotographic photosensitive member according to claim 4, wherein $R^{216}$ and $R^{217}$ are the same.

6. The electrophotographic photosensitive member according to claim 1, wherein the content ratio of the structure selected from the group A to the polycarbonate resin is 20 to 80 mol %.

7. The electrophotographic photosensitive member according to claim 1, wherein the viscosity-average molecular weight of the polycarbonate resin is 20,000 to 70,000.

8. The electrophotographic photosensitive member according to claim 1, wherein the content of the charge transporting material in the charge transport layer is 80 to 200% by mass based on the content of the polycarbonate resin.

9. The electrophotographic photosensitive member according to claim 1, wherein the charge generation layer comprises a gallium phthalocyanine crystal charge generating material.

10. The electrophotographic photosensitive member according to claim 1, wherein the polymerizable functional group of the compound having the polymerizable functional group is an acryloyloxy group, a methacryloyloxy group, an alkoxysilyl group or an epoxy group.

11. An electrophotographic photosensitive member comprising, in this order:

a support;

a charge generation layer;

a charge transport layer comprising a charge transporting material, and a polycarbonate resin having structures represented by formulae (121) and (104); and a protective layer comprising a cured material of a composition comprising a compound having at least a functional group selected from chain-polymerizable functional groups and sequential polymerizable functional groups (121)

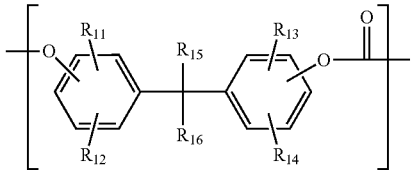

where $R^{11}$ to $R^{15}$ independently represent a hydrogen atom, a methyl group, an ethyl group or a phenyl group; and $R^{16}$ represents a linear alkyl group having 6 to 15 carbon atoms; and (104)

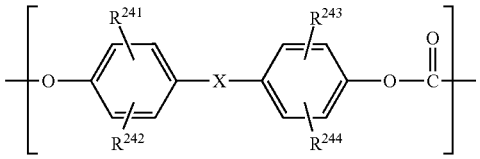

where $R^{241}$ to $R^{244}$ independently represent a hydrogen atom, an alkyl group, an aryl group or an alkoxy group; and X represents a single bond, an oxygen atom, a sulfur atom or a sulfonyl group.

12. A method for producing an electrophotographic photosensitive member comprising, in this order:

a support;

a charge generation layer;

a charge transport layer comprising a charge transporting material, and a polycarbonate resin having a structure selected from group A and a structure selected from group B; and a protective layer comprising a cured material of a composition comprising a compound having at least a functional group selected from chain-polymerizable functional groups and sequential polymerizable functional groups, wherein Group A is represented by formulae (101) and (102)

(101)

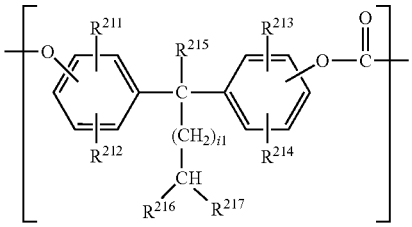

where $R^{211}$ to $R^{214}$ independently represent a hydrogen atom, an alkyl group, an aryl group or an alkoxy group; $R^{215}$ represents an alkyl group, an aryl group or an alkoxy group; $R^{216}$ and $R^{217}$ independently represent an alkyl group having one to nine carbon atoms; and i1 represents an integer of 0 to 3, provided that $R^{215}$ and $(CH_2)_{i1}CHR^{216}R^{217}$ are not the same;

(102)

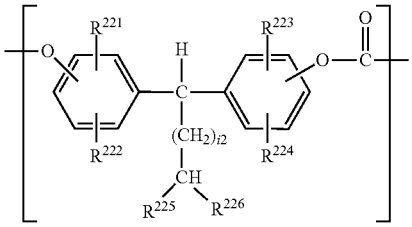

where $R^{221}$ to $R^{224}$ independently represent a hydrogen atom, an alkyl group, an aryl group or an alkoxy group; $R^{225}$ and $R^{226}$ independently represent an alkyl group having one to nine carbon atoms, provided that $R^{225}$ and $R^{226}$ are not the same; and i2 represents an integer of 0 to 3;

Group B is represented by formulae (104) to (106)

(104)

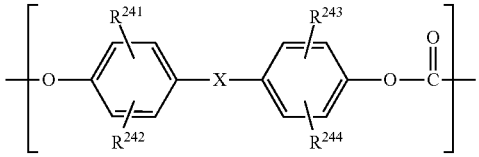

where $R^{241}$ to $R^{244}$ independently represent a hydrogen atom, an alkyl group, an aryl group or an alkoxy group; and X represents a single bond, an oxygen atom, a sulfur atom or a sulfonyl group;

(105)

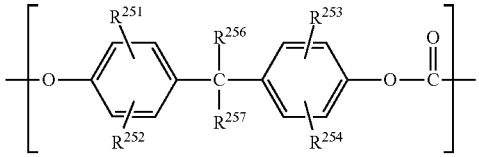

where $R^{251}$ to $R^{254}$ independently represent a hydrogen atom, an alkyl group, an aryl group or an alkoxy group; and $R^{256}$ and $R^{257}$ independently represent a hydrogen atom, an alkyl group, an aryl group or a halogenated alkyl group; and (106)

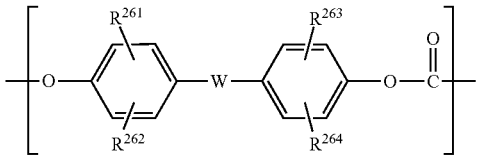

where $R^{261}$ to $R^{264}$ independently represent a hydrogen atom, an alkyl group, an aryl group or an alkoxy group; and W represents a cycloalkylidene group having 5 to 12 carbon atoms, the method comprises the steps of forming a coating film of a coating solution comprising the composition, followed by selectively irradiating the coating film with an ultraviolet ray or radiation to form said protective layer.

13. A process cartridge integrally supporting an electrophotographic photosensitive member and at least one unit selected from the group consisting of a charging unit, a developing unit, a transferring unit and a cleaning unit and being attachable to and detachable from a main body of an electrophotographic apparatus, the electrophotographic photosensitive member comprising in this order a support;

a charge generation layer;

a charge transport layer comprising a charge transporting material, and a polycarbonate resin having a structure selected from group A and a structure selected from group B; and a protective layer comprising a cured material of a composition comprising a compound having at least a functional group selected from chain-polymerizable functional groups and sequential polymerizable functional groups, wherein Group A is represented by formulae (101) and (102)

(101)

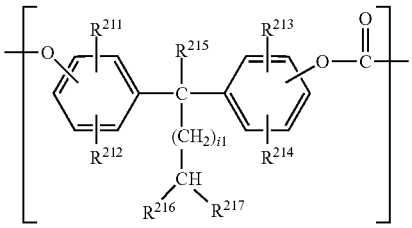

where $R^{211}$ to $R^{214}$ independently represent a hydrogen atom, an alkyl group, an aryl group or an alkoxy group; $R^{215}$ represents an alkyl group, an aryl group or an alkoxy group; $R^{216}$ and $R^{217}$ independently represent an alkyl group having one to nine carbon atoms; and i1 represents an integer of 0 to 3, provided that $R^{215}$ and $(CH_2)_{i1}CHR^{216}R^{217}$ are not the same;

(102)

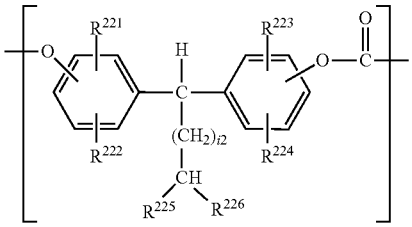

where $R^{221}$ to $R^{224}$ independently represent a hydrogen atom, an alkyl group, an aryl group, or an alkoxy group; $R^{225}$ and $R^{226}$ independently represent an alkyl group having one to nine carbon atoms, provided that $R^{225}$ and $R^{226}$ are not the same; and i2 represents an integer of 0 to 3;

Group B is represented by formulae (104) to (106)

(104)

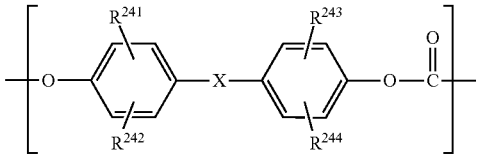

where $R^{241}$ to $R^{244}$ independently represent a hydrogen atom, an alkyl group, an aryl group or an alkoxy group; and X represents a single bond, an oxygen atom, a sulfur atom or a sulfonyl group;

(105)

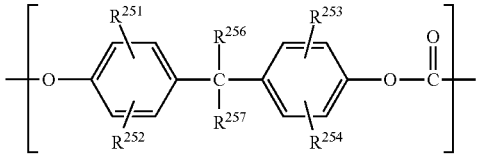

where $R^{251}$ to $R^{254}$ independently represent a hydrogen atom, an alkyl group, an aryl group or an alkoxy group; and $R^{256}$ and $R^{257}$ independently represent a hydrogen atom, an alkyl group, an aryl group or a halogenated alkyl group; and (106)

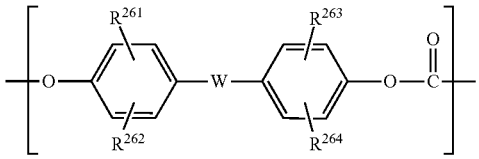

where $R^{261}$ to $R^{264}$ independently represent a hydrogen atom, an alkyl group, an aryl group or an alkoxy group; and W represents a cycloalkylidene group having 5 to 12 carbon atoms.

14. An electrophotographic apparatus comprising an electrophotographic photosensitive member, a charging unit, an exposing unit, a developing unit and a transferring unit, the electrophotographic photosensitive member comprising in this order:

a support;

a charge generation layer;

a charge transport layer comprising a charge transporting material, and a polycarbonate resin having a structure selected from group A and a structure selected from group B; and a protective layer comprising a cured material of a composition comprising a compound having at least a functional group selected from chain-polymerizable functional groups and sequential polymerizable functional groups, wherein Group A is represented by formulae (101) and (102)

(101)

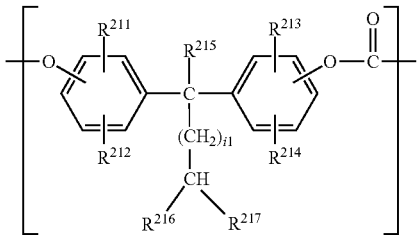

where $R^{211}$ to $R^{214}$ independently represent a hydrogen atom, an alkyl group, an aryl group or an alkoxy group; $R^{215}$ represents an alkyl group, an aryl group or an alkoxy group; $R^{216}$ and $R^{217}$ independently represent an alkyl group having one to nine carbon atoms; and i1 represents an integer of 0 to 3, provided that $R^{215}$ and $(CH_2)_{i1}CHR^{216}R^{217}$ are not the same;

(102)

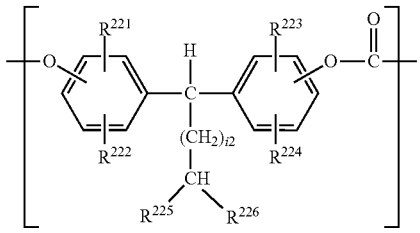

where $R^{221}$ to $R^{224}$ independently represent a hydrogen atom, an alkyl group, an aryl group or an alkoxy group; $R^{225}$ and $R^{226}$ independently represent an alkyl group having one to nine carbon atoms, provided that $R^{225}$ and $R^{226}$ are not the same; and i2 represents an integer of 0 to 3;

Group B is represented by formulae (104) to (106)

(104)

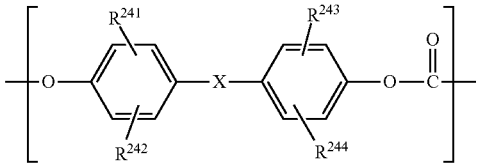

where $R^{241}$ to $R^{244}$ independently represent a hydrogen atom, an alkyl group, an aryl group or an alkoxy group; and X represents a single bond, an oxygen atom, a sulfur atom or a sulfonyl group;

(105)

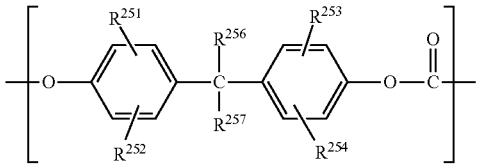

where $R^{251}$ to $R^{254}$ independently represent a hydrogen atom, an alkyl group, an aryl group or an alkoxy group; and $R^{256}$ and $R^{257}$ independently represent a hydrogen atom, an alkyl group, an aryl group or a halogenated alkyl group; and (106)

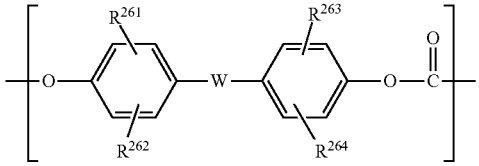

where $R^{261}$ to $R^{264}$ independently represent a hydrogen atom, an alkyl group, an aryl group or an alkoxy group; and W represents a cycloalkylidene group having 5 to 12 carbon atoms.

* * * * *